United States Patent [19]

Miyata et al.

[11] Patent Number: 4,641,954

[45] Date of Patent: Feb. 10, 1987

[54] APPARATUS FOR FORMING AN IMAGE ON ONE SIDE OF A RECORD MEDIUM AND IN ANOTHER MODE TO FORM IMAGES ON BOTH SIDES THEREOF

[75] Inventors: Masanori Miyata, Mitaka; Yutaka Komiya; Shinichi Nakamura, both of Tokyo; Masayuki Hirose, Yokohama; Hideki Adachi; Masahiro Tomosada, both of Kawasaki, all of Japan

[73] Assignee: Canon Kabushiki Kaisha, Tokyo, Japan

[21] Appl. No.: 640,333

[22] Filed: Aug. 13, 1984

[30] Foreign Application Priority Data

Aug. 16, 1983 [JP] Japan ..... 58-148711

[51] Int. Cl.[4] ..... G03G 15/00

[52] U.S. Cl. ..... 355/14 R; 355/3 R; 355/14 C; 355/23

[58] Field of Search ..... 355/3 SH, 14 SH, 23, 355/24, 14 R, 14 C

[56] References Cited

U.S. PATENT DOCUMENTS

| | | | |
|---|---|---|---|
| 4,099,860 | 7/1978 | Connin | 355/14 R X |
| 4,229,101 | 10/1980 | Hamlin et al. | 355/23 X |
| 4,277,165 | 7/1981 | Wada et al. | 355/3 SH X |
| 4,330,197 | 5/1982 | Smith et al. | 355/3 SH X |
| 4,437,756 | 3/1984 | Kawakubo et al. | 355/23 X |

*Primary Examiner*—A. C. Prescott

*Attorney, Agent, or Firm*—Fitzpatrick, Cella, Harper & Scinto

[57] ABSTRACT

An image forming apparatus has a copying machine operable in a single side copy mode and a double side copy mode, a processor for commanding an interrupting copy operation in the double side copy mode, and a bin for storing, in a non-sort mode, the double-side copied papers fed from the copying machine in the interrupting copy operation.

10 Claims, 123 Drawing Figures

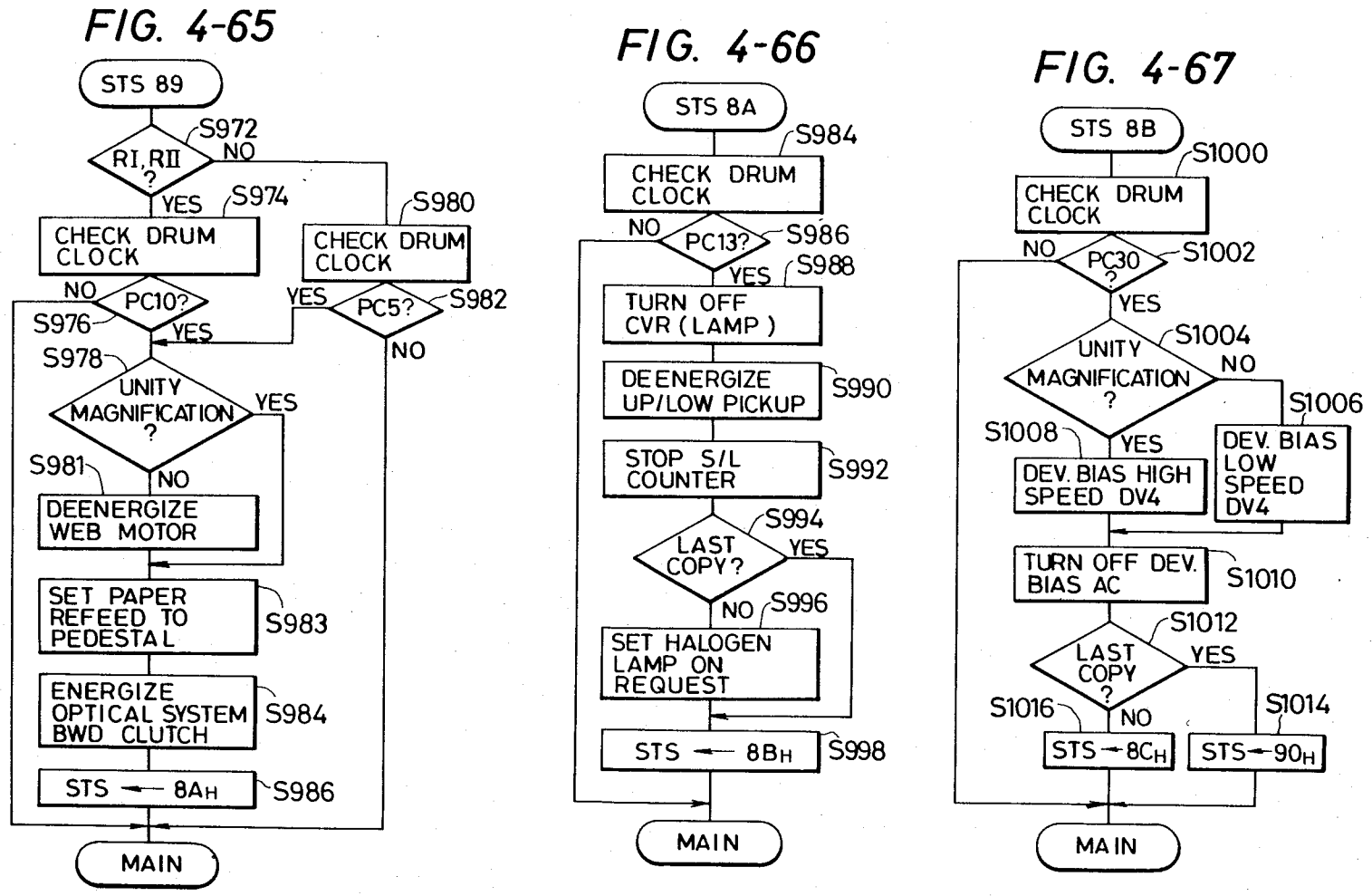
FIG. 4-65
STS 89
S972
RI, RII ?
NO
YES
S974
CHECK DRUM CLOCK
S980
CHECK DRUM CLOCK
S982
PC5?
NO
YES
PC10?
NO
YES
S976
S978
UNITY MAGNIFICATION ?
YES
NO
S981
DEENERGIZE WEB MOTOR
S983
SET PAPER REFEED TO PEDESTAL
S984
ENERGIZE OPTICAL SYSTEM BWD CLUTCH
S986
STS → 8AH
MAIN
FIG. 4-66
STS 8A
S984
CHECK DRUM CLOCK
S986
PC13?
NO
S988
YES
TURN OFF CVR (LAMP)
S990
DEENERGIZE UP/LOW PICKUP
S992
STOP S/L COUNTER
S994
LAST COPY?
YES
S996
NO
SET HALOGEN LAMP ON REQUEST
S998
STS → 8BH
MAIN
FIG. 4-67
STS 8B
S1000
CHECK DRUM CLOCK
S1002
PC30 ?
NO
YES
S1004
UNITY MAGNIFICATION ?
NO
S1006
DEV. BIAS LOW SPEED DV4
YES
S1008
DEV. BIAS HIGH SPEED DV4
S1010
TURN OFF DEV. BIAS AC
S1012
LAST COPY ?
YES
S1014
STS → 90H
NO
S1016
STS → 8CH
MAIN

FIG. 4-79

| | $b_7$ | $b_6$ | $b_5$ | $b_4$ | $b_3$ | $b_2$ | $b_1$ | $b_0$ |
|---|---|---|---|---|---|---|---|---|
| SNDCT | IN TRANS-MISSION | | | A/D REQ. | TRANS. COUNTER | | | |
| SLVCT | IN TRANS-MISSION | | | TIME OUT | BUSY TIME COUNT | | | |
| PEDCT | IN TRANS-MISSION | | | TIME OUT | BUSY TIME COUNT | | | |
| ADCCT | IN TRANS-MISSION | | | TIME OUT | BUSY TIME COUNT | | | |

FIG. 5-8

| DATA | DISPLAY | OUTPUT DATA | | | | | | | |
|---|---|---|---|---|---|---|---|---|---|
| | | D.P. | g | f | e | d | c | b | a |
| 0 | | 0 | 0 | 1 | 1 | 1 | 1 | 1 | 1 |
| 1 | | 0 | 0 | 0 | 0 | 0 | 1 | 1 | 0 |
| 2 | | 0 | 1 | 0 | 1 | 1 | 0 | 1 | 1 |
| 3 | | 0 | 1 | 0 | 0 | 1 | 1 | 1 | 1 |
| 4 | | 0 | 1 | 1 | 0 | 0 | 1 | 1 | 0 |
| 5 | | 0 | 1 | 1 | 0 | 1 | 1 | 0 | 1 |
| 6 | | 0 | 1 | 1 | 1 | 1 | 1 | 0 | 1 |
| 7 | | 0 | 0 | 1 | 0 | 0 | 1 | 1 | 1 |

FIG. 5-9

| DATA HEX | DISPLAY | OUTPUT DATA | | | | | | | |
|---|---|---|---|---|---|---|---|---|---|
| | | D.P. | g | f | e | d | c | b | a |
| 8 | | 0 | 1 | 1 | 1 | 1 | 1 | 1 | 1 |
| 9 | | 0 | 1 | 1 | 0 | 1 | 1 | 1 | 1 |
| A | | 0 | 1 | 1 | 1 | 0 | 1 | 1 | 1 |
| B | | 0 | 1 | 1 | 1 | 1 | 1 | 0 | 0 |
| C | | 0 | 0 | 1 | 1 | 1 | 0 | 0 | 1 |
| D | | 0 | 1 | 1 | 1 | 0 | 0 | 1 | 1 |
| E | | 0 | 1 | 1 | 1 | 1 | 0 | 0 | 1 |
| F | BLANK | 0 | 0 | 0 | 0 | 0 | 0 | 0 | 0 |

FIG. 7-1

| STATUS | DATA | $b_3$ | $b_2$ | $b_1$ | $b_0$ |
|---|---|---|---|---|---|
| 0 | CONDITION STATUS 1 | ABN / $\overline{\text{NOR}}$ | READY / $\overline{\text{NOT READY}}$ | WAIT COMPL / $\overline{\text{UNCOMP}}$ | PWR ON / $\overline{\text{OFF}}$ |
| 1 | CONDITION STATUS 2 | INT TRAY | 123 | | |
| 2 | PAPER STATUS 1 | MANUAL INSER-TION | S F / H | I Z A / B | E AB / U |
| 3 | PAPER STATUS 2 | | BACK COPY INT. TRAY PAPER EXHAUS-TED | CASSETTE ABSENT | PARER EXHAUS-TED |
| 4 | COPY STATUS | DUUBLE SIDE COPY FRONT END | COPY END | ADF CONTINU-OUS COPY RESET COUNT | COUNT DOWN REQ |
| 5 | JAM STATUS 1 LOW ORDER 4 BITS: NO. OF REMAINING PAPERS | | | | |
| 6 | JAM STATUS 2 LOW ORDER 4 BITS: POSITION | PAPER EJECTION | SEPARA-TION | LOWER CASSE-TTE | UPPER CASSE-TTE |
| 7 | JAM STATUS 3 | SWITCH BACK | | INT. TRAY | DECK |

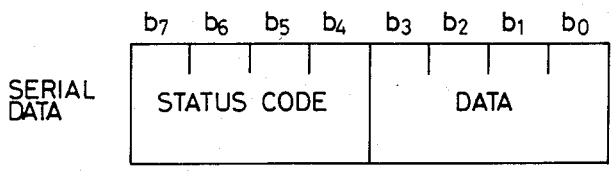

FIG. 7-2

| STATUS | DATA | $b_3$ | $b_2$ | $b_1$ | $b_0$ |
|---|---|---|---|---|---|
| 8 | JAM STATUS 4 | | | SORTER | A<br>D<br>F |
| 9 | OUT PUT CONTROL 1 | DEV BIAS.<br>ON/$\overline{\text{OFF}}$ | SECOND-ARY<br>ON/$\overline{\text{OFF}}$ | PRIMARY<br>ON/$\overline{\text{OFF}}$ | |
| A | OUT PUT CONTROL 2 | LAMP/$\overline{\text{HEATER}}$ | CVR<br>ON/$\overline{\text{OFF}}$ | | LENS POSITION UNITY MAG. |
| B | POWER-ON STATUS 1 | | JAM ON | DECK<br>$\overline{\text{PRE}}$/ABS | DOUBLE SIDE<br>$\overline{\text{OR}}$<br>/$\overline{\text{NOT OK}}$ |
| C | POWER-ON STATUS 2 | JAM KILLED | OTHERS KILLED | CHECK PROG | TIMER KILLED |
| D | POTENTIAL CONTROL | $DB_3$ | $DB_2$ | $DB_1$ | $DB_0$ |
| E | AE CONTROL | AE MEASUR-MENT EXPO-SURE | | AE<br>ON/OFF | AE<br>RESET |
| F | SERVICEMAN CALL FRROR LOW ORDER 4 BITS NO. BLINK E0 ~ E9 | | | | |

FIG. 8

| $b_7$ | $b_6$ | $b_5$ | $b_4$ | $b_3$ | $b_2$ | $b_1$ | $b_0$ |
|---|---|---|---|---|---|---|---|
| 0 | 0 | 0 | INTERRUPT INPUT | STOP INPUT | AUTOSHUT OFF | DECK SELECT | UPPER / $\overline{\text{LOWER}}$ SELECT |
| 0 | 0 | 1 | ABNOR-MAL | MANUAL / $\overline{\text{AE}}$ | UNITY MAG. | R / $\overline{\text{E}}$ | I / $\overline{\text{II}}$ |
| 0 | 1 | 0 | START (LENS MOVEMENT END) | DOUBLE SIDE BACK STAND-BY | SINGLE SIDE FRONT STAND-BY | DOUBLE SIDE FRONT STAND-BY | SINGLE SIDE COPY STAND-BY |
| 0 | 1 | 1 | | | | | |
| 1 | | | | | | (COUNT 1~63H) | |

FIG. 9-1

| | $b_7$ | $b_6$ | $b_5$ | $b_4$ | $b_3$ | $b_2$ | $b_1$ | $b_0$ |
|---|---|---|---|---|---|---|---|---|
| MPSTS 0 | 0 | 0 | DECK LIFT-UP INHIBIT | IMAGE LEADING EDGE | JAM PEDESTAL STOP REQUEST | | INT. TRAY PAPER REFEED | PAPER FEED REQUEST |
| MPSTS 1 | 0 | 1 | DECK STAND-BY | DOUBLE SIDE BACK MODE STAND-BY | DOUBLE SIDE FRONT MODE STAND-BY | INT. F/H | TRAY PAPER A/B | SIZE AB/U |
| MPSTS | 1 | 1 | 1 | 1 | 0 / 1 CHECK PRO | $\overline{\text{JAM KILL}}$ | POWER ON/$\overline{\text{OFF}}$ | $\overline{\text{MOTOR LOW}}$/HIGT / INT. TRAY CONT. FEED |
| MPSTS 3 | 1 | PRESET COUNT 1~63H | | | | | | |

FIG. 9-2

| | $b_7$ | $b_6$ | $b_5$ | $b_4$ | $b_3$ | $b_2$ | $b_1$ | $b_0$ |
|---|---|---|---|---|---|---|---|---|
| PMPSTS 0 | 0 | 0 | DECK LIFT-UP REQUEST | PAPERS PRESENT IN INT. TRAY | INT. TRAY TRAY READY | INT. TRAY PAPER FEED JAM | DECK PAPER FEED JAM | DOUBLL SIDE MODE FRONT END |
| PMPSTS 1 | 0 | 1 | PEDESTAL ABNORMAL | INT. TRAY NOT FEED OR DOUBLE FEED | PAPERS PRESENT IN DECK | DECK PAPER SIZE F/H | A/B | AB/U |
| PMPSTS 2 | 1 | 1 | 1 | 1 | | | | |
| PMPSTS 3 | 1 | NO OF PAPERS LEFT IN INT. TRAY 1~63H | | | | | | |

APPARATUS FOR FORMING AN IMAGE ON ONE SIDE OF A RECORD MEDIUM AND IN ANOTHER MODE TO FORM IMAGES ON BOTH SIDES THEREOF

BACKGROUND OF THE INVENTION

1. Field of the Invention

The present invention relates to an image forming apparatus for forming an image.

2. Description of the Prior Art

An image forming apparatus capable of forming (or copying) images on both sides of a record medium has been known. In such an apparatus, a single side mode in which an image is copied on one side of the record medium and a double side mode in which images are copied on the both sides are selectively used to copy the images. In the prior art apparatus of this type, it is possible to interrupt the double side mode by the single side mode by depressing an interruption key, but it is not possible to interrupt the single side mode by the double side mode. Thus, an operator has to wait for the completion of the current copying operation.

In the prior art apparatus of this type, if a copying operation for a back side is cancelled during the execution of the double side mode copying operation, a record medium having an image copied on one side thereof is left in an intermediate tray of the apparatus and the operator must take out the record medium from the intermediate tray.

When a sorter is used in combination with the apparatus, the record media are sorted without images being copied on the back sides and hence the pages are disordered.

If the record media are double-fed during the back side copying operation and hence the record media in the intermediate tray are exhausted before a preset number of media are handled, the copying operation is stopped as the jam has occurred or an optical system is scanned while no record medium is present.

The copying machine consumes a high power during the copying operation. In the copying machine which uses a home plug socket (100 V, 15 A), a drive current must always be maintained below a predetermined level. However, since a fixer heater in the copying machine consumes a high power (e.g. 800 W), the current consumed significantly increases when a deck which accommodates a large number of record papers (e.g. 2000 papers) is lifted up. As a result, the current significantly exceeds the current rating of the plug socket.

A transferred image must always be fixed in a predetermined temperature range (e.g. around 180° C). However, when a large number of images are continuously fixed, the heat is absorbed by the record papers and the temperature of the fixer gradually falls. If the temperature of the fixer falls below a predetermined temperature (e.g. 150° C.), the copying operation must be stopped until the temperature of the fixer rises. As a result, a throughput is lowered.

In the image forming apparatus such as the copying machine, the current capacity is limited due to the requirement for the plug socket. Accordingly, it is usually impossible to increase the heater drive current when the temperature of the fixer drops.

In such apparatus, independently operated microprocessors such as a microprocessor exclusively used to control a sequence and a microprocessor for managing an overall copying operation are used. With such a construction, however, the number of input/output ports of the sequence control processor is very large and a large volume of wirings are required for the apparatus.

In a system having a plurality of processors, necessary communication control is carried out by using microprocessors in the respective units of the system. Those microprocessors require lines for transmitting and receiving request signals. The communication is done in one way, that is, only the unit which issued the transmission request transmits a data and other units receive the data. As a result, the communication procedures are complex and it is difficult to reduce the communication time. Further, a large volume of lines must be connected among the processors.

When a serial communication is to be carried out among a plurality of processors, a communication request right is imparted to each of the processors and a complex communication control is carried out. As a result, the communication control is complex particularly when the communication requests compete.

SUMMARY OF THE INVENTION

It is an object of the present invention to provide an improved image forming apparatus.

It is another object of the present invention to provide an image forming apparatus having an improved operability.

It is other object of the present invention to provide an image forming apparatus capable of efficiently forming images on both sides of a record paper.

It is other object of the present invention to provide an image forming apparatus which permits interruption of a single side mode by a double side mode.

It is other object of the present invention to provide an image forming apparatus which reduce a trouble when record papers are double-fed during the double side mode copying operation.

It is other object of the present invention to provide an improved system for effecting a serial communication among a plurality of microprocessors.

It is other object of the present invention to provide a serial communication control system which minimizes the number of necessary signal lines and reduces the communication time.

It is other object of the present invention to provide an image forming apparatus which has a plurality of microprocessors, and controls a sequence in synchronism with a drum clock to synchronize the processors.

It is other object of the present invention to provide a control system which enables a serial communication under a simple communication control.

The above and other objects of the present invention will be apparent from the following description of the invention.

DETAILED DESCRIPTION OF THE PREFERRED EMBODIMENTS

Figure 1:
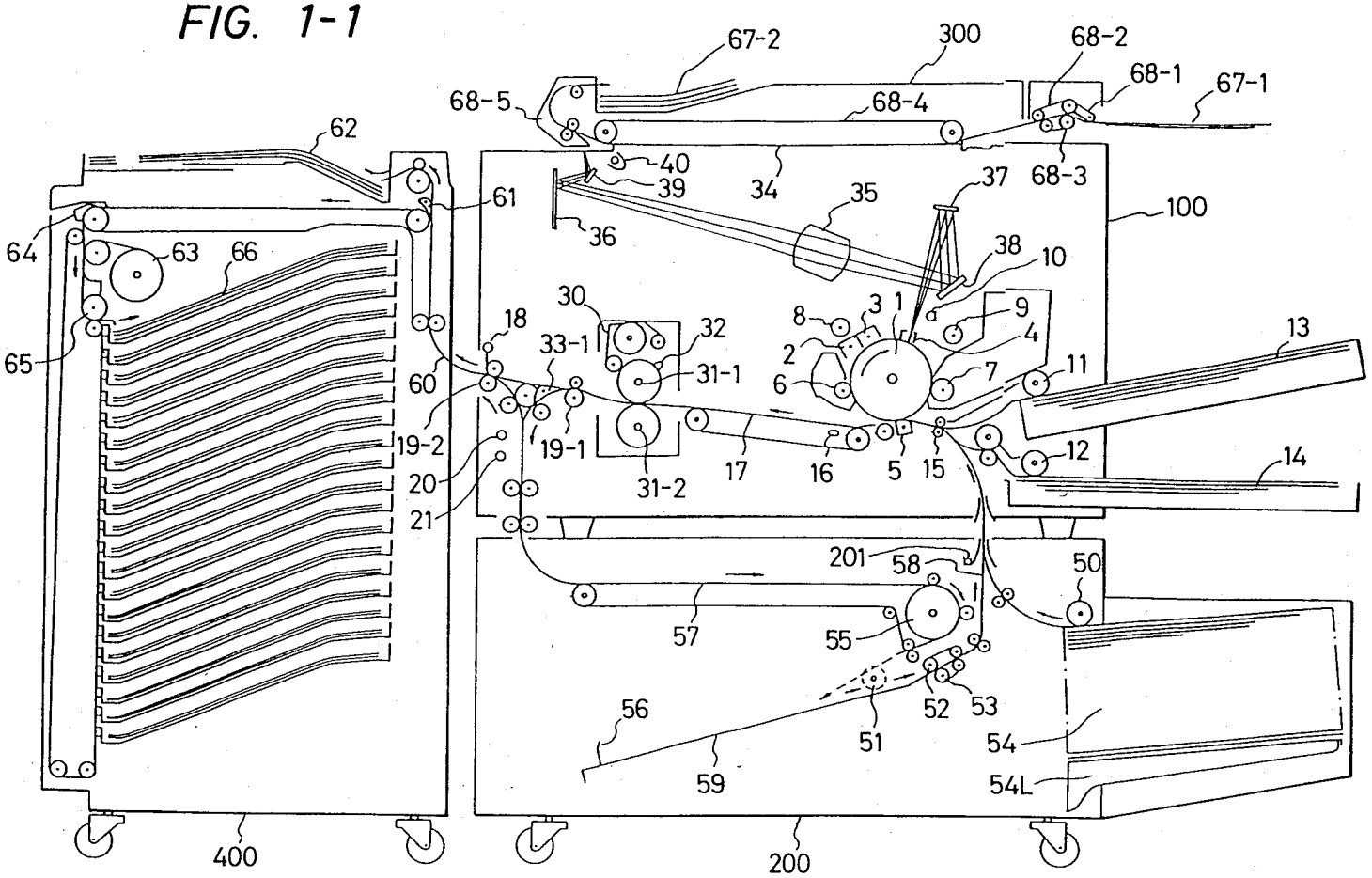
FIGS. 1(1)–1(3) show constructions of one embodiment of a double side copying machine in accordance with the present invention.

FIG. 1(1) shows a sectional view of one embodiment of a double side copying machine in accordance with the present invention, FIG. 1(2) shows an enlarged view of a record paper convey path in FIG. 1(1), and FIG. 1(3) shows an enlarged view of a record paper switch-back unit in FIG. 1(1).

In those figures, a surface of a drum 1 comprises a three-layer seamless photoconductive member made of a CdS photoconductor. The drum 1 is rotatably supported and rotated in a direction of an arrow by a main motor (not shown) which is energized in response to the depression of a copy start key. After a predetermined angle of rotation of the drum 1 and potential control processing (pre-processing) to be described later, an original sheet mounted on an original sheet mount glass 34 is illuminated by an illumination lamp 40 which is in union with a first scan mirror 39, and a light reflected therefrom is scanned by the first scan mirror 39 and a second scan mirror 36.

The first scan mirror 39 and the second scan mirror 36 are moved at a relative speed ratio of 2 to 1 so that the original sheet is scanned while an optical path length to a lens 35 is always kept constant. The reflected light image is focused on the drum 1 through the lens 35, a third mirror 38 and a fourth mirror 37.

The drum 1 is simultaneously discharged by a pre-exposure lamp 8 and a pre-discharger 2 and then corona-charged (e.g. positively charged) by a primary charger 3. Thereafter, the image illuminated by the illumination lamp 40 is slit-exposed. The drum 1 is corona-discharged (AC or in the opposite polarity to that of the primary charging) by a secondary charger 4 and then it is uniformly exposed by a flat exposure lamp 9 to form a high contrast electrostatic latent image on the drum 1.

The electrostatic latent image on the photoconductor drum 1 is then developed by a developing roller of a developer 7 so that it is visualized as a toner image, which is transferred by a transfer charger 5.

A record paper in an upper cassette 13 or a lower cassette 14 is fed into the copying machine by a paper feed roller 11 or 12, and fed toward the photoconductor drum 1 at a precise timing determined by a registration roller 15 so that a leading edge of the record paper is registered with a leading edge of the image. Then, the record paper is conveyed between the transfer charger 5 and the drum 1 so that the toner image on the drum 1 is transferred to the record paper.

After the transfer, the record paper is separated from the drum 1, conveyed to a fixing roller 32 by a conveyor belt 17 through a paper sensor 16 and the image is fixed by heat and pressure. Then, the record paper is fed out of the machine by ejection rollers 19-1 and 19-2 through a paper sensor 18.

After the fixing, the fixing roller 32 is cleaned by a web 30. After the transfer, the drum 1 continues to rotate so that the surface of the drum 1 is cleaned by a cleaning unit 6 having a cleaning roller and an elastic blade.

A pedestal 200 may be separated from a main unit 100 and it has a deck 54 capable of accommodating up to 2000 record papers and an intermediate tray 59 for the double side copy. A lifter 54L for the deck 54 which can accommodate up to 2000 papers is lifted up or down in accordance with the quantity of the record papers so that the record paper always contacts to a paper feed roller 50.

In the double side copying operation, a flapper 33-1 in the main unit 100 is turned over so that the record paper having a copy formed thereon is fed to the pedestal 200 and stored in the intermediate tray 59 through a feed path 57 of the pedestal 200. A paper size control plate 56 is moved in accordance with the size of the papers to be accommodated. The intermediate tray 59 can accommodate up to 99 record papers.

In the back side copying operation to be carried out next, the record papers accommodated in the intermediate tray 59 are fed to the registration roller 15 of the main unit 100 through a path 58 by paper feed rollers 51 and 52 and a separation roller 53.

In FIG. 1(1), numeral 300 denotes an automatic document feeder (ADF), numeral 67-1 denotes a paper feed tray in which original sheets are mounted and numeral 67-2 denotes a paper ejection tray. When a copy start button (not shown) on the main unit 100 is depressed, the original sheet is fed to a conveyor belt 68-4 through a paper feed roller 68-1, a conveyor roller 68-2 and a double-feed prevention separation roller 68-3. The original sheet is mounted at a predetermined position on the original sheet mount glass 34 of the main unit 100 and the copy operation is started. When a series of copy operations for the original sheet have been completed, the original sheet is ejected to the ejection tray 67-2 through an ejection unit 68-5 by the conveyor belt 68-4. So long as the original sheet is present in the paper feed tray 67-1, the next original sheet is fed simultaneously with the ejection of the current original sheet.

Numeral 400 denotes a sorter/collator which sorts and collates the copies ejected from the main unit. Numeral 66 denotes sort bins which may include 20 bins. Numeral 62 denotes a non-sort bin. When more than 20 copies are to be made from one original sheet, the 21st and following copies are ejected into the bin 62, or when the main unit 100 issues an interruption, the record paper after the interruption are ejected into the bin 62. Numeral 64 denotes a flapper for directing the record papers to another sorter when a plurality of sorters 400 are serially operated.

Figures 1, 2:
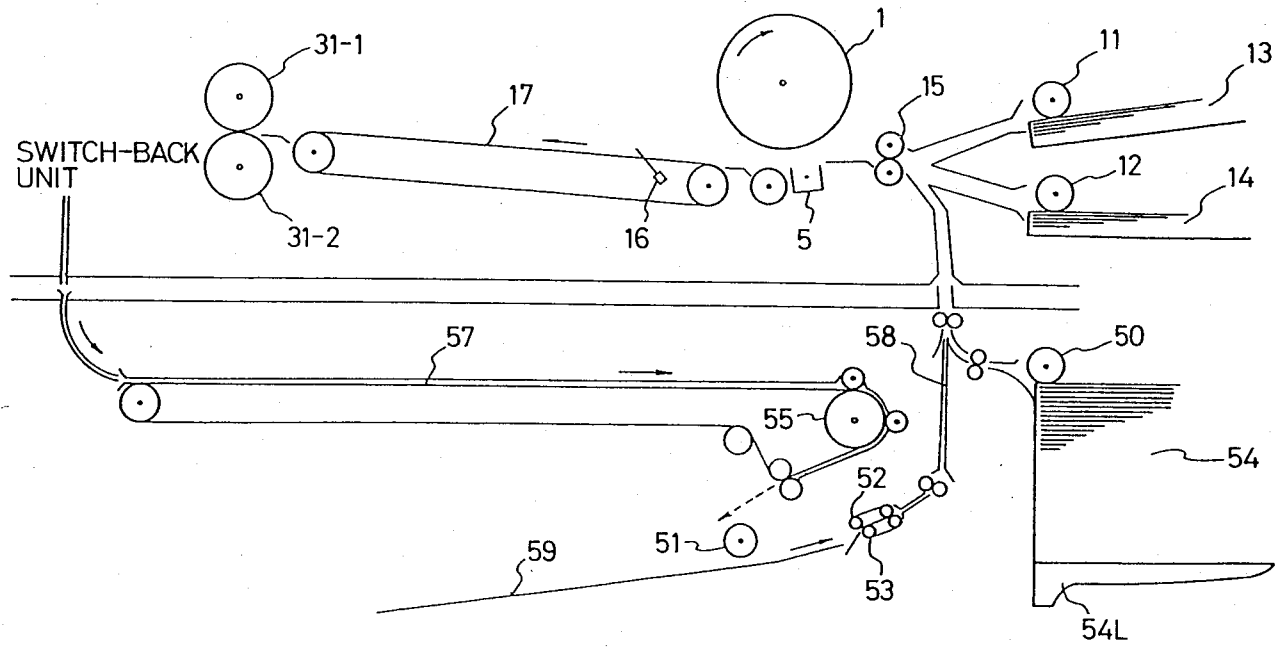
FIG. 2 is a plan view of a console panel of the double side copying machine of FIG. 1, FIGS. 3(1)–3(3) show control circuits of the double side copying machine of FIG. 1, FIGS. 4(1)–4(79) show control sequences of a master Q101 shown in FIG. 3(1), FIGS. 5(1)–5(11) show control sequences of a slave Q102 shown in FIG. 3(1), FIGS. 6(1)–6(11) show control sequences of a pedestal controller Q103 shown in FIG. 3(1), FIGS. 7(1) and 7(2) show serial communication data from the master Q101 to the slave Q102.

FIG. 2 is a plan view of a console panel on the main unit 100 of the copying machine shown in FIG. 1(1). Numeral 75 denotes a key for selecting the upper cassette 13, the lower cassette 14 and the 2000-paper deck 54. Numeral 81 denotes a slide lever for setting a copy density. A position 5 indicates a standard density. Numeral 73 denotes numeric keys for setting number of copies, numeral 74 denotes a clear key for cancelling the member set by the keys 73, numeral 72 denotes an interruption key for interrupting the copy operation before the preset number of copies are made to effect another copy operation, numeral 70 denotes a copy key for commanding the start of the copy operation, numeral 71 denotes a stop key for stopping the copy operation during the continuous copy operation, numerals 76, 77 and 77 denote keys for selecting a unity magnification copy, a magnified copy and a reduced copy, respectively, and numerals 94–96 denote displays for displaying selected magnification factors. The display 96 displays a selected reduction copy mode, the display 95 displays a magnified copy mode and the display 94 displays a unity magnification copy mode.

Numeral 93 denotes a display for displaying the cassette 13 or 14 or the deck 54 selected by the cassette selection key 75 and numeral 92 denotes a display for displaying a size of the record papers accommodated in the selected cassette. If the selected cassette is improper when the reduction key 78 is depressed, the display 92 flashes to indicate it. The size of the previously selected cassette is also displayed.

Numerals 82–86 denote alarm displays for the main unit. They are displayed by picture patterns numeral 82 denotes the paper feed check display which is lit when the record paper is jammed in the machine. The display 83 is bit when the cassette is not loaded in the cassette box indicated by the record paper 1 cassette display or when the record papers in the cassette loaded in the cassette box are exhausted. Numeral 84 denotes the ejected toner full display which is lit when a vessel (not shown) is filled with the toner used in the machine and recovered. Numeral 85 denotes the developing agent refill display which is lit when the developing agent in the developer is less than a predetermined amount. Numeral 86 denotes the key counter display which is lit when a key counter is not inserted in a socket of the main unit.

Numeral 89 denotes a wait display which is lit when a temperature of a fixer heater is lower than a predetermined temperature upon turn-on of a power switch and turned off when the temperature reaches the predetermined temperature.

Numeral 87 denotes a copy count display. When a desired count is set by the ten-key 73, the count is displayed by 7-segment numerals. Up to count 99 can be set. Approximately 60 seconds after the completion of the copy operation or when the clear key 74 or the interruption key 72 is depressed, the display of the preset number or the copy number is automatically changed to "01".

Numeral 88 denotes an interruption display which is lit when the interruption key is depressed and turned off when the interruption processing is completed.

Numeral 79 denotes a selector key for an automatic exposure control mode (AE). When the key 79 is depressed, the density control lever 81 is rendered invalid and a sharp image having no fog is always formed from the original sheet.

Numeral 80 denotes an automatic double side selection key which can be selected only when the pedestal 200 having the double side intermediate tray 59 (see FIGS. 1(1) and 1(2)) and the main unit 100 are used in combination.

Numerals 90 and 91 denote LED's (light emitting diodes) for indicating the operations in the double side copy operation. The LED 90 is lit during the front side copy operation and the LED 91 is lit during the back side copy operation.

Numeral 98 denotes a display for displaying a position of a jam. It has nine LED's to display the position.

Numeral 99 denotes a green LED for indicating the presence of the record papers in the intermediate tray 59 (see FIGS. 1(1) and 1(2)). It is lit so long as the record paper is present in the intermediate tray 59.

Figures 1, 2, 3:
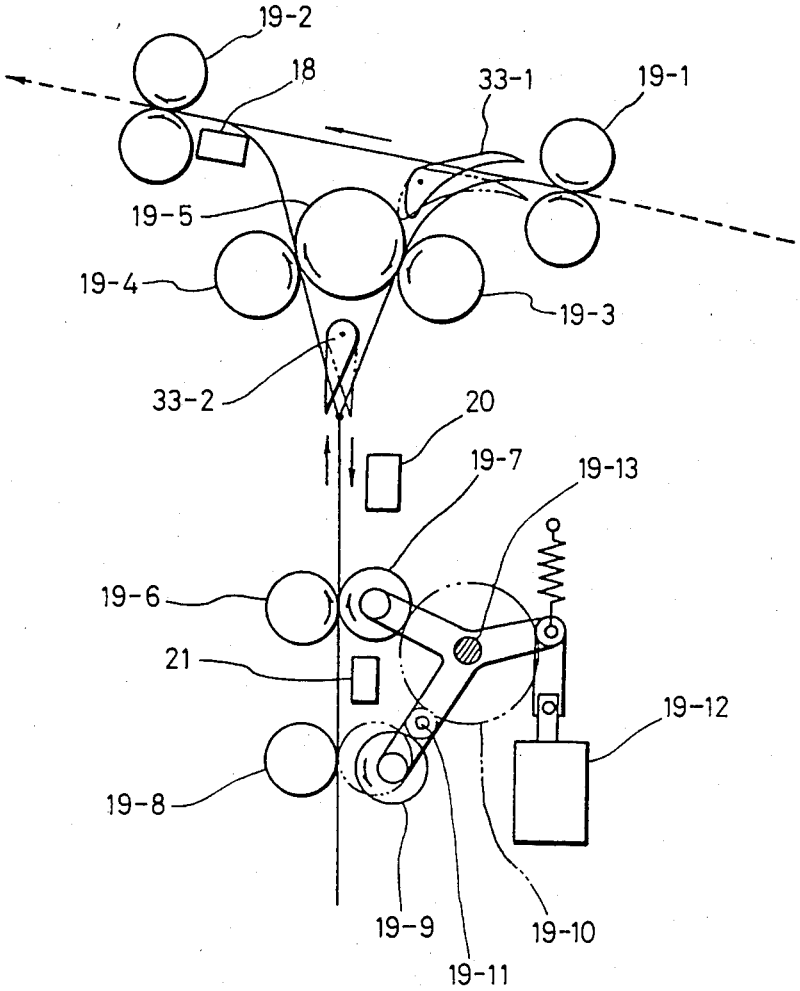
Figure 2:
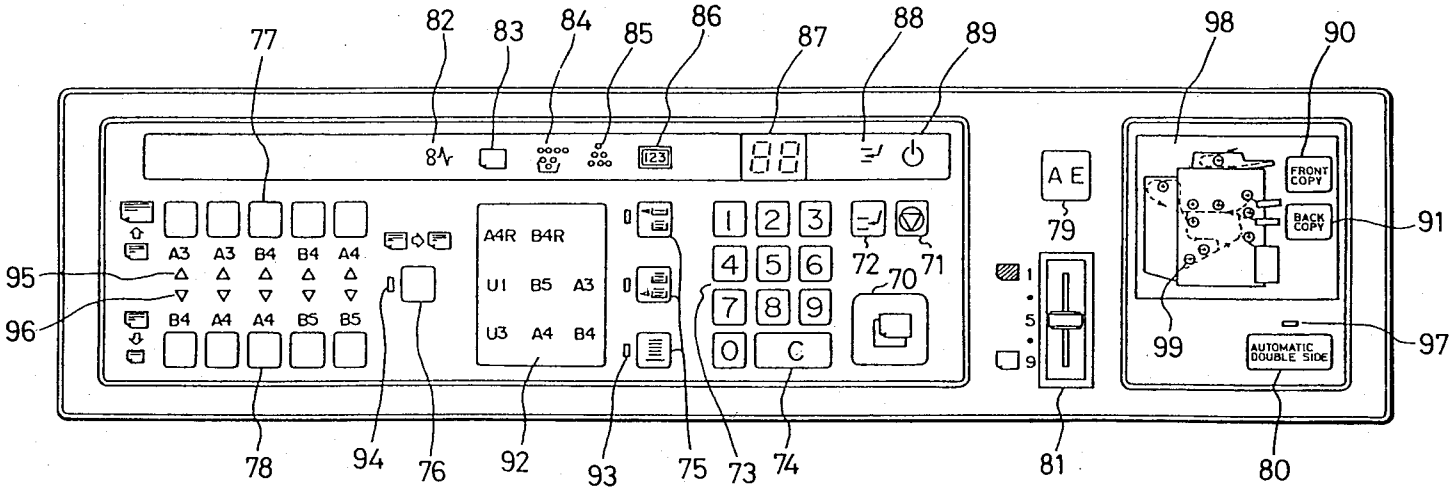

FIG. 3(1) shows a control circuit of the copying machine shown in FIGS. 1(1)–1(3). Q101 denotes a microcomputer (hereinafter referred to as a master) which controls the energization of the main motor and the high voltage transformer for carrying out the copy process and controls the communication with other microprocessors. The master Q101 is a one-chip microcomputer which comprises a ROM memory for storing control programs shown in FIGS. 4(1)–4(79) as instruction code routines, a RAM memory for storing process timing data for the sequence control and size data from the cassette sensor and a CPU having I ports, O ports and I/O ports for controlling inputs and outputs.

Figures 1, 4:
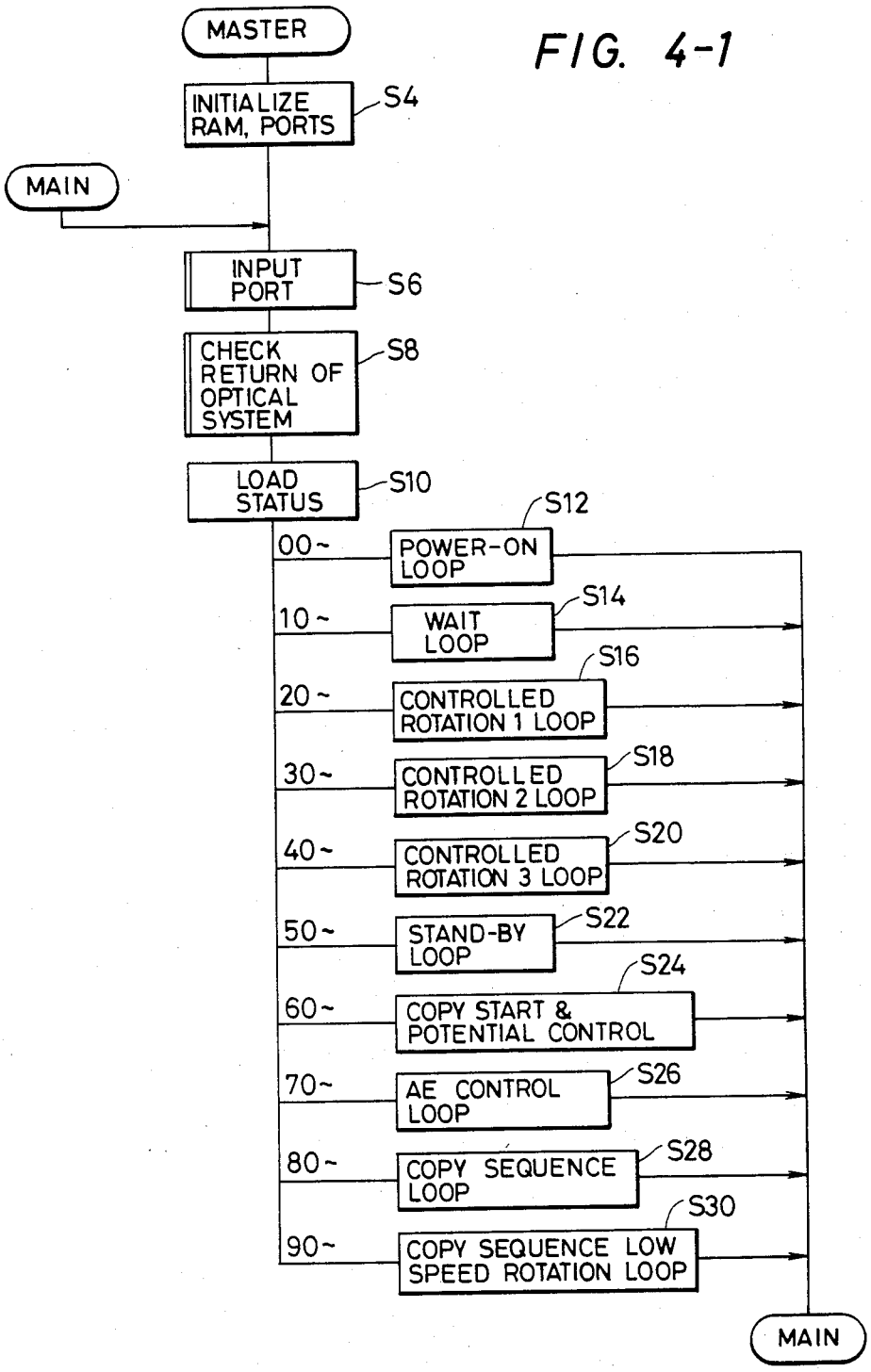
Figures 3, 4:
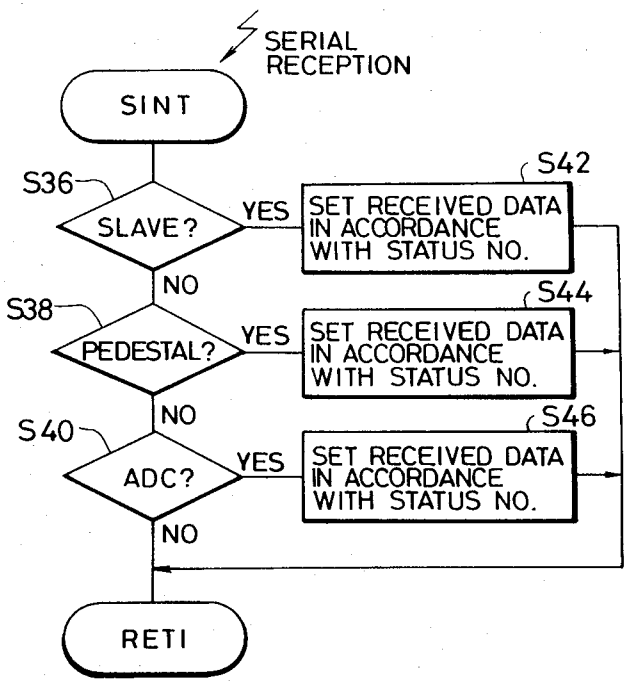
Figures 2, 4:
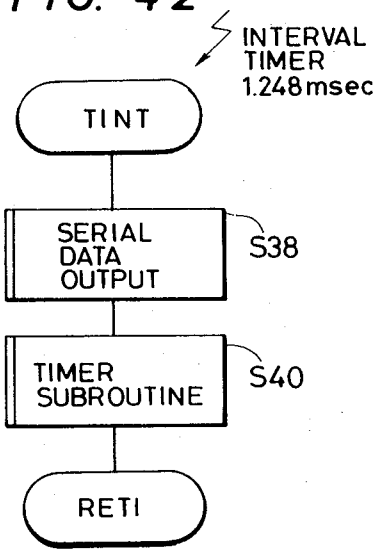
Figure 4:
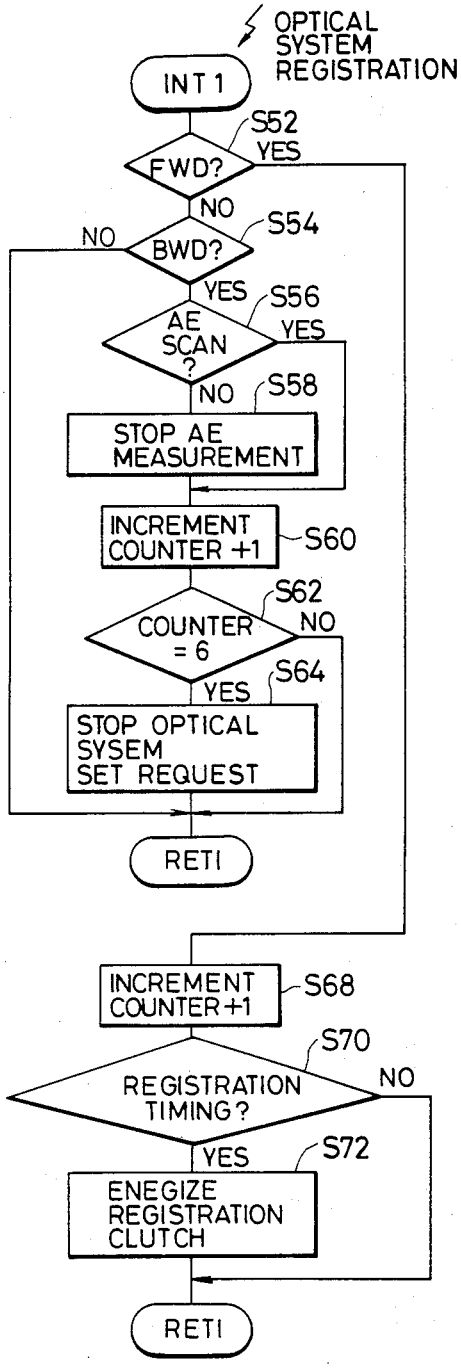
Figures 4, 5:
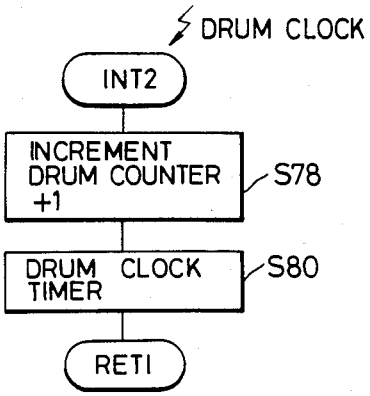

Q102 denotes a one-chip microcomputer similar to Q101 and a ROM memory (not shown) thereof stores control programs shown in FIGS. 5(1)–5(6). The Q102 is hereinafter referred to as a slave.

A dynamic display unit 800 for driving the display on the console panel (see FIG. 2) is connected to the ports O3 and O4 of the slave Q102, and a key matrix 801 for the input circuits of the keys is connected to the port I2 of the slave Q102.

Q103 denotes a one-chip microcomputer similar to Q101. It controls the pedestal 200 shown in FIG. 1(1). The Q103 is hereinafter referred to as a pedestal controller. The timing of the deck paper feed and the sequence in the double side copy mode are controlled through a serial communication between the pedestal controller Q103 and the master Q101. A ROM memory (not shown) of the Q103 stores control programs shown in FIGS. 6(1)–6(11).

Q104 denotes an A/D converter which effects the serial communication with the master Q101 to control the temperature of the fixer heater. The A/D converter Q104 has four enalog input lines ADIN and connected to a thermister 850 of the fixer as well as to a temperature sensor of a drum heater, a CdS for checking the amount of used toner (by checking a potential of a used toner box) and a dummy potentiometer mounted on the circuit board.

The A/D converter Q104 and the master Q101 effect the serial communication upon serial request from the master Q101 as is done between the slave Q102 and the master Q101. The master Q101 reads in one of the analog inputs as an 8-bit data under a control of an internal timer (not shown) (at every 16th interruption by the internal timer) and designates an analog input channel of the A/D converter Q104.

Q105–Q107 denote extended I/O's for extending the input/output ports of the microcomputers Q101 and Q102.

The respective microcomputers are interconnected by five serial transfer control lines and the master Q101 controls the communication. For example, the port 08 of the master Q101 is a request signal output terminal of the communication to the microcomputer Q102.

When the receiving microcomputer Q102 is ready for communication, it returns an ENABLE signal to the port I2 of the master Q101. When eight serial clocks SCK are sent out from the master Q101, a content of an 8-bit shift register in the microprocessor Q102 and a content of an 8-bit shift register in the master Q101 are exchanged simultaneously (see FIG. 11).

Figures 4, 5, 6:
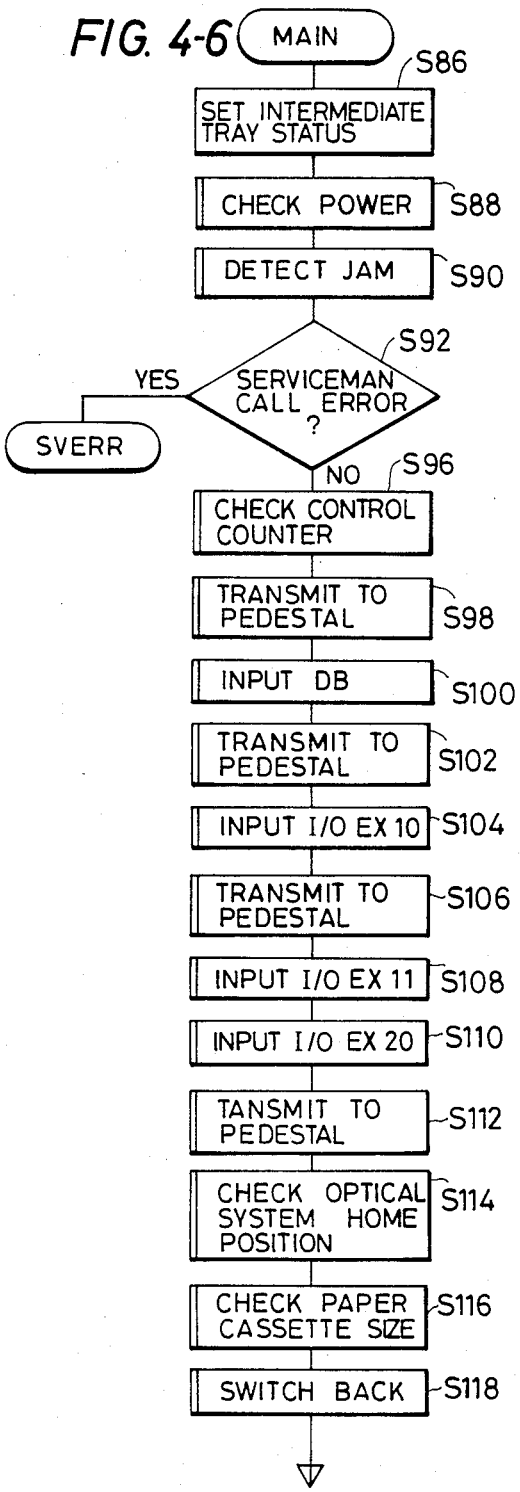
Figures 4, 5, 6, 7:
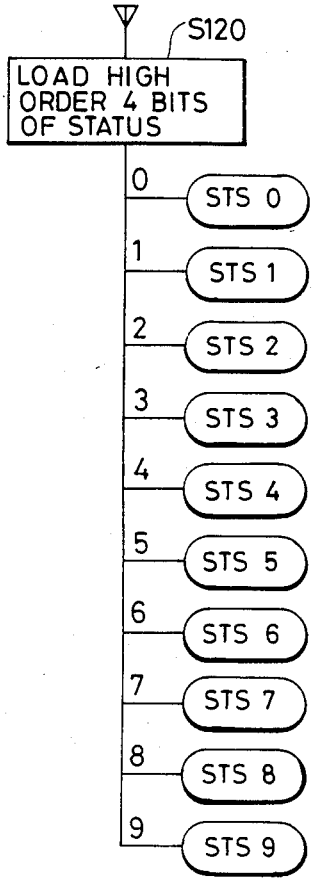
Figures 4, 5, 6, 7, 8:
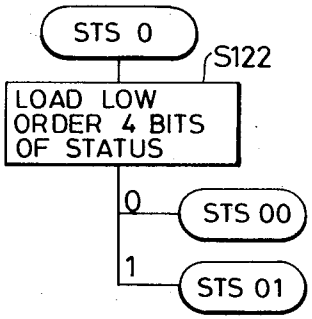
FIG. 8 shows a serial communication data from the slave Q102 to the master Q101, FIG. 9(1) shows a serial communication data from the master Q101 to the pedestal controller 103, FIG. 9(2) shows a serial communication data from the pedestal controller Q103 to the master Q101.
Figures 4, 5, 6, 7, 8, 9:
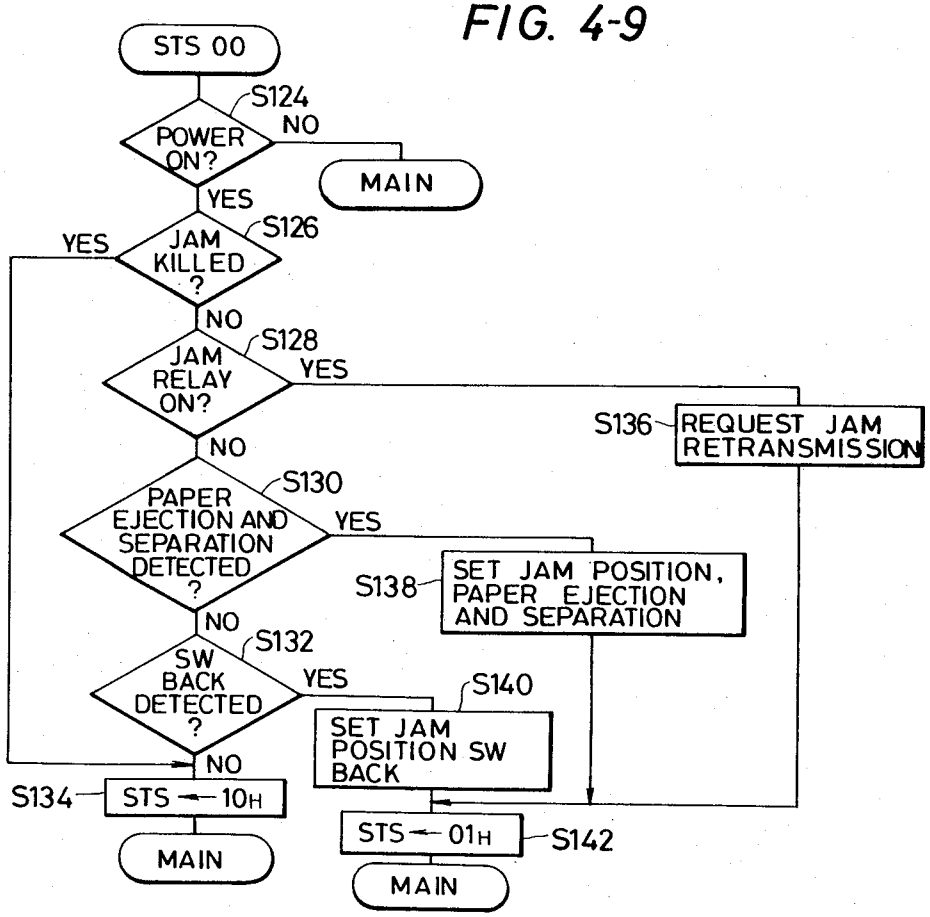
Figures 4, 5, 6, 7, 8, 9, 10:
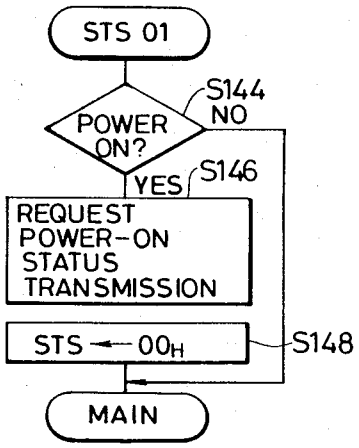
FIG. 10 shows a timing chart for the serial transfer.
Figures 4, 5, 6, 7, 8, 9, 10, 11:
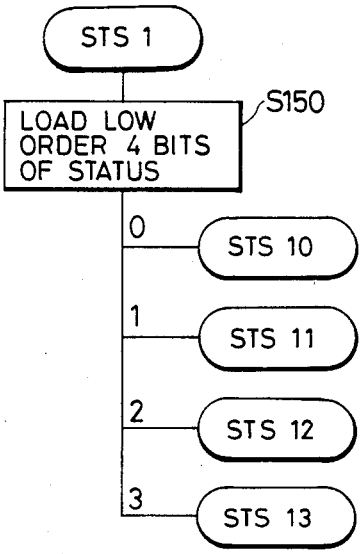
FIG. 11 illustrates a communication control by the master Q101.
Figures 4, 5, 6, 7, 8, 9, 10, 11, 12:
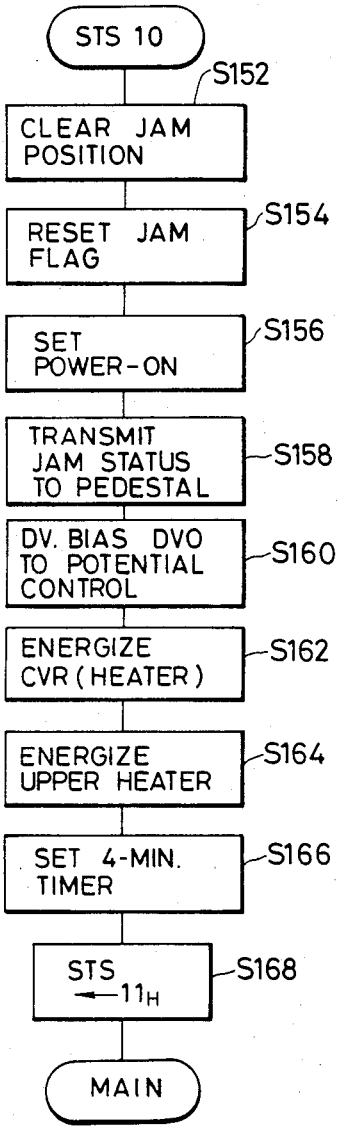
FIG. 12 shows a timing for a serial clock SCK, a serial out SO and a serial in SI, and FIGS. 13(1)–13(4) show sequence control charts of the present embodiment.

Referring to FIG. 11, SO denotes a serial output data and SI denotes a serial input data. The serial output data SO is sent out is synchronism with the rise of the serial clock SCK and the serial input data SI is latched at the fall of the serial clock SCK. A timing chart therefor is shown in FIG. 12.

The communication timing among the microcomputers is managed by the interval timer except during the copy operation. As shown in FIG. 10, the master Q101 serial-communicates with the slave Q102 once for very 1,248 msec., with the pedestal controller Q103 at every fourth timing, and with the A/D converter Q104 at every sixteenth timing.

On the other hand, during the copy sequence, the master Q101 communicates with the pedestal controller Q103 in synchronism with the drum clock and communicates with the slave Q102 and the A/D controller Q104 based on the interval timer.

Referring to FIGS. 1(1) to 1(3) and 2, the double side copy operation is explained.

When the automatic double side selection key 80 shown in FIG. 2 is depressed, the front side copy is indicated by the LED 90. The number of copies is set by the copy count setting keys 73 and the copy start key 70 is depressed. Thus, the front side copy operation is carried out for the preset number of copies. A timing chart therefor is shown in a front half of FIG. 13(4).

The copied second papers are not ejected because of the action of the flapper 33-1 in the switch-back unit but stored in the intermediate tray 59 through the convey path 57 in the pedestal.

The paper size control plate 56 in the intermediate tray starts to move when the copy start key 70 is depressed, in accordance with the paper size information sent from the master Q101 in the main unit 100. The main unit 100 starts to feed the paper after it has received the serial communication data (bit b3 "intermediate tray ready" signal of PMSTSO shown in FIG. 9(2)) sent from the pedestal controller Q103.

When the record papers having images copied on the front sides are stored in the intermediate tray 59, the intermediate tray paper feed roller 51 is pulled up by a solenoid (not shown).

As the record papers are fed into the intermediate tray 59, the master Q101 receives the serial communication data from the slave Q02 (bit $b_4$ by PMSTSO shown in FIG. 9(2)). Then, the master Q101 sends a "papers present in intermediate tray" data (see status 1 in FIG. 7) to the slave Q102 and the LED 99 (see FIG. 2) of the slave Q102 is lit to indicate the presence of the papers in the intermediate tray.

After the preset number of papers have been stored in the intermediate tray 59, the drive systems of the main unit 100 and the pedestal 200 are stopped and the front side copy display LED 90 on the console panel is turned off, and the back side copy display LED 91 is lit.

The upper/lower cassettes and deck selection display LED 93 is turned off and the paper size display 92 displays the size of the papers stored in the intermediate tray 59. Accordingly, the subsequent depression of the upper/lower cassettes and deck selection key 75 is disregarded.

The automatic exposure (AE) selection key 79 and the magnification factor setting keys 76 (unity magnification), 77 (magnification) and 78 (reduction) may be depressed so that the copies can be made on the front side and the back side at different magnification factors.

Even if the copy count setting keys 73 are depressed, the key inputs are not accepted and the copy count display 87 displays the number of papers stored in the intermediate tray 59.

When the copy start key 70 is depressed, the intermediate tray paper feed roller 51 is moved down by a solenoid (not shown) and contacts to the record paper. The paper feed from the intermediate tray 59 is started in response to the serial communication data (bit $b_6$ "paper feed request" signal of MPSTSO shown in FIG. 9(1)) sent from the master Q101 in the main unit 100. A sequence therefor is shown in a rear half of the timing chart shown in FIG. 13(4).

As the image is copied on the back side of the record paper, the record paper is ejected through the fixing rollers 31-1 and 31-2. When the sorter 400 is attached, the paper is reversed before it is ejected. This is required to collate the double side copy papers and the reversal mechanism is called a switchback mechanism.

FIG. 1(3) shows the enlarged view of the switchback mechanism. In the back side copy mode, the record paper fed through the fixing rollers 31-1 and 31-2 is moved down by a flapper 33-1, and when the trailing edge of the record paper is detected by the first switchback sensor 20, a reversal roller 19-9 is rotated by a solenoid 19-12 to fall a flapper 33-2 toward the ejection port so that the record paper is ejected by rollers 19-4 and 19-2. Then, as the second switch-back sensor 21 detects the trailing edge of the record paper, the solenoid 19-12 is returned to the forward position to be ready for the next switch-back operation.

Since the convey path of the record paper is long in the back side paper feed (from the intermediate tray 59) in the double side copy mode and in the deck paper feed (from the deck 54), the scan of the optical system is started after the record paper has reached a predetermined position. To this end, the "intermediate tray ready" signal (see bit $b_3$ of PMSTSO shown in FIG. 9(2)) used in the front side copy operation in the double side copy mode is used as a timing signal. A time required for the record paper to travel from a sensor 201 arranged in the record paper convey path 58 of the pedestal 200 to the registration roller 15 is pre-calculated and the pedestal 200 sends the "intermediate tray ready" signal, and the main unit 100 starts to scan the optical system in response to this signal.

The sensor arranged in the record paper convey path 58 detects the paper so long as the paper request is issued from the main unit 100. If the sensor does not detect the record paper within a predetermined time after the rotation of the paper feed roller of the intermediate tray 59 or the 2000-paper deck 54, it is determined that a jam has occurred in the paper feed unit. Taking into consideration of the possibility that the feed of the record paper may be delayed due to a slip, the predetermined time is set to be twice as long as a normal feed time. In this manner, the shift of the copied image is prevented and the occurrence of the jam is reduced even if the record paper feed is somewhat delayed.

If the record papers are double-fed in the front side copy operation so that a more than the preset number of record papers are stored in the intermediate tray 59, the back side copy operator is continued until the record papers in the intermediate tray 59 are exhausted, in response to the "papers present in the intermediate tray" signal (bit $b_4$ of PMSTSO shown in FIG. 9(2)). The count in the copy count display 87 is decremented starting from the initial preset count and stopped at zero.

If the record papers stored in the intermediate tray 59 are double-fed and the papers in the intermediate tray 59 are exhausted before the preset number of back side copies are made, the wasteful scan of the optical system is inhibited and the copy operation is terminated.

After the front side copy operation in the double side copy mode has been completed, the back side copy display LED 91 is lit. If it is desired to cancel the back side copy operation, the stop key 71 is depressed and the record papers having copies made on the front sides, stored in the intermediate tray 59 are ejected.

When the stop key 71 is depressed during the back side copy stand-by, the slave Q102 which controls the console panel (see FIG. 2) sends a "stop input" signal and a "double side mode back stand-by" signal to the master Q101 (see FIG. 8). As a result, the master Q101 energizes the main motor controller 820 to drive the registration roller 15. The slave Q102 further unconditionally sends a "double side back mode stand-by" signal (see bit $b_4$ in FIG. 9(1)), a "paper feed request" signal and an "image leading edge" signal (see bits $b_0$ and $b_4$ of MPSTSO in FIG. 9(1)) to the pedestal controller Q103 to render the record papers stored in the intermediate tray 59 to be sequentially fed to the main unit. The main unit stops the scan of the optical system, sets the development bias such that the toner is not deposited on the photoconductor drum and turns on only the blank exposure lamp. Thus, the papers are continuously ejected from the main unit.

If the sorter 400 is attached, the master Q101 instructs to the Q108 to unconditionally eject the papers to the non-sort bin 62 even if the sort mode has been selected in the sorter.

The interruption in the double side copy mode is now explained.

If the interruption key 72 is depressed in the double side copy mode, the operation mode currently executed is temporarily stopped. The data on preset copy count, the cassette selection, the magnification factor, the AE/MANUAL selection and the double side front-/back mode are buffered and the interruption display 88 is lit.

The double side copy mode can be designated only when the size of the selected cassette matches the size of the record papers in the intermediate tray.

Since the record papers before the interruption have been accommodated in the intermediate tray 59, the number of double side copies settable in the interruption mode is equal to the maximum capacity of the intermediate tray less the number of papers already accommodated in the intermediate tray 59.

For example, if the maximum capacity of the intermediate tray 59 is 99 and 30 record papers having copies made on the front sides have already been accommodated in the intermediate tray 59, 1 to 69 double side copies can be set in the interruption mode.

The record papers already stored in the intermediate tray 59 before the interruption are not affected by the interruption because the record papers having copies made on the front sides in the interruption mode are placed at the top of the intermediate tray 59.

When the double side copy mode is designated in the interruption mode, the previous copy mode is automatically recovered when the double side copy operation in the interruption mode is completed.

When the double side copy mode is designated in the interruption copy mode, the record papers after the copying operation are ejected to the non-sort bin 62 (see FIG. 1(1)). Even if the sort mode has been designated in the sorter, the papers are always ejected to the non-sort bin 62 because the main unit sends out the non-sort signal.

The temperature control of the fixer is explained. Referring to FIG. 3(1), the analog signal from the fixing thermister 850 is applied to the A/D converter Q104 which converts it to a digital signal. The digital temperature information is sent to the master Q101 by the serial communication so that the temperature of the fixer is read in.

Figures 4, 5, 6, 7, 8, 9, 10, 11, 12, 13:
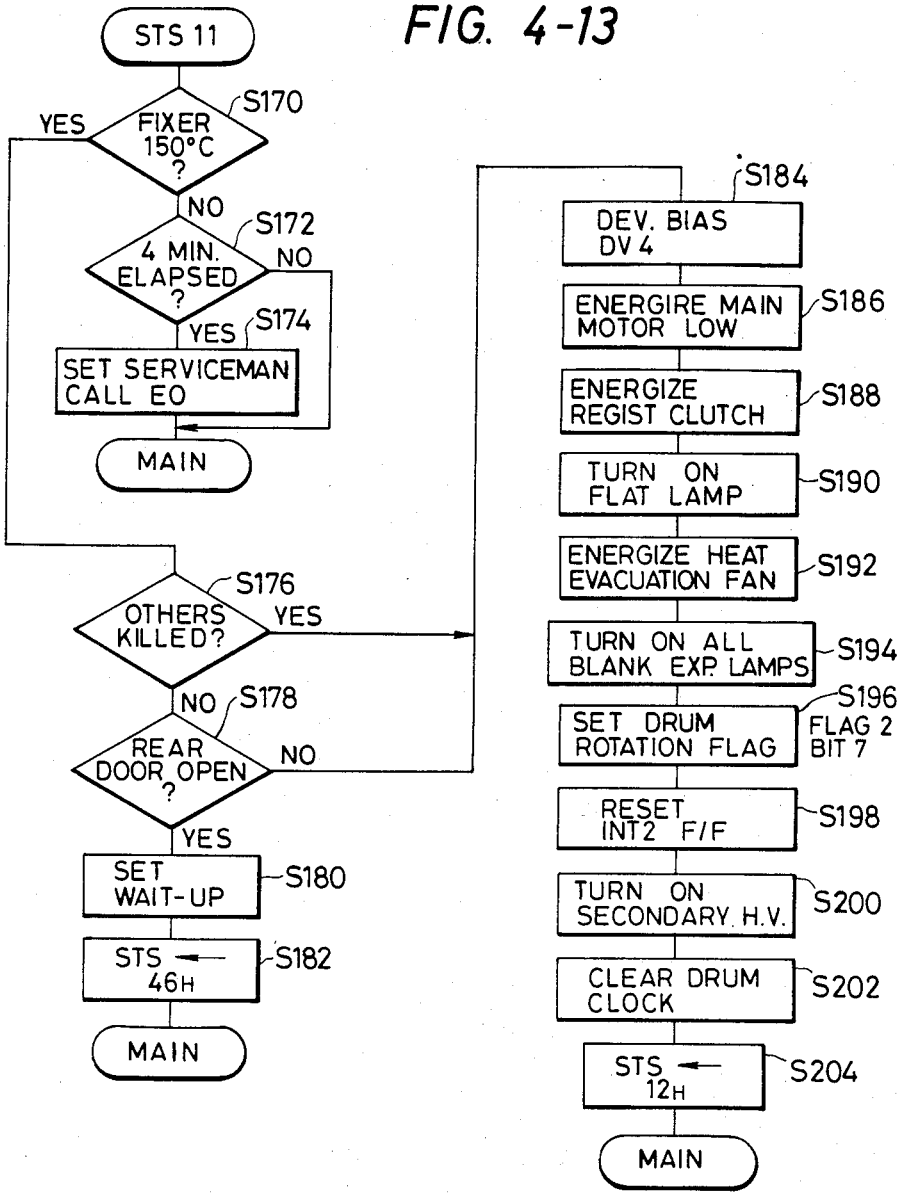
Figures 4, 5, 6, 7, 8, 9, 10, 11, 12, 13, 14:
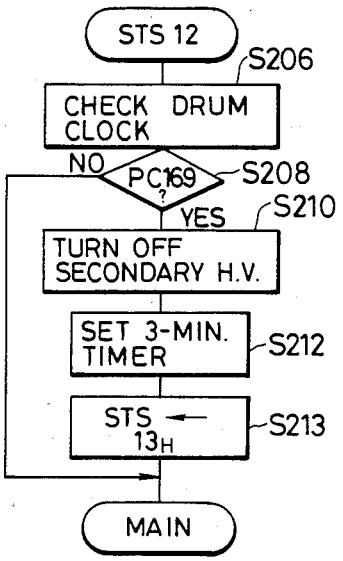
Figures 4, 5, 6, 7, 8, 9, 10, 11, 12, 13, 14, 15:
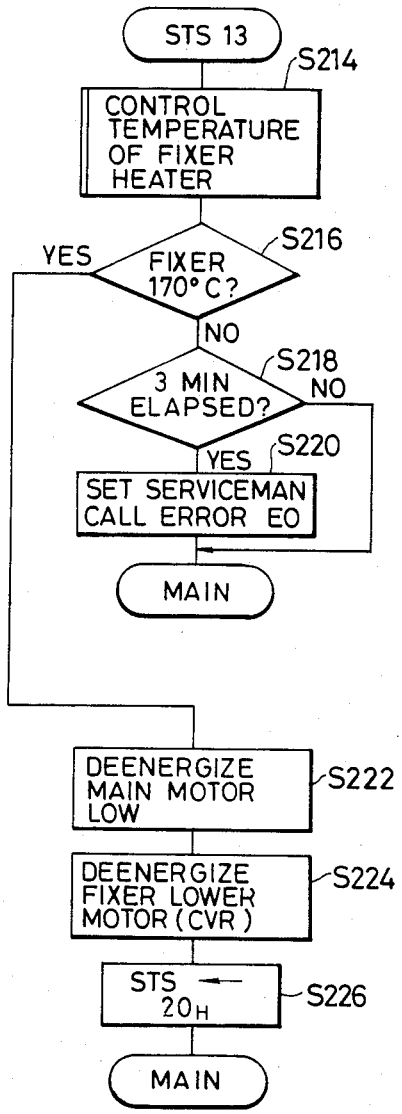
Figures 4, 5, 6, 7, 8, 9, 10, 11, 12, 13, 14, 15, 16:
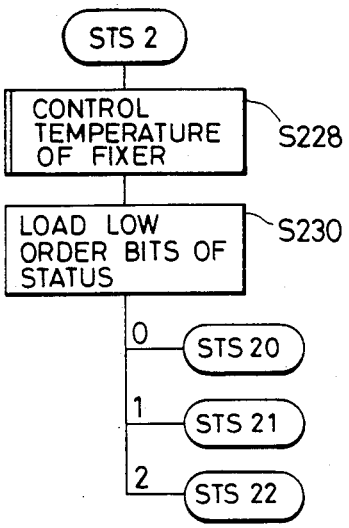
Figures 4, 5, 6, 7, 8, 9, 10, 11, 12, 13, 14, 15, 16, 17:
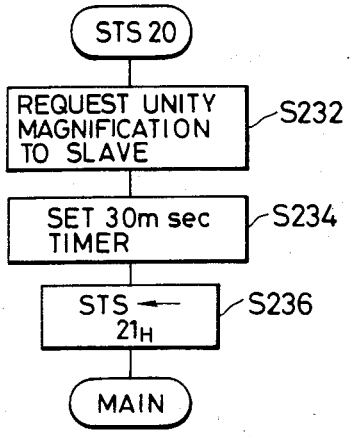
Figures 4, 5, 6, 7, 8, 9, 10, 11, 12, 13, 14, 15, 16, 17, 18, 19, 20:
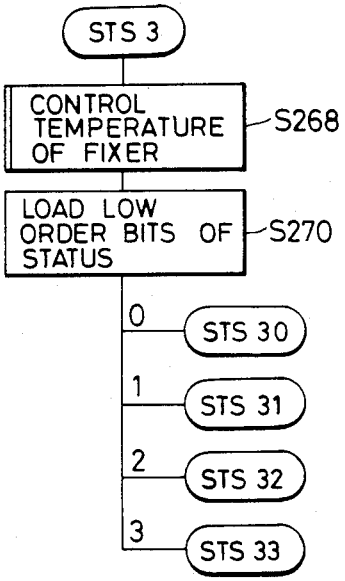
Figures 4, 5, 6, 7, 8, 9, 10, 11, 12, 13, 14, 15, 16, 17, 18, 19, 20, 21:
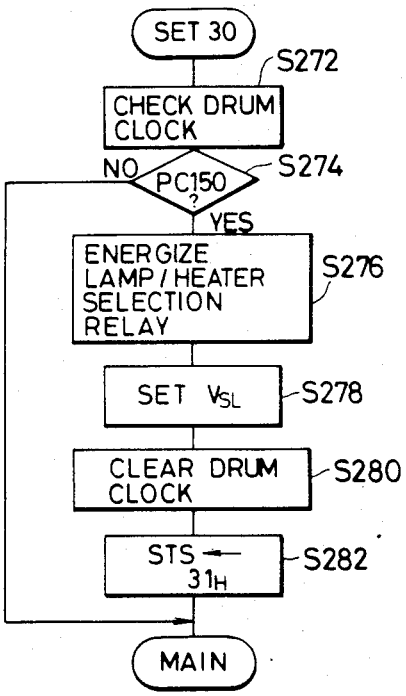
Figures 4, 5, 6, 7, 8, 9, 10, 11, 12, 13, 14, 15, 16, 17, 18:
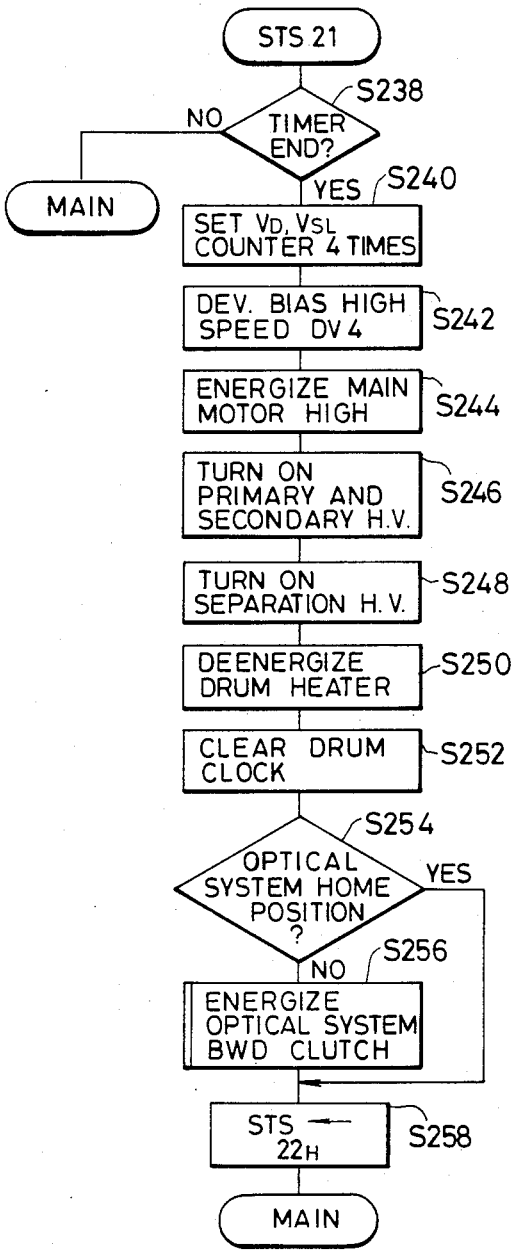
Figures 4, 5, 6, 7, 8, 9, 10, 11, 12, 13, 14, 15, 16, 17, 18, 19:
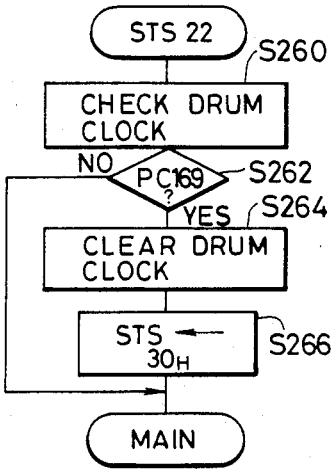
Figures 4, 5, 6, 7, 8, 9, 10, 11, 12, 13, 14, 15, 16, 17, 18, 19, 20, 21, 22, 23, 24:
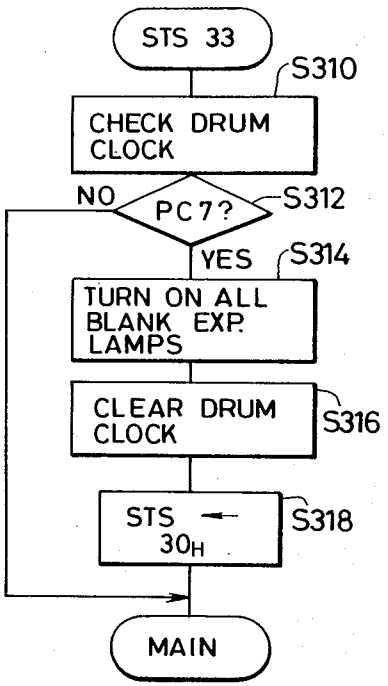
Figures 4, 5, 6, 7, 8, 9, 10, 11, 12, 13, 14, 15, 16, 17, 18, 19, 20, 21, 22, 23:
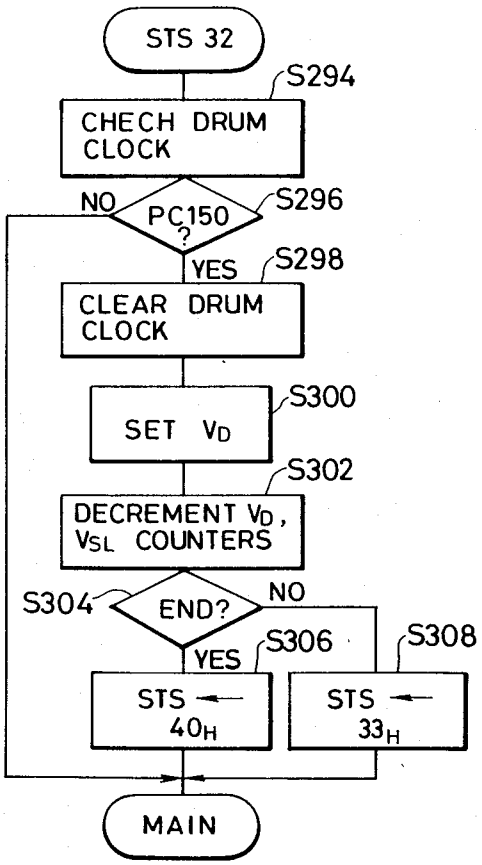
Figures 4, 5, 6, 7, 8, 9, 10, 11, 12, 13, 14, 15, 16, 17, 18, 19, 20, 21, 22:
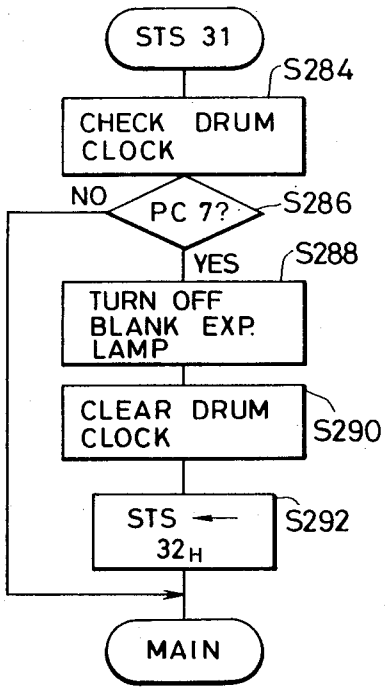
Figures 4, 5, 6, 7, 8, 9, 10, 11, 12, 13, 14, 15, 16, 17, 18, 19, 20, 21, 22, 23, 24, 25:
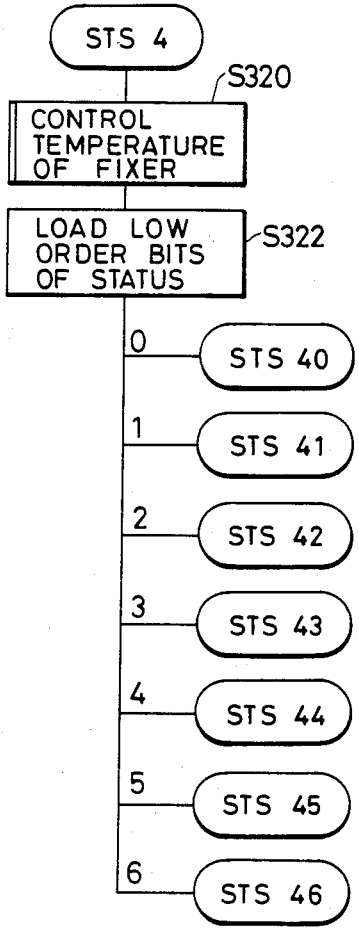
Figures 4, 5, 6, 7, 8, 9, 10, 11, 12, 13, 14, 15, 16, 17, 18, 19, 20, 21, 22, 23, 24, 25, 26:
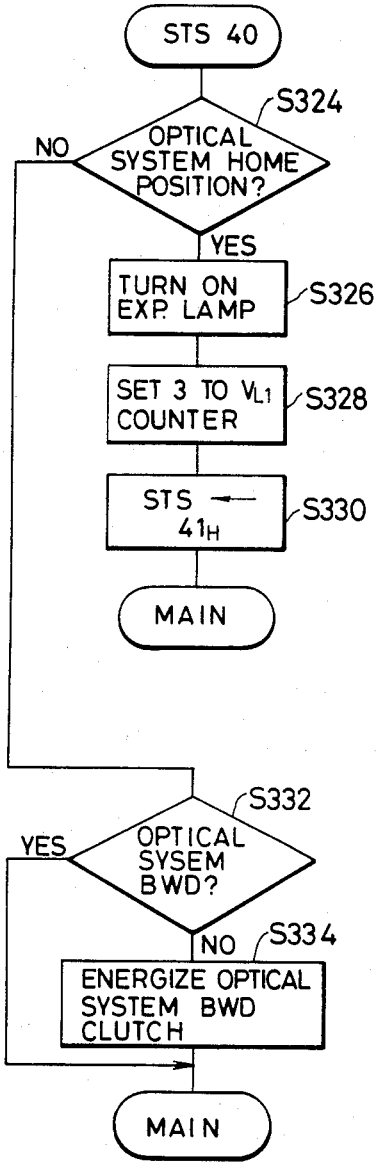
Figures 4, 5, 6, 7, 8, 9, 10, 11, 12, 13, 14, 15, 16, 17, 18, 19, 20, 21, 22, 23, 24, 25, 26, 27:
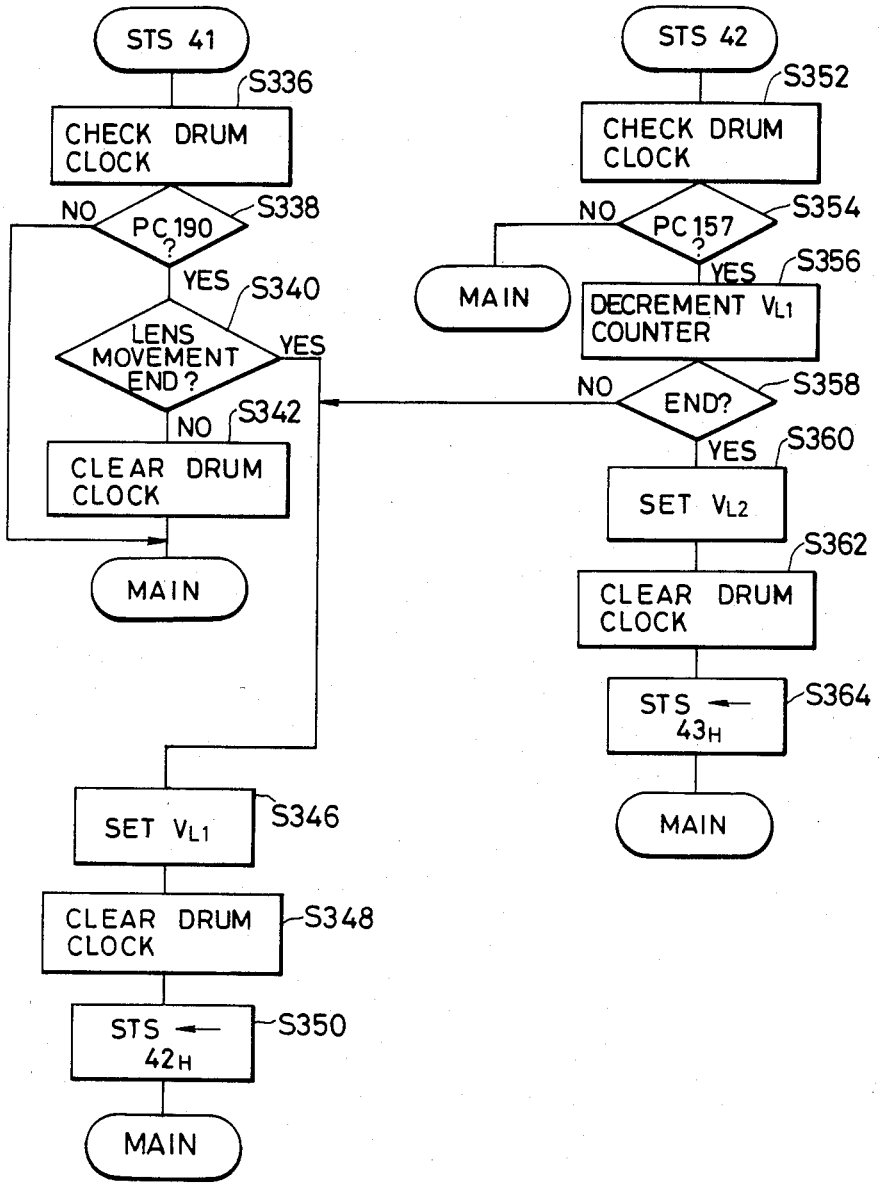
Figures 4, 5, 6, 7, 8, 9, 10, 11, 12, 13, 14, 15, 16, 17, 18, 19, 20, 21, 22, 23, 24, 25, 26, 27, 28:
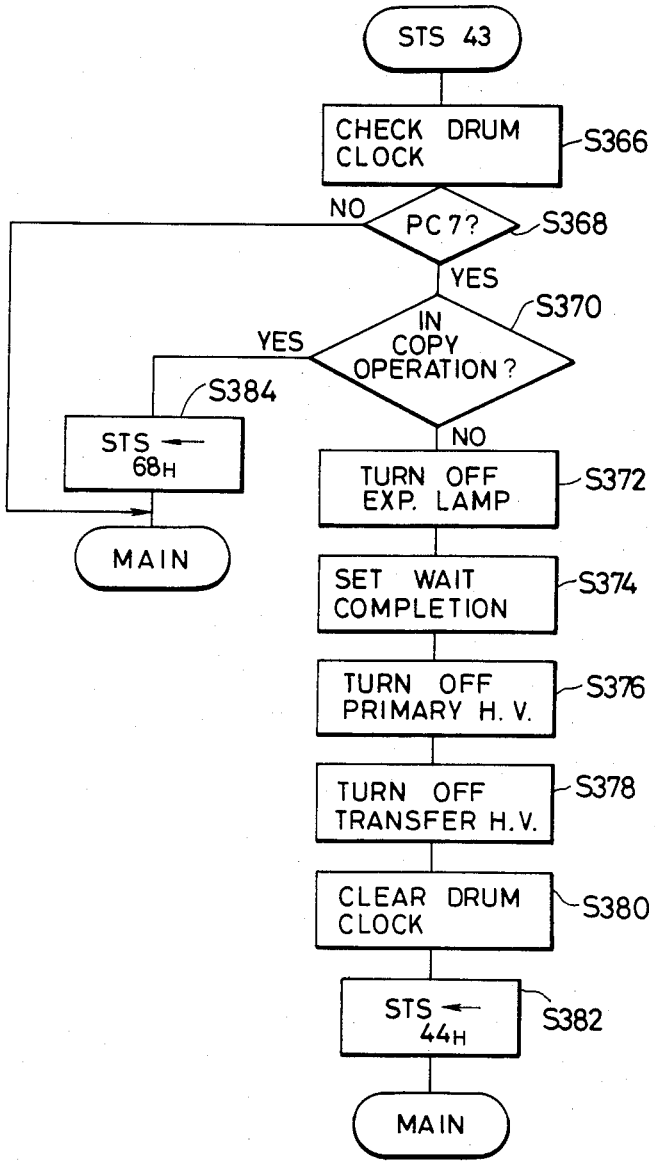
Figures 4, 5, 6, 7, 8, 9, 10, 11, 12, 13, 14, 15, 16, 17, 18, 19, 20, 21, 22, 23, 24, 25, 26, 27, 28, 29:
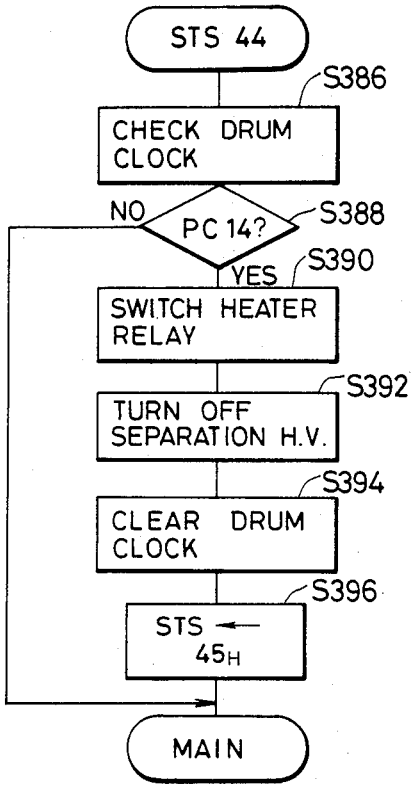
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34:
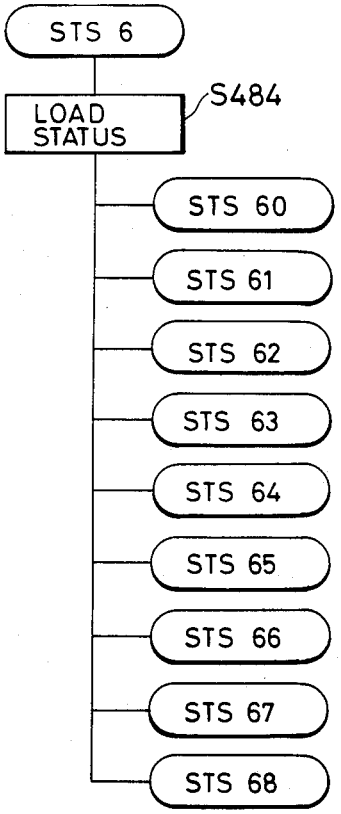
Figures 4, 5, 6, 7, 8, 9, 10, 11, 12, 13, 14, 15, 16, 17, 18, 19, 20, 21, 22, 23, 24, 25, 26, 27, 28, 29, 30:
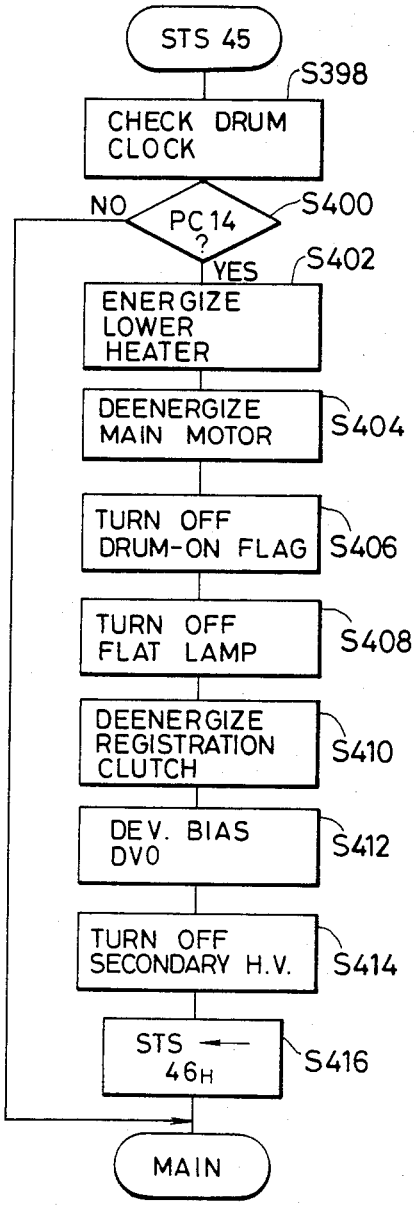
Figures 4, 5, 6, 7, 8, 9, 10, 11, 12, 13, 14, 15, 16, 17, 18, 19, 20, 21, 22, 23, 24, 25, 26, 27, 28, 29, 30, 31:
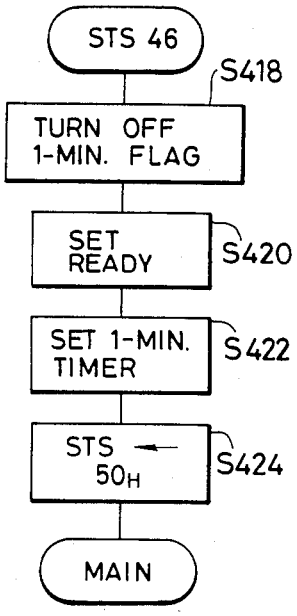
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32:
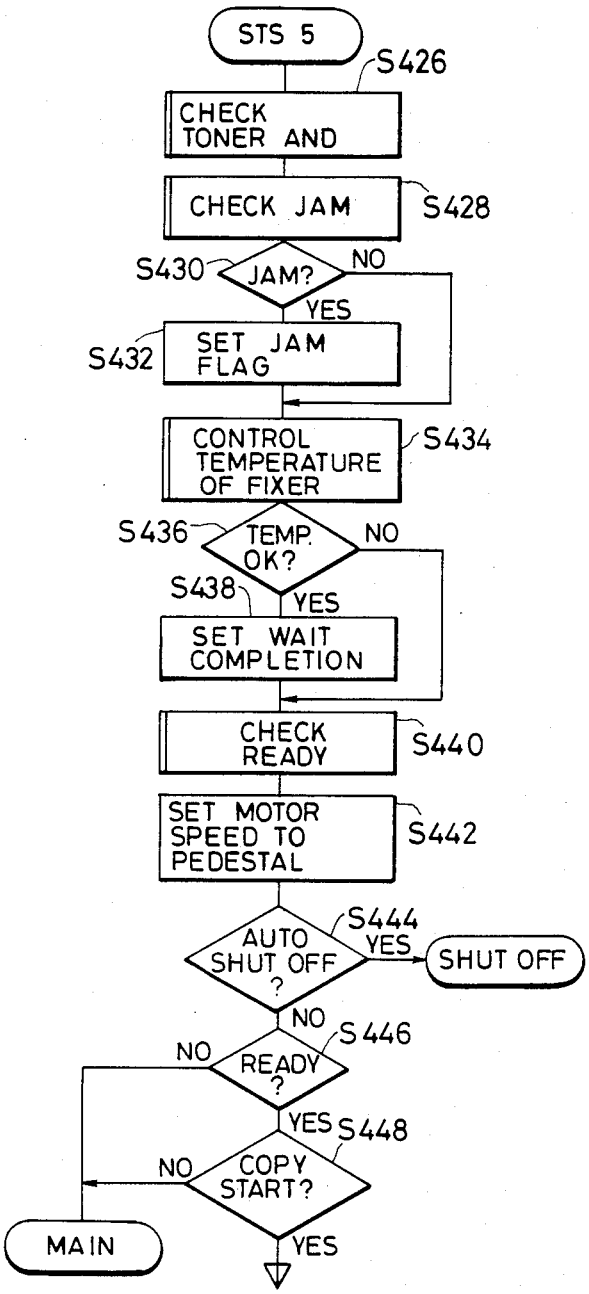
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36:
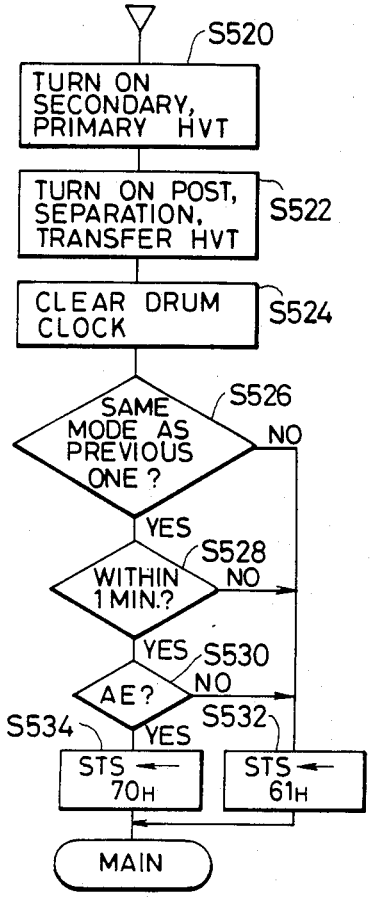
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33:
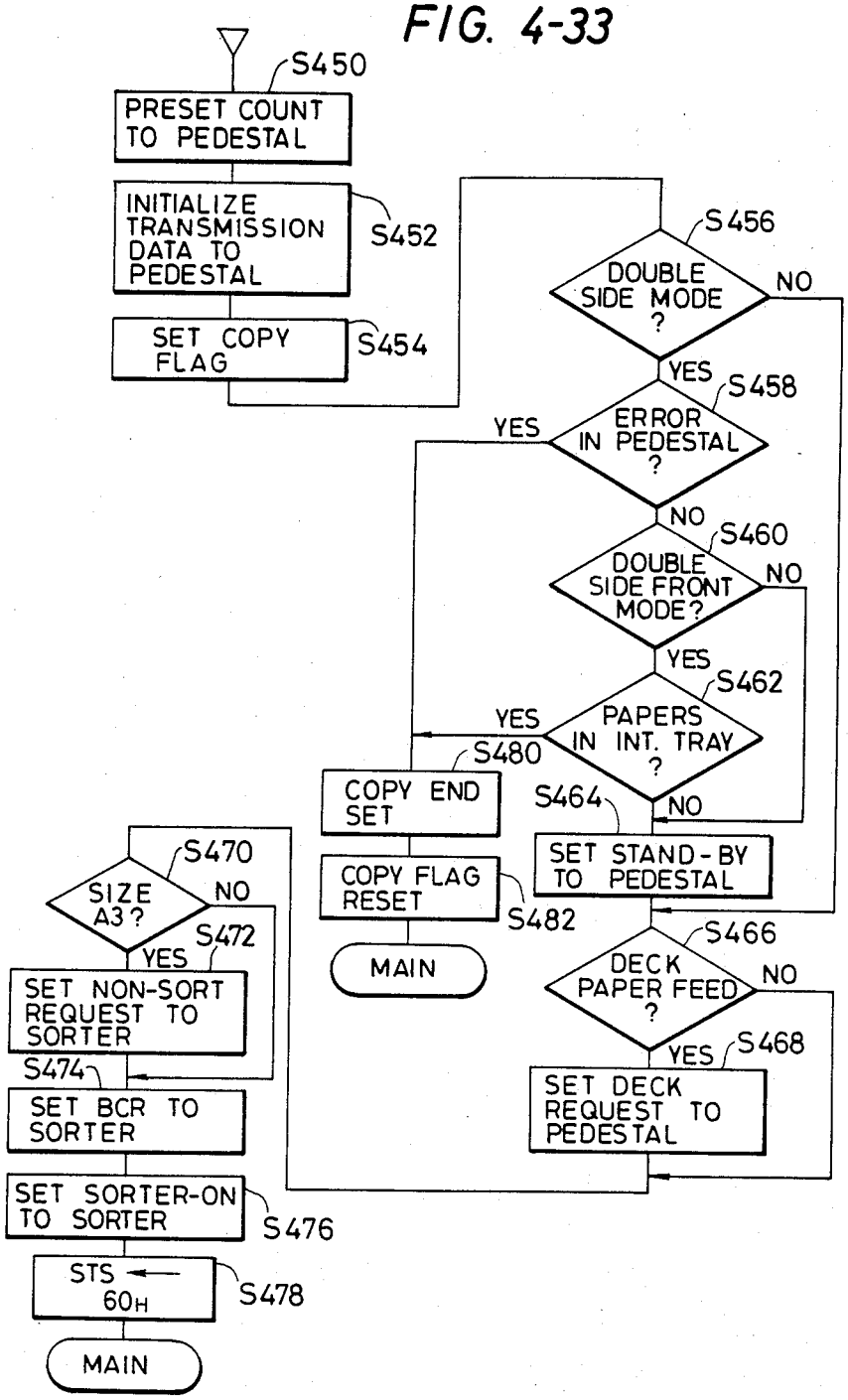
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35:
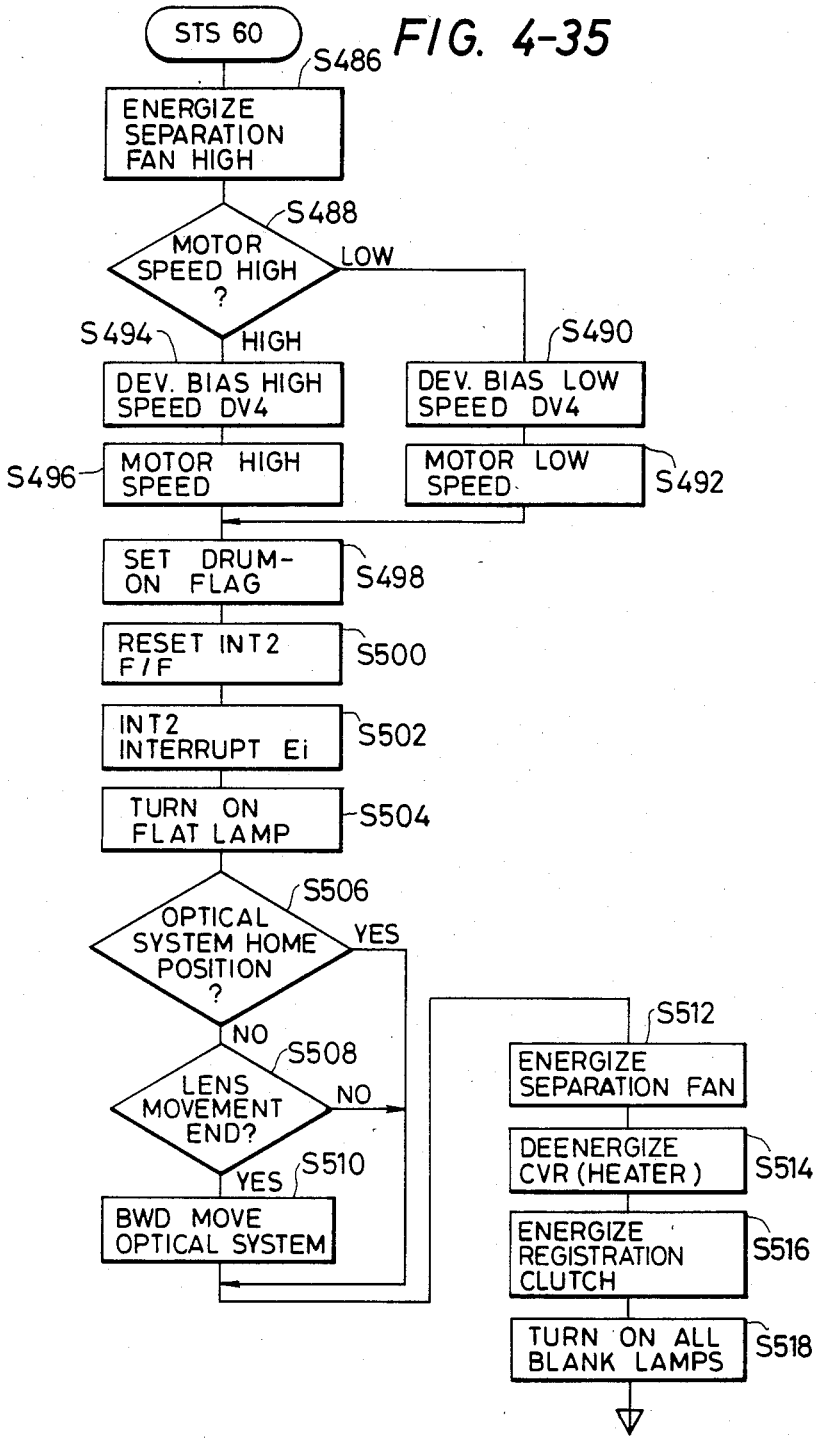
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37:
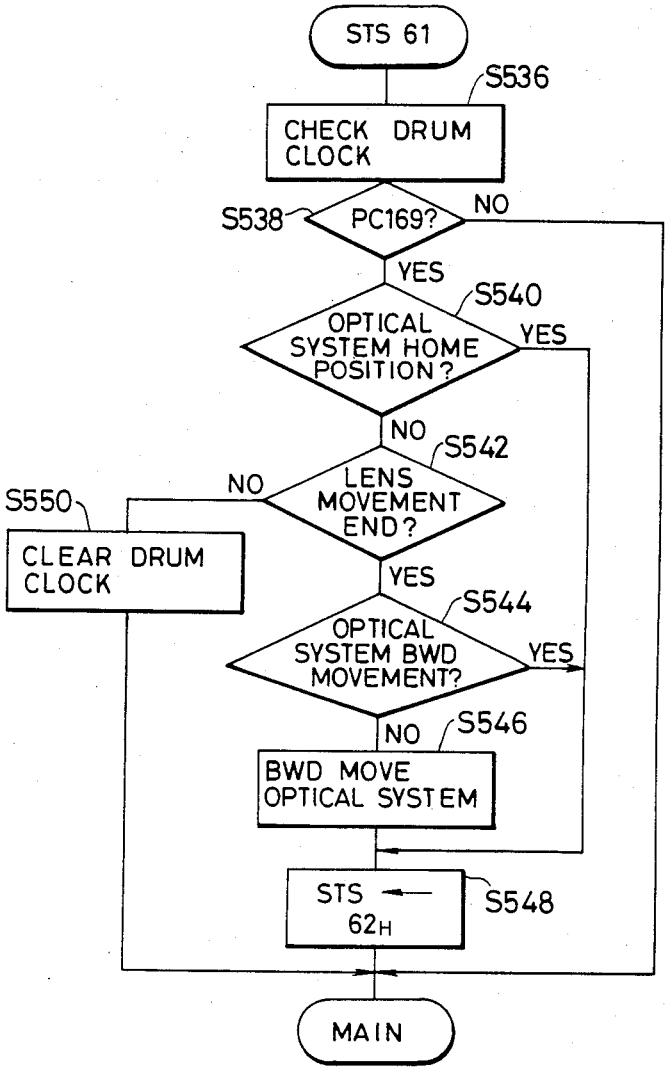
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38:
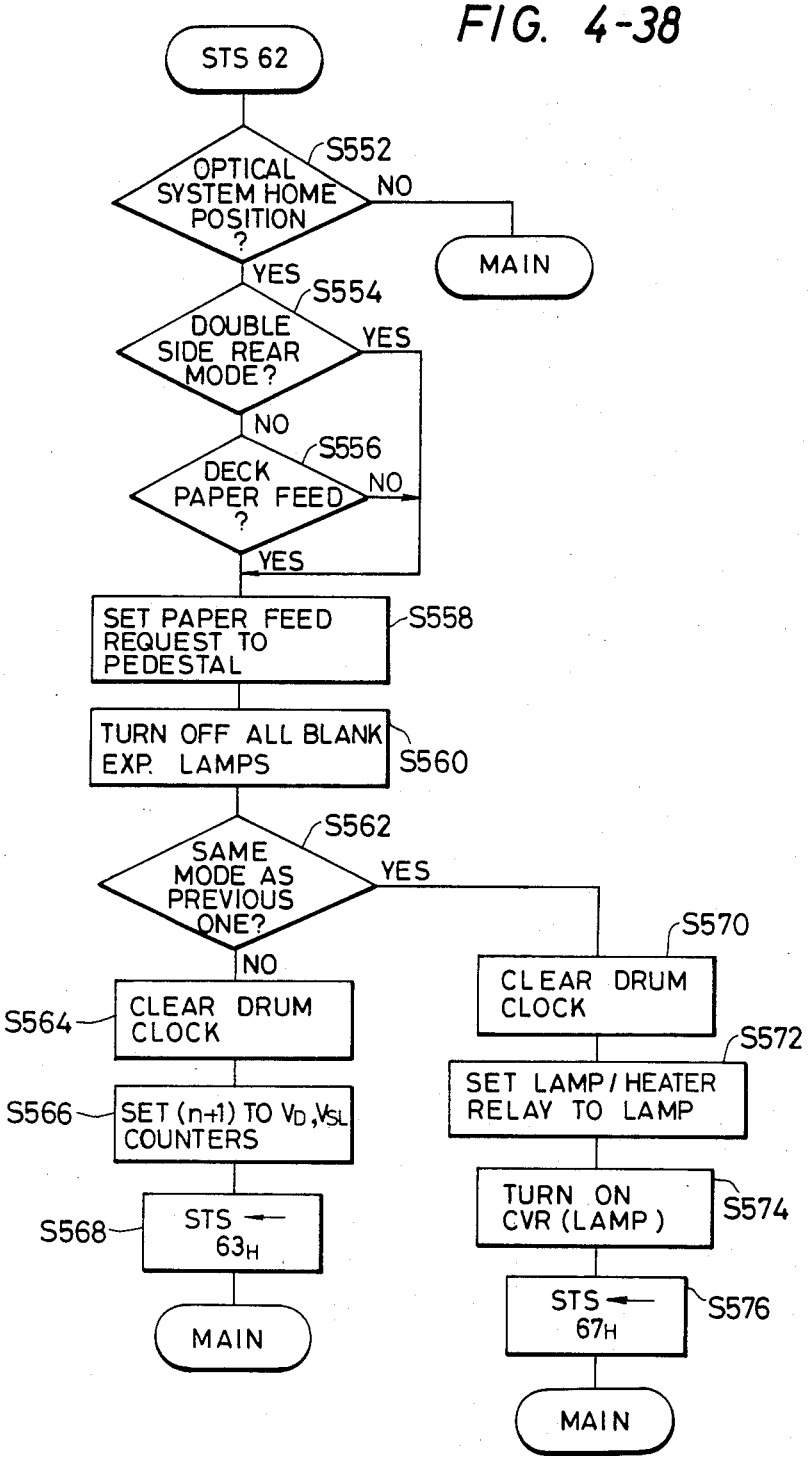
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39:
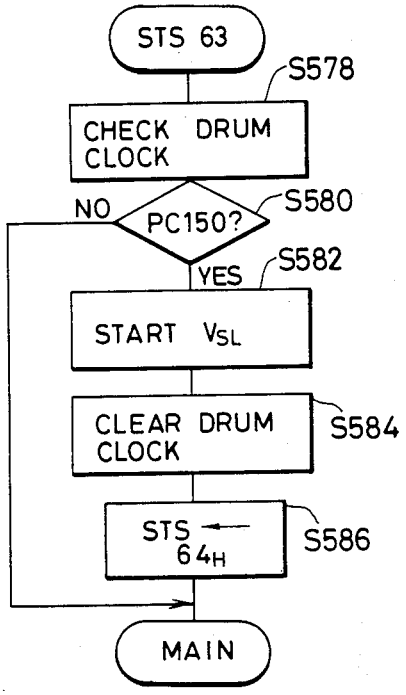
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40:
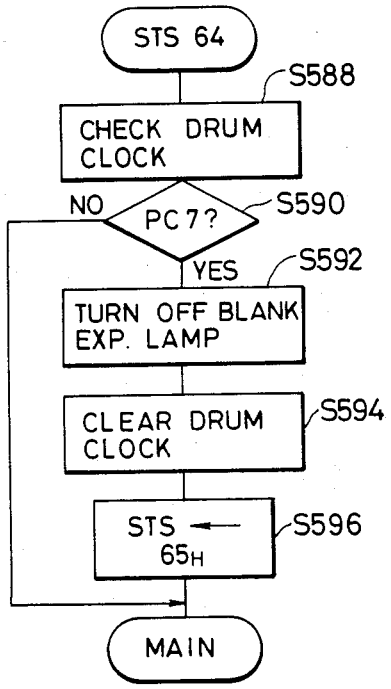
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41:
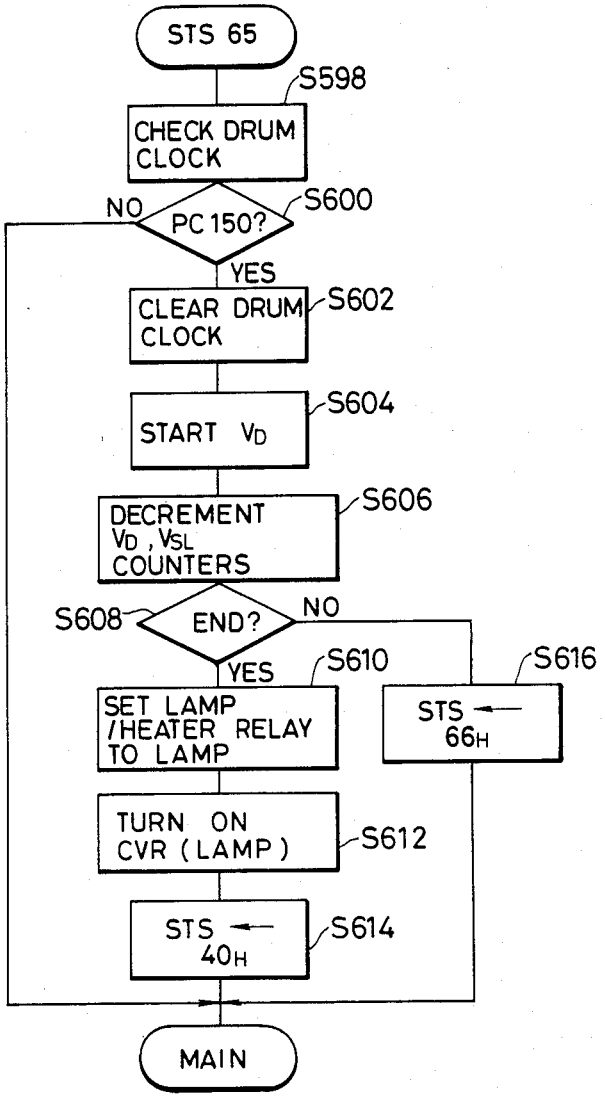
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42:
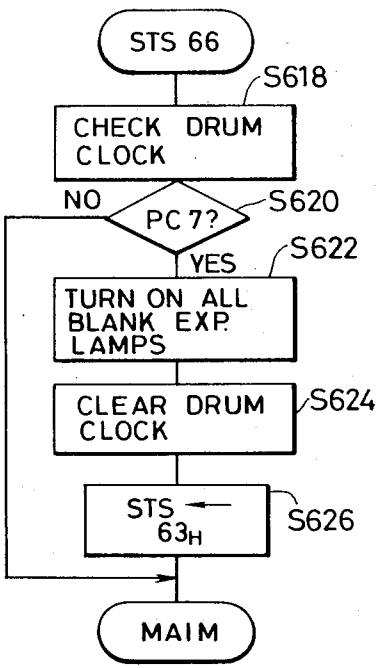
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43:
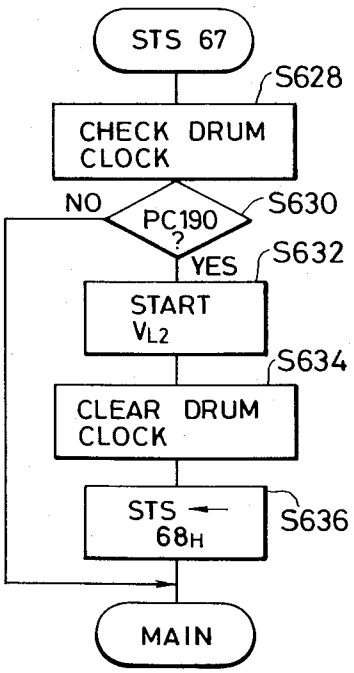
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44:
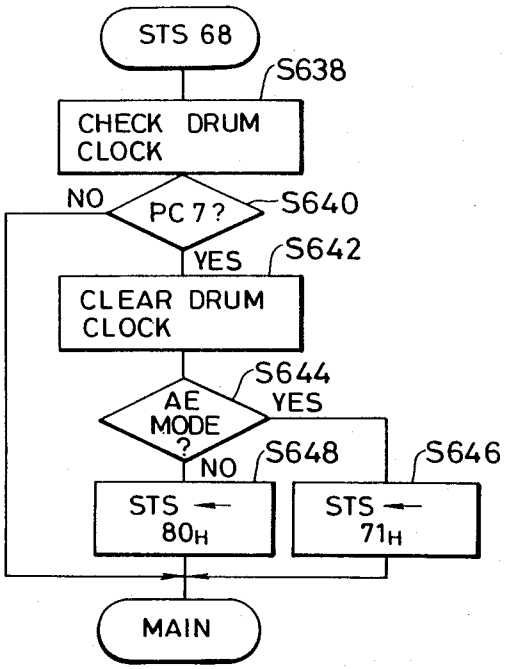
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45:
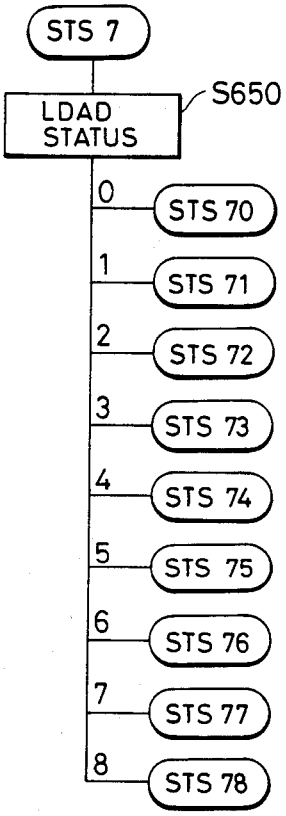
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50:
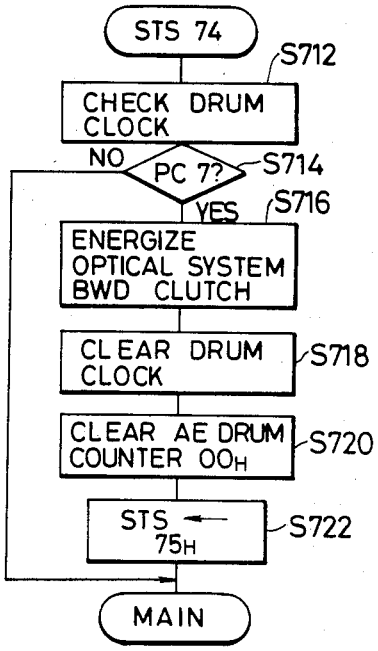
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49:
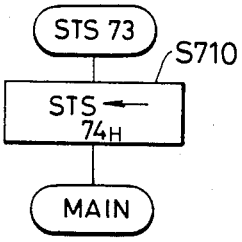
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46:
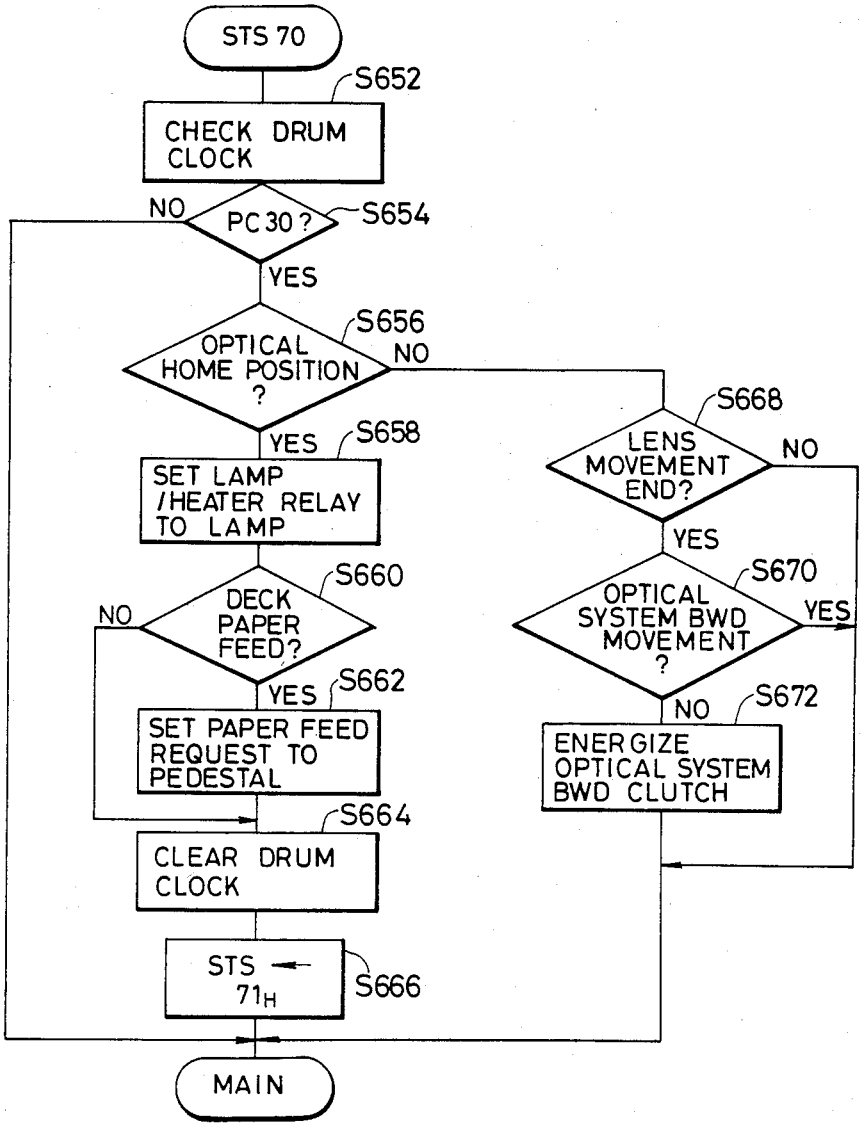
Figure 4:
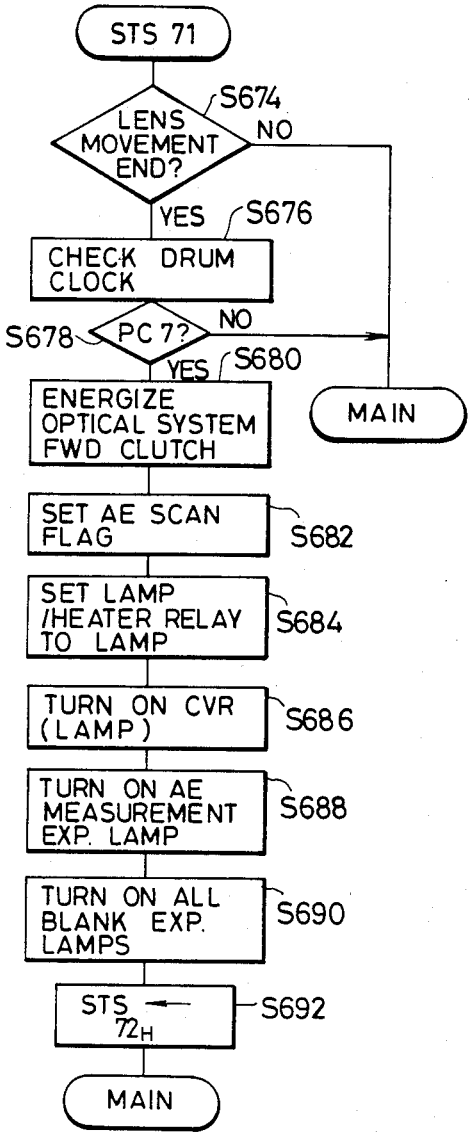
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48:
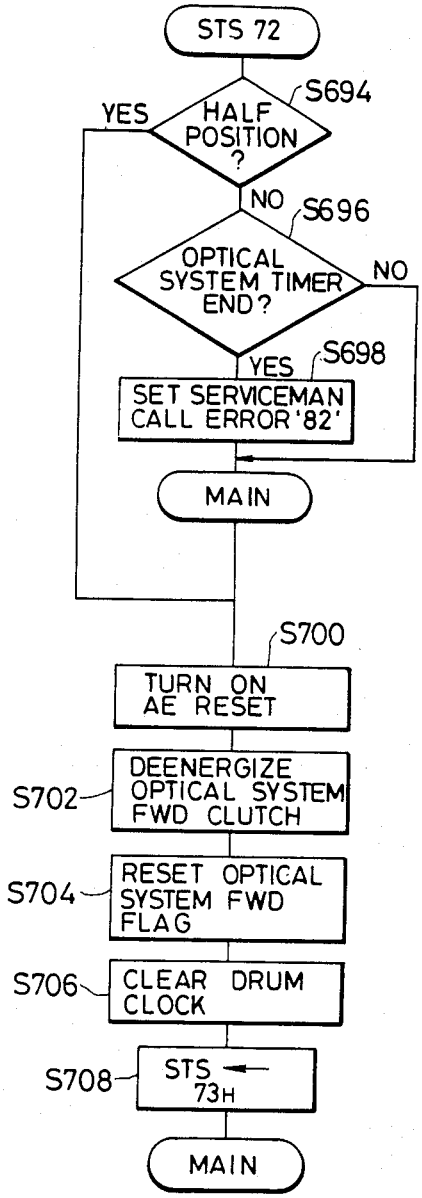
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51:
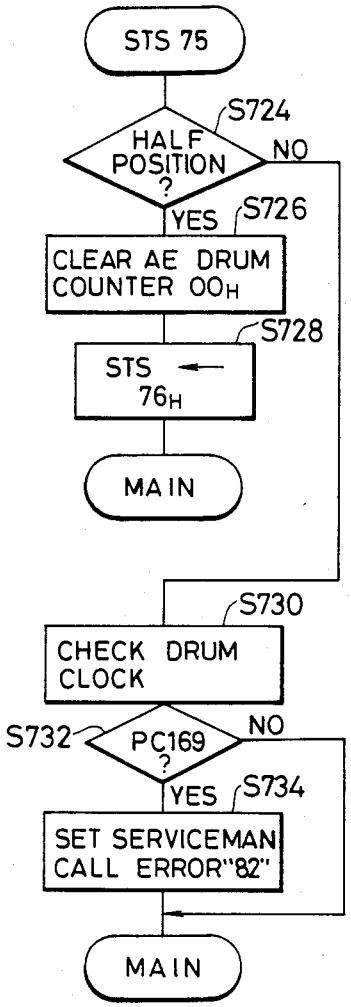
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52:
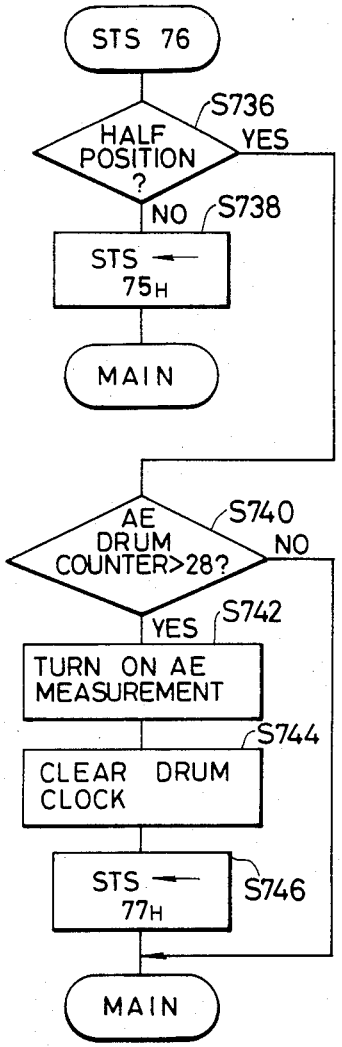
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53:
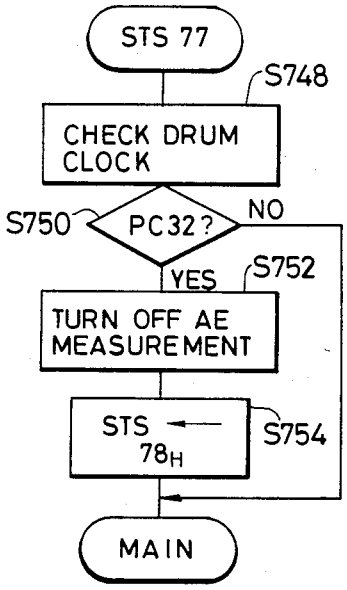
Figures 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54:
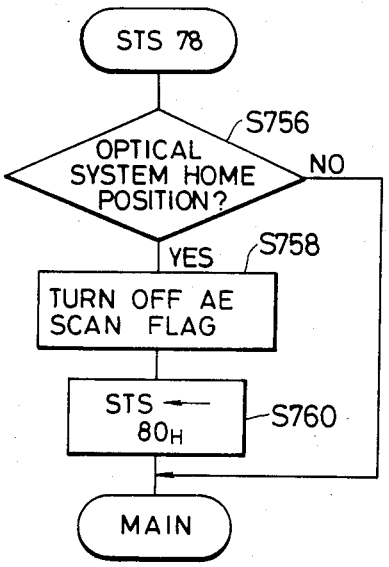
Figures 4, 55:
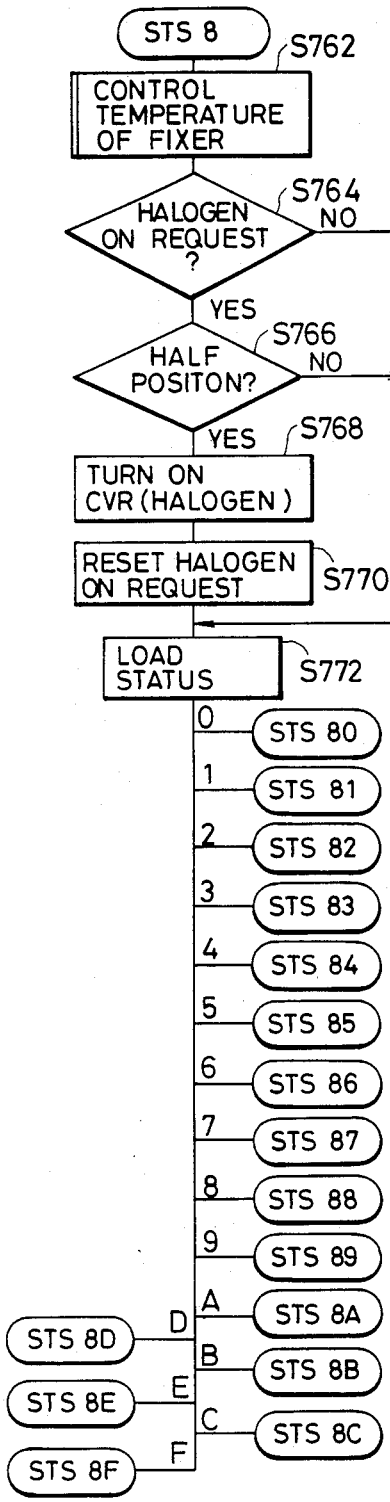
Figures 4, 56:
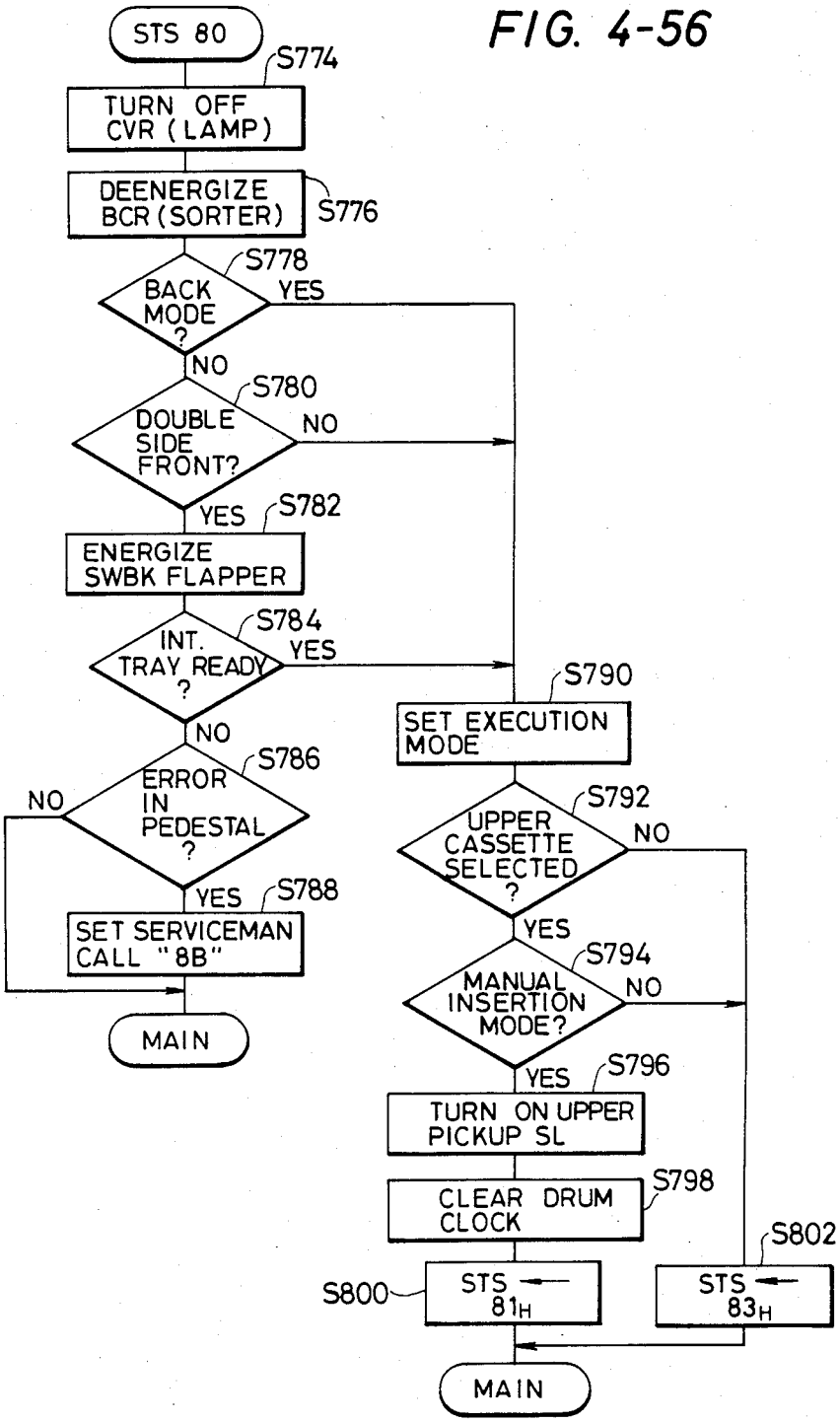
Figures 4, 57:
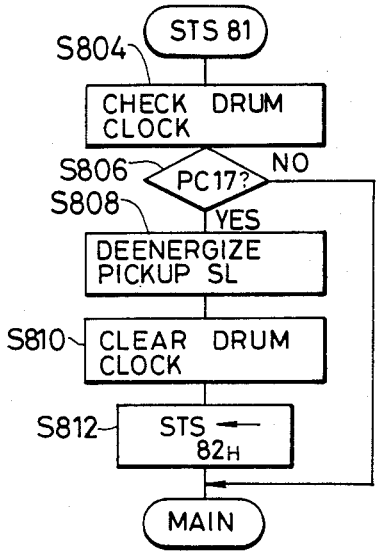
Figures 4, 58:
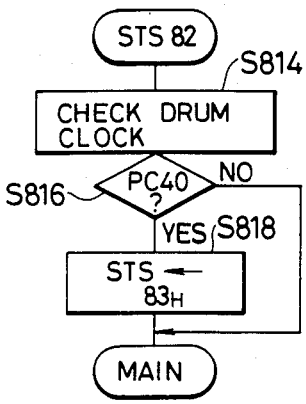

When the temperature of the fixer reaches 150° C. after the power-on, the low speed rotation of the fixing rollers 31-1 and 31-2 is started, and when the temperature reaches 170° C., the rollers are rotated at a high speed and the stand-by mode is started. The sequence is shown in FIG. 13(1).

During the stand-by mode, the fixer is temperature-controlled so that it is maintained at 180° C. If the temperature of the fixer falls below 150° C., the copying operation is disabled.

When a large number of copies are continuously made, the heat of the fixer is absorbed by the record papers and the temperature of the fixer gradually drops. Accordingly, when the temperature of the fixer drops below 160° C., the copy interval is expanded. In other words, an interval to drive the optical system is expanded to reduce the number of record papers fed into the fixer, a timer used to set the interval is selected to have an optimum time to allow the rise of the temperature of the fixer. When the temperature rises to 170° C., the normal sequence is recovered.

The operation sequence for the paper feed from the deck 54 (see FIG. 1(1)) is explained.

The lift up/down of the deck and the on/off of the paper feed roller are controlled by the pedestal controller Q103. In the embodiment shown in FIG. 1(1), the record paper mounted on the lifter 54L always contacts to the paper feed roller 50 at a constant pressure.

When it is desired to lift up the lifter 54L during the copy operation, the pedestal controller Q103 serially transfers a "deck lift-up request" signal (see bit $b_5$ of PMSTSO shown in FIG. 9) to the master Q101. Thus, the master Q101 deenergize the fixer heater and renders a "deck lift-up inhibit" signal (see bit $b_5$ of MPSTSO shown in FIG. 9(1)) to assume a low level to permit the lift-up of the deck 54 to the pedestal.

When the deck lift-up is completed, the pedestal 200 turns off the "deck lift-up request" signal. The master Q101 responds thereto to start the temperature control of the heater.

For the deck paper feed, the lift-up is required one for every 30 copies. A time required for the deck lift-up is approximately 0.8 second. Accordingly, even if the fixer heater is deenergized for approximately 0.8 second during the continuous copy operation, it does not significantly affect to the temperature control.

In the above embodiment, the serial communication is effected among the plurality of microcomputers to effect the temperature control. Alternatively, a control by one microcomputer or a control by a hardwired logic shown in FIG. 3(2) may be used.

FIG. 3(2) shows the hardwired logic for deenergizing the fixer heater when the deck 54 (see FIG. 1(1)) is lifted up. A deck lift signal 140-1 is sent from a deck lift up/down control circuit 861 connected to the pedestal controller Q103. The deck lift signal 140-1 is applied to an AND gate 140-4 through an inverter 140-2, together with a fixer heater turn-on signal 140-3.

When the deck lift signal 140-1 is high, the deck lift motor is energized and the fixer heater is deenergized. Accordingly, the increase of the total consumed power of the copying machine is suppressed. Alternatively, the fixer heater may not be deenergized but a power supplied to the fixer heater may be suppressed.

In this manner, the energization and the deenergization of the fixer heater can be controlled by the hardwired logic without using other processor.

FIG. 3(3) shows a circuit configuration of the AC controller. The AC drive control of the copying machine is now explained with reference to FIG. 3(3).

A plug P1 is connected to a main switch SW1 through a line filter LF1. Microswitches MS1 and MS2 are arranged in a front door and a rear door. When the front door is opened, the AC input is cut off.

H1 denotes a drum heater which controls the temperature of the drum. H2 and H3 denote upper and lower heaters of the fixer. FM1, FM2 and FM3 denote a conveyor fan, an optical system fan and a heat evacuation fan, respectively.

M1 denotes a main motor for rotating the convey drum, and LA1 denotes a halogen lamp.

An output terminal of a transformer T1 is connected to a DC power supply.

The main motor M1 of the copying machine rotates at a high speed in a unity magnification copy mode and rotates at a low speed in a reduction copy mode. A drive unit which receives control signals DRMD.H and DRMD.L from the master Q101 (see FIG. 3(1)) to supply a power to the main motor M1 is provided.

FIGS. 4(1)–4(78) are flow charts showing control sequences of the master Q101.

FIG. 4(1) is explained first.

In a step S4, the RAM and the ports are initialized. The data RAM at the power-on and the I/O ports are initialized.

A step S6 is a processing program for inputting to the input prots, and a step S8 is a supervision program executed when the optical system is returned to a home position.

A step S10 and the subsequent steps are called a status program in which a sequence control is managed by a status number. In the step S10, a status is loaded, that is, a corresponding status number is called. Then, the processing is divided as shown by steps S12–S30.

A step S12 is a processing program for determining whether the power supply of the main unit has been turned on, a step S14 is a waiting program before a predetermined temperature is reached after the energization of the heater, and steps S16–S20 are a processing program for the potential controlled rotation.

A step S22 is a stand-by loop. After the predetermined temperature has been reached and the potential controlled rotation has been terminated, the process stands by until the copy start button is depressed.

A step S24 shows a processing program executed when the copy button is depressed, and the potential control processing. A step S26 is an AE control processing program to be subsequently executed.

A step S28 is a processing program for actually executing the copy operation, and a step S30 is a processing program for a post-rotation.

A time interval (TINT) shown in FIG. 4(2) is explained.

The master Q101 is interrupted by the internal timer at every 1.248 msec. A step S38 is an output processing for the serial communication of 1.248 msec. interval.

In a step S40, a sub-routine of the constant time interval is executed. When a processing is desired a predetermined time after another processing, the timer is set in the main routine so that the predetermined time is counted and the processing is executed.

SINT shown in FIG. 4(3) shows a serial reception interruption.

Steps S36–S40 determine whether the serial communication is from the slave Q102, the pedestal controller Q103 or the A/D converter Q104, respectively.

The storage address is determined in accordance with the received content (steps S42, S44 and S46). The received data is stored in the corresponding area in accordance with the status or the address.

In FIG. 4(4), an optical system registration interruption (INT1) is executed.

Pulses emitted from an encoder (not shown) attached to the drive motor for the movable optical system are received to determine the forward or backward movement of the movable optical system (steps S52 and S54). If the movable optical system is moving forward, the content of the counter is incremented by one in a step S68. By monitoring the content of the counter, a reversal point of the movable optical system can be detected.

In a step S70, a registration timing is determined. A timing to actually feed the paper is determined in this step. The registration clutch is energized when the leading edge of the original sheet reaches a reference position so that the leading edges of the record paper and the original sheet are registered (step S72).

If the movable optical system is moving backward (step S54), whether the AE scan is to be carried out or not is determined in a step S56. If the decision is NO, the AE measurement is stopped (step S58) and if YES the counter is incremented by one (step S60).

When the count of the counter reaches 6, the optical system stop request is set in a step S64 and the process is terminated.

In INT2 shown in FIG. 4(5), the drum clock is interrupted. The drum clocks generated by the rotation of the main motor are detected and counted up.

In a step S78, a drum counter area is incremented by one for each interruption. In a step S80, a clock timer processing is carried out.

FIG. 4(6) and the following drawings show further detailed sequences.

In a step S86, the data to be sent to the slave Q102 is set (presence/absence of the intermediate tray).

In a step S88, the on/off status of the 24V power supply (on/off status of the main switch) is checked. When the main switch of the main unit is turned off, the microcomputer is kept in operation but the 24V power supply is cut off.

In a step S90, the jam is checked. If the record paper is still left at the sensor when the power is turned on, it turns out that the jam has not been perfectly removed.

In such a case, a serviceman call error is set and the control is shifted to SVERR (SV error) and the operation of the main unit is stopped. The serviceman call is displayed on a display.

For example, if a thermister for detecting the temperature of the fixer is broken, the fixer will burn. Accordingly, when such a break is detected, all outputs are blocked and an error display "EOO" is displayed.

In a step S96 (control counter check), the insertion of a key counter (also called a control counter) provided in the copying machine main unit is checked. Accordingly, if the key counter is removed during the copy operation, the copy operation is stopped.

A step S98 is a transmission program to the pedestal controller Q103.

In a step S100, inputting to the data bus DB (i.e. inputting to the port) is carried out.

In a step S102, the transmission to the pedestal controller is carried out. It is same as the steps S98 and S102. This step is needed because a certain period of time is required in the step S100 (DB inputting).

In a step S104, inputting to the I/0 expanders (i.e. extended I/O's Q105, Q106) is carried out. Since a certain period of time is again required in this step, the transmission to the pedestal controller Q103 is carried out in a step S106.

In steps S108 and S110, similar inputting to the extended I/0 to the step S104 is carried out. In a step S112, the transmission to the pedestal controller Q103 is again carried out.

In a step S114, the home position of the optical system is checked. Whether the optical system has been retarded to the home position during the copy sequence or not is checked.

In a step S116, the size of the paper cassette is checked.

In a step S118, the switch-back (see FIG. 1(3)) is carried out. By the switch-back, the record paper is reversed when it is ejected to the sorter after the back side copy.

Thereafter, the status is processed in a step S120 shown in FIG. 4(7).

The status (STS) include ten status STS0–STS9. "Load high order 4 bits of status" in the step S120 means to load high order 4 bits of the area STS (8 bits). The high order 4 bits are loaded before jumping. In accordance with the content of the high order 4 bits, the program is jumped to one of the STS0–STS9.

In a step S122 (see FIG. 4(8)), low order 4 bits of the status STS are loaded. Depending on the content of the low order 4 bits, the program is jumped. When the power is turned on, the area STS is cleared and the status starts from the status 00.

In a step S124 (see FIG. 4(9)), the ON/OFF state of the 24V power supply is checked. The microcomputer does not stop to operate even if the main switch is turned off. It is operated by simply plugging the power plug of the copying machine to the power plug socket.

If the 24V power supply is on, a step S126 (jam killing) is carried out. Whether the dip switch for detecting the jam is in the jam non-detecting position or not. If the decision is YES, the operation of the jam sensor is inhibited. On the other hand, if the decision is NO (that is, when the sensor is to be operated), whether the record paper is jammed by the sensor or not is checked. If the record paper is jammed, the jam position is set and displayed.

In a step S144 of the status STS01 (see FIG. 4(10)), the ON/OFF state of the power supply is checked.

If the power supply is on, "power-on status transmission request" (step S146) is sent to the microcomputers. "1" is imparted to the lowermost order bit $b_0$ of the status 0 (see FIG. 7(1)) sent from the master Q101 to the slave Q102 (step S146).

In a step S148, "00" is loaded to the area STS.

The STS01 is a processing program which is executed when the jam has occurred once.

The status STS10 (see FIG. 4(12)) is next explained.

In a step S152, the jam position data is cleared, and in a step S154, the jam flag is reset.

In a step S156, the transmission data (bit $b_0$ of the status 0 in FIG. 7(1)) is set.

In a step S158, the occurrence/non-occurrence of the jam is informed to the pedestal controller Q103.

A step S160 is a processing program for controlling the potential (that is, for measuring the surface potential of the drum to obtain an optimum image and controlling the charger, the exposure lamp and the developer). The DV bias means the developing bias.

In a step S162, the lower heater of the fixer is energized. In a step S164, the upper heater of the fixer is energized.

Thereafter, in a step S166, the 4-minutes timer is set to check whether the thermister for sensing the temperature is abnormal or not.

Thereafter, the control is shifted to the status STS11 (step S168).

In the status STS11 shown in FIG. 4(13), whether the temperature of the fixer has reached 150° C. or not is checked (step S170).

If the temperature does not reach 150° C. after the elapse of 4 minutes (step S172), it is assumed that the thermister has been broken and the serviceman call error (EO) is displayed (step S174). The functions at the respective ports are stopped.

If the temperature of the fixer reaches 150° C., the others are killed in a step S176. It is similar to the jam killing and the other killing setting switches are controlled. The other killing include the paper exhausted killing and the developer exhausted killing. They inhibit the detection of the paper exhausted state and the developer exhausted state by the dip switch in a similar manner as that of the jam killing. Since the decision is NO in normal case, the open/close state of the rear door is checked in a step S178. The rear door is not opened by the user but may be opened by a serviceman. Since the main motor automatically starts to rotate as the temperature of the fixer reaches a predetermined temperature, it is necessary to terminate the process without rotating the main motor if the rear door is open in order to prevent danger.

Thus, in a step S180, the flag indicating the end of waiting is set and the control is shifted to the status STS46 (step S182).

If the rear door is closed, the potential controlled rotation is carried out in a step S184.

After the developing bias has been set to a predetermined potential, the main motor is rotated at a low speed (step S186) and the registration clutch is energized (step S188).

The flat lamp is turned on (step S190), the heat evacuation fan is energized (step S192) and all blank exposure lamps are turned on (step S194).

In a step S196, the flag indicating that the drum is rotating is set, and in a step S198, the flip-flop is reset to interrupt by the drum clock.

In a step S200, the secondary high voltage is turned on, in a step S202, the count of the drum clock is cleared, and in a step S204, the next status code is set (STS←12).

A status STS12 shown in FIG. 4(14) is next explained.

In steps S206 and S208, the drum clock is checked and the control is shifted to a step S210 after the clock count 169. The drum clock generated by the rotation of the main motor is counted (see INT2 shown in FIG. 4(5)).

In the step S210, the secondary high voltage is turned off, and the three-minutes timer is set in a step S212. Whether the temperature of the fixer heater reaches 170° C. or not is checked by using the three-minutes timer (see a status STS13).

In the status STS13 shown in FIG. 4(15), the temperature of the fixer heater is controlled in a step S214.

In a step S216, whether the temperature of the fixer has reached 170° C. or not.

If the temperature does not reach 170° C. after the elapse of three minutes (step S218), the serviceman call error is displayed.

If the temperature of the fixer heater reaches 170° C., the low speed rotation of the main motor is terminated in a step S222.

In a step S224, the fixer lower heater is deenergized. Then, the control is shifted to a status STS20 (step S226).

In the STS2 shown in FIG. 4(16), the temperature of the fixer is controlled (step S228) and the program branches to the status STS20, STS21 or STS22 depending on the low order bit of the status.

In the status STS20 shown in FIG. 4(17), a lens unity magnification request is sent to the slave Q102 (see FIG. 7(2)). Then, in a step S234, the 30-milliseconds timer is set.

The program waits for the completion of the communication to the slave Q102 for this time period (30 milliseconds).

After the elapse of 30 milliseconds, "21" is stored in the next status area STS (step S236).

In the status STS21 shown in FIG. 4(18), the time-out of the timer is detected in a step S238. The time-out of the 30-milliseconds timer set in the status STS20 is checked.

After the time-out of the 30-millisecond timer, the program proceeds to a step S240 to effect the potential controlled rotation. "Set $V_D$, $V_{SL}$ counters to 4" means to detect the dark potential $V_D$ and the light potential $V_{SL}$ and set the number of times of potential control for controlling the outputs of the primary charger 3 and the secondary charger 4 to "4".

In a step S242, the developing bias is set, and in a step S244, the main motor is rotated at a high speed.

In a step S246, the primary and secondary high voltages are turned on, in a step S248, the separation high voltage is turned on, in a step S250, the drum heater is deenergized, and in a step S252, the drum clock count is cleared.

In a step S254, whether the movable optical system is at the home position or not is checked. If it is not at the home position, the optical system backward clutch is energized in a step S256 to bring the movable optical system back to the home position. Thereafter, the control is shifted to the status STS22 (step S258).

In the status STS22 shown in FIG. 4(19), a time point when the 169th drum clock is generated is detected (steps S260 and S262). When the 169th clock is detected, the drum clock count is cleared (step S264) and the control is shifted to a status STS30.

In the status STS30 shown in FIG. 4(21), whether 150 drum clocks have been generated or not is checked (steps S272 and S274). If the 150 clocks are detected, the lamp/heater selection relay is energized in a step S276. The lamp is the halogen lamp and the heater is the fixer heater. The energization of the selection relay means to set the relay contact to the halogen lamp. The halogen lamp is not yet turned on at this step.

In a step S278 (set $V_{SL}$), the blank exposure lamp is turned on and the surface potential for the light area of the photoconductor is measured.

In a step S280, the drum clock count is cleared and the control is shifted to a status STS31 (step S282).

In the status STS31 shown in FIG. 4(22), whether seven drum clocks have been detected or not is checked. If the seven drum clocks have been detected, the blank exposure lamp is turned off in a step S228, and the drum clock count is cleared in a step S290. Thereafter, the control is shifted to a status STS32 (step S292).

In the status STS32 shown in FIG. 4(23), the dark potential $V_D$ is measured (steps S298 and S300) when 150 drum clocks have been detected (steps S294 and S296). A command is set to measure the surface potential (dark potential) as is done for the $V_L$ set (see step S278).

In a step S302, the counts of the $V_D$ and $V_{SL}$ counters (see step S240) are decremented by one. Since the counters were set to "4" in the status STS21, the status STS33 (step S308) is actually repeated four times. After the four runs of the loop, the control is shifted to a status STS40 in a step S306.

In the status STS33 shown in FIG. 4(24), seven drum clocks are detected (steps S310 and S312), the blank exposure lamp is turned on (step S314), the drum clock count is cleared (step S316) and then the control is shifted to the status STS30. The status STS30–STS33 are repeated four times until the potential control by $V_D$ and $V_{SL}$ are carried out four times. After the $V_D$ and $V_{SL}$ potential control, the control is shifted to a status STS40.

In the status STS40 shown in FIG. 4(26), whether the movable optical system is at the home position or not is checked in a step S324.

If the movable optical system is not at the home position, whether the movable optical system is moving backward or not is checked in a step S332. If it is not, the optical system backward clutch is energized in a step S334 to return the optical system to the home position.

If the movable optical system is at the home position, the exposure lamp is turned on in a step S326 to illuminate a standard white plate 70 with a standard light intensity, and the $V_{L1}$ counter is set to "3" in a step S328. Thus, the surface potential of the standard light potential $V_{L1}$ is measured three times. Then, the control is shifted to a status STS41 (step S330).

In the status STS41 shown in FIG. 4(27), 190 drum clocks are detected (steps S336 and S338), and whether the lens movement has been completed or not is checked in a step S340. That is, whether the zoom lens is at the unity magnification position or not is checked. If the lens is at the unity magnification position, the $V_{L1}$ counter is set in a step S346. That is, the surface potential of the standard light area is measured.

In a step S348, the drum clock count is cleared and "42" is stored in the area STS, and the control is shifted to a status STS42.

In the status STS42, 157 drum clocks are detected (steps S352 and S354) and the $V_{L1}$ counter is decremented by one. Since "3" has been set in the $V_{L1}$ counter, the loop is repeated three times.

Then, in a step S360, the $V_{L2}$ counter is set and the surface potential of the standard light area of the photoconductor is measured. Thereafter, the control is shifted to a status STS43 (step S364).

In the status STS43 shown in FIG. 4(28), seven drum clocks are detected (step S366), and in a step S370, whether the machine is in the copying operation or not is checked. If it is not, the exposure lamp is turned off in a step S372.

Then, the "wait end" signal is set (step S374), the primary high voltage is turned off (step S376), the transfer high voltage is turned off (step S378), the drum clock count is cleared (step S380), and the control is shifted to a status STS44.

In the status STS44 shown in FIG. 4(29), 14 drum clocks are counted (steps S386 and S388) and the heater relay in switched to the lower heater (step S390).

In a step S392, the separation high voltage is turned off, the drum clock count is cleared in a step S394 and "45" is stored in the area STS in a step S396.

In a status 45 shown in FIG. 4(30), 14 drum clocks are detected (steps S398 and S400), and the lower heater of the fixer is energized in a step S402.

In a step S404, the rotation of the main motor is stopped. Thereafter, in a step S406, "Drum ON flag" is turned off, and the flat lamp is turned off in a step S408.

In a step S410, the registration clutch is deenergized, the development bias is set to zero volt in a step S412, and the secondary high voltage is turned off in a step S414.

Thereafter, in a step S416, "46" is stored in the area STS and the control is shifted to a status STS46.

In the status STS46 shown in FIG. 4(31), the one-minute flag is turned off in a step S418. A time management is required to measure the surface potential because the number of times of the potential control differs depending on the leaving time of the machine. Thus, the one-minute timer is set in a step S422 and then the control is shifted to a status STS50 in a step S424.

The status STS5 shown in FIG. 4(32) is a stand-by routine. In a step S426, the toner quantity and the used toner quantity are checked.

In a step S428, the jam is checked. If the paper is detected by the separation sensor or the paper ejection sensor, the jam flag is set to indicate the paper jam (steps S430 and S432).

In a step S434, the temperature of the fixer is controlled. In the present embodiment, the temperature is set to 180° C. so that the heater is energized or deenergized to keep the temperature at 180° C.

In a step S440 (ready check), various status are checked. For example, the presence or absence of the key counter is checked to determine whether the copy operation is ready to start.

In a step S442, the speed control signal for the intermediate tray convey motor is sent out to the pedestal controller Q103 so that it is synchronized with the rotation of the main motor.

The motor speed control is effected by the lowermost order bit $b_0$ of the MPSTS2 (motor LOW/HIGH) shown in FIG. 9(1).

In a step S444, whether the power supply is automatically shut off or not is checked. If no operation has been done for approximately two hours after the copy operation, the main switch is automatically turned off by the auto-shut-off function. Whether the auto-shut-off function is to be effected or not is determined in this step.

If the decision is not to turn off the main switch, the ready state is checked in a step S446.

If it is the ready state, the depression of the copy start key is checked in a step S448. If the copy start key has been depressed, the preset count is informed to the pedestal controller Q103 in a step S450 (see FIG. 4(33)).

On the other hand, if the copy start key has not been depressed, the program returns to the main routine.

In a step S452, the communication data to the pedestal controller Q103 is initialized, and the copy operation flag is set in a step S454.

In a step S456, the double side copy mode is checked. If it is the double side copy mode, the intermediate tray is used and the abnormal/normal state of the pedestal controller Q103 is checked (step S458). If it is normal, the front side copy mode is checked in a step S460.

If it is the front side copy mode, whether the record papers are present in the intermediate tray or not is checked (step S462). If the record papers have been stored in the intermediate tray, the control plate cannot be moved. Therefore, the presence or absence of the record papers is checked in this step.

If the record paper is not present in the intermediate tray, the stand-by signal to the pedestal controller Q103 (see MPSTS1 in FIG. 9(1)) is set in a step S464.

When the paper is fed from the 2000-capacity deck, the deck drive request to the pedestal controller Q103 is set in a step S468 (see FIG. 9(1)).

In a step S470, whether the size of the record paper is A3 or not is checked. Since the sorter of the copying machine in the present embodiment can sort the papers of up to size B4, if the size A3 is designated, the papers are unconditionally ejected to the non-sort bin. Accordingly, if the size A3 is detected in the step S470, the non-sort request is set in a step S472 (see Q108 shown in FIG. 3(1)).

In a step S474, the bin cam return signal BCR is set to the sorter. Thus, the elevator for causing the papers to be ejected in a predetermined bin in the sorter is returned to the home position.

In a step S476, the sorter ON signal is sent to the Q108 (see FIG. 3(1)) to energize the conveyer motor to eject the papers.

Thereafter, "60" is stored in the area STS and the control is shifted to a status STS60 (step S478).

In the status STS60 shown in FIG. 4(35), the separation fan (blower fan for separating the record paper from the photoconductor drum) is rotated at a high speed in a step S486. The separation fan is normally rotated at a low speed.

In a step S488, whether the main motor rotates at the high speed or the low speed is checked. The rotation speed of the main motor is determined by the copy magnification. It is rotated at the high speed when the magnification is larger than 90%, and at the low speed when the magnification is no larger than 90%.

The program branches to a step S494 or S490 depending on the rotation speed of the main motor in order to change the developing bias.

In a step S498, the drum on flag (which is an internal flag to indicate the rotation of the drum) is set.

Thereafter, in a step S506, whether the movable optical system is at the home position or not is checked. If it is not at the home position, the lens movement is completed (step S508) and then the optical system is moved backward (step S510).

In a step S512, the separation fan is again energized.

The fixer lower heater is energized in a step S514, the registration clutch is energized in a step S516, and all lamps for erasing the surface of the photoconductor drum are turned on in a step S518 (blank all ON).

In a step S520 shown in FIG. 4(36), the primary high voltage (HVT) and the secondary high voltage are turned on.

In a step S522, the post, separation and transfer high voltages are turned on. The drum clock is cleared in a step S524, and whether the copy magnification is same as the previous one or not is checked in a step S526 in order to control the surface potential in accordance with the rotation speed of the motor, that is, in accordance with the magnification.

If the magnification is not same as the previous one, the control is shifted to a status STS61.

If the magnification is same as the previous one, the elapse of the time is checked in a step S528 because the quantity of the charges carried on the surface of the photoconductor drum changes with the time and the method for measuring the surface potential changes depending on whether the elapsed time is longer than one minute or not.

In a step S530, the automatic exposure (AE) mode is checked because the operation sequence changes depending on the mode.

If it is the AE mode, "70" is stored in the area STS and the control is shifted to a status STS70 (step S534).

In the status STS61 shown in FIG. 4(37), 169 drum clocks are detected (steps S536 and S538), and whether the movable optical system is at the home position or not is checked (step S540).

When the movable optical system is at the home position, "62" is stored in the area STS to shift the control to a status STS62 (step S548).

If the movable optical system is not at the home position, the optical system is moved backward in a step S546.

In the status STS62 shown in FIG. 4(38), whether the movable optical system has reached the home position or not is checked (step S552), and the back side copy mode is checked (step S554).

If it is not the back side copy mode, the deck paper feed (paper feed from the 2000-capacity deck 54) is checked in a step S556.

In the deck paper feed, the paper feed request to the pedestal controller Q103 is set in a step S558 (see MPSTSO shown in FIG. 9(1)).

In a step S560, all blank exposure lamps are turned off.

In a step S562, whether the mode (magnification) is same as the previous one or not is checked. If it is same as the previous one, a step S570 is carried out.

If the mode is not same as the previous one, the drum clock is cleared in a step S564, the $V_D$ and $V_{SL}$ counters are set to n+1 in a step S566 (where n is up to 4), and "63" is stored in the area STS.

In a status STS63 shown in FIG. 4(39), 150 drum clocks are detected (steps S578 and S580), and the light potential $V_{SL}$ of the photoconductor drums is measured (step S582).

Thereafter, in a step S584, the drum clock is cleared, and "64" is stored in the area STS.

In a status STS64 shown in FIG. 4(40), seven drum clocks are detected (steps S588 and S590), the blank exposure lamp is turned off (step S594), the drum clock is cleared (step S594), and "65" is stored in the area STS to shift the control to a status STS65 (step S596).

In the status STS65 shown in FIG. 4(41), 150 drum clocks are detected (steps S598 and S600), the drum clock count is cleared (step S602), and the measurement of the dark potential $V_D$ is started (step S604). In the step S604, the mode to measure the dark potential of the photoconductor drum surface is set.

In a step S606, the $V_D$ and $V_{SL}$ counters are decremented by one. Accordingly, this step is repeated up to four times.

Thereafter (step S608), the lamp/heater selection relay is switched to the lamp (halogen lamp) to turn on the halogen lamp (steps S610 and S612). Thereafter, "40" is stored in the area STS to shift the control to the status STS40 (step S614).

In a step S616, "66" is stored in the area STS to shift the control to a status STS66.

In the status STS66 shown in FIG. 4(42), seven drum clocks are detected (steps S618 and S620), and the blank exposure lamp is turned on (step S622).

Thereafter, the drum clock count is cleared (step S624) and "63" is stored in the area STS to shift the control to a status STS63 (step S626). The status STS63–STS66 are repeated until the contents of the $V_D$ and $V_{SL}$ counters reach zero.

In a status STS67 shown in FIG. 4(43), 190 drum clocks are detected (steps S628 and S630), the measurement of $V_{L2}$ is started (step S632), the drum clock count is cleared (step S634), and "68" is stored in the area STS to shift the control to a status STS68 (step S636).

The status STS68 shown in FIG. 4(44) is also branched from the step S384 shown in FIG. 4(28).

Seven drum clocks are detected (steps S638 and S640) and the drum clock count is cleared (step S642).

Thereafter, whether the AE mode has been set or not is checked in a step S644, and if it has not been set, the control is shifted to a step S648 (status 80), and if it has been set, the control is shifted to a step S646 (status 71).

In the status STS7 shown in FIG. 4(45), the AE (automatic exposure control) scan is carried out.

The automatic scan control is a sequence to measure the density of the original sheet so that a clear image is always obtained for any original sheet. The light intensity of the original sheet exposure halogen lamp 40 is determined in accordance with the measured original sheet density.

In a status STS70 shown in FIG. 4(46), 30 drum clocks are detected (steps S652 and S654), and whether the movable optical system is at the home position or not is checked (step S656).

If it is at the home position, the halogen lamp/heater selection relay is set to the halogen lamp (step S658). When the paper is fed from deck (step S660), the paper feed request is sent to the pedestal controller Q103 (step S662).

If the movable optical system is not at the home position (step S656), whether the movable optical system is moving backward or not is checked (step S670) after the lens has been moved to the predetermined position (step S668).

If the movable optical system is not moving backward, the optical system backward clutch is energized (step S672).

In a status STS71 shown in FIG. 4(47), seven drum clocks are detected (steps S676 and S678) after the lens has been moved to the predetermined position (step S674). When seven drum clocks are detected, the optical system forward clutch is energized (step S680) and the internal flag "AE scan" is set (step S682).

In a step S684, the lamp/heater selection relay is set to the lamp. The halogen lamp is turned on in a step S686. The firing voltage of the halogen lamp is controlled by the microcomputer.

In a step S688, a reference firing voltage is outputted to provide a constant light intensity for the AE measurement.

In a step S690, all blank exposure lamps are turned on, and "72" is stored in the area STS72 to shift the control to a status STS72 (step S692).

In the status STS72 shown in FIG. 4(48), whether the movable optical system has reached the size A4 position or not is checked. This is checked by monitoring the counter in the step S68.

If the movable optical system has been moved to the size A4 position (step S694), the AE measurement is started in a step S700.

In a step S702, the optical system forward clutch is deenergized. In a step S704, the optical system forward flag is reset. Thus, the forward movement of the optical system is completed.

The drum clock count is then cleared (step S706), and "73" is stored in the area STS to shift the control to a status STS73.

If the movable optical system has not been moved to the size A4 position, whether the optical system timer (which was set at the forward movement) is timed out or not is checked (step S696). If the movable optical system does not reach the size A4 position within the predetermined time, the serviceman call error is displayed to indicate the abnormal state (step S698).

In a status STS73 shown in FIG. 4(49), no operation is carried out and the control is shifted to a status STS74.

In the status STS74 shown in FIG. 4(50), seven drum clocks are detected (steps S712 and S714), the optical system backward clutch is energized (step S716) and the drum clock count is cleared (step S718).

In a step S720, the AE drum counter is cleared. The period of the AE measurement carried out during the backward movement of the optical system is checked by the AE drum counter. Thereafter, "75" is stored in the area STS to shift the control to a status STS75.

In the status STS75 shown in FIG. 4(51), whether the movable optical system is again at the size A4 position or not is checked (step S724). Whether the optical system has been returned to the size A4 position by the backward clutch energized to cancel the affect by the inertia of the movable optical system passed past the size A4 position is checked.

If the movable optical system has been returned to the size A4 position, the AE drum counter is cleared (step S726) and the control is shifted to a status STS76.

If the optical system has not been returned to the size A4 position, 169 drum clocks are detected (steps S730 and S732) and then the serviceman call error 82 is displayed to indicate the abnormal state. 82 is a code to indicate the optical system abnormal status.

In the status shown in FIG. 4(52), whether the movable optical system has reached the size A4 position or not is checked. In the present example, the decision is YES and the program proceeds to a step S740.

In the step S740, the AE drum counter is checked to determine whether the count is larger than 28. If it is larger than 28, the AE measurement is started (step S742). Thereafter, the drum clock count is cleared (step S744) and the control is shifted to a status STS77.

In the status STS77 shown in FIG. 4(53), 32 drum clocks are detected (steps S748 and S750) and then the AE measurement is stopped. Thus, during the execution of the AE measurement, the surface density of the original sheet is averaged and the halogen lamp firing voltage for the copy is determined based on the average density. In a step STS754, "78" is stored in the area STS to shift the control to a status STS78. Alternatively, the maximum density (background density) may be measured to control the halogen firing voltage.

In the status STS78 shown in FIG. 4(54), whether the movable optical system has been returned to the home position or not is checked (step S756). If the movable optical system is returned to the home position after the AE measurement, the AE scan flag is turned off (step S758) and the control is shifted to a status STS80.

The status STS8 shown in FIG. 4(55) is a sequence program for executing the copying operation. In a step S762, the temperature of the fixer is maintained at a predetermined temperature.

In a step S764, the request signal to turn on the halogen lamp is detected. The request signal to turn on the halogen lamp which was turned off during the backward movement of the movable optical system is detected.

In a step S766, whether the movable optical system has reached the half position (the size A4 position) or not is checked. If the movable optical system has reached the half position, the halogen lamp is turned on in a step S768.

In a step S770, the halogen ON request signal is reset. Thereafter, the program branched to the status processing routine.

In a status STS80 shown in FIG. 4(56), the halogen lamp is turned off (step S774) and the bin cam return (BCR) signal is turned off (step S776). The sorter bin shift operation is controlled by the Q108 (see FIG. 3(1)).

In a step S778, whether the back side copy mode is to be executed or not is checked. If the back side copy is not to be made, whether the front side copy is to be made or not is checked in a step S780.

When the front side copy is to be made, the flapper 33-1 of the switch-back unit is energized (see FIG. 1(3)). When the front side copy is to be made in the double side copy mode, the flapper 33-1 of the switch-back unit should be energized because the record paper is to be fed to the intermediate tray.

In a step S784, whether the control plate 56 of the intermediate tray (see FIG. 1(1)) has been moved or not is checked. The control plate defines the size of the intermediate tray 59 depending on the paper size.

In a step S786, the abnormal state of the pedestal controller Q103 is checked. If it is detected, the serviceman call error 8B is set (step S788).

In a step S790, the mode to be executed is set in the internal area. Thereafter, the source of the record paper is selected in steps S792 and S794. Whether the upper cassette or the lower cassette is to be used or the record paper is manually inserted is determined. When the record paper is to be manually fed, the upper pickup solenoid is energized (step S796), the drum clock count is cleared (step S798) and the control is shifted to the status STS81. Otherwise, the control is shifted to the status STS83 (steps S794, S800 and S802).

In the status STS81 shown in FIG. 4(57), 17 drum clocks are detected (steps S804 and S806) and the pickup solenoid (paper feed solenoid) is deenergized (step S808). Then, the drum clock count is cleared (step S810) and the control is shifted to the status STS82 (step S812).

In a status STS82 shown in FIG. 4(58), 40 drum clocks are detected (steps S814 and S816) and the control is shifted to a status STS83 (step S818).

In the status STS83 shown in FIG. 4(59), the back side copy mode is checked (step S820). If it is not, the front side copy mode is checked (step S822). If it is not, whether the sorter is enabled or not is checked (step S824).

If it is the front side copy mode, the step S824 is jumped because there is no need to feed the paper from the main unit.

Thereafter, the heat evacuation fan is deenergized (step S826), the paper feed roller is energized depending on the upper cassette or the lower cassette selected by the user (step S828), and the small counter (counter for the size A4 or smaller papers) or the large counter (counter for the sizes B4 and A3) is actuated (step S830). This is useful when the charge is different depending on the paper size. It is not relevant for the ordinary use in Japan.

Then, the drum clock count is cleared (step S832) and the control is shifted to a status STS84.

In the status STS84 shown in FIG. 4(60), 164 drum clocks are detected in steps S836 and S838, the developing bias DC (1600 V) is turned on in a step S840, the developing bias AC is turned on in a step S842, the paper feed roller is deenergized in a step S844 the small counter or the large counter is deactuated in a step S846, the halogen lamp is turned on in a step S868, the drum clock count is cleared in a step S850, and the control is shifted to a status STS852 in a step S852.

In the status STS85 shown in FIG. 4 (61), 100 drum clocks are detected (steps S854 and S856) and the paper feed counter is incremented by one (step S858).

After steps S860 and S862 have been carried out, the optical system registration clutch is deenergized. The registration clutch serves to register the leading edge of the image of the optical system with the leading edge of the record paper (see 15 in FIG. 1 (1)).

In a step S866, the optical system forward clutch is energized, and the web motor is energized in a step S868.

In a step S870, the last copy is checked. If it is the last copy, the continuous copy flag is turned off in a step S872 and the paper feed request signal to the pedestal controller Q103 is reset in a step S874. On the other hand, if the continuous copy operation is detected, the continuous copy flag is turned on in a step S876.

Thereafter, the control is shifted to a status STS86 (step S878).

In the status STS86 shown in FIG. 4(62), the image leading edge signal is detected in a step S880. The image leading edge signal is a one which indicates the leading edge of the original sheet. After the image leading edge signal has been detected, 18 drum clocks are counted (steps S882 and S884) and the upper cassette or lower cassette pickup solenoid is deenergized (step S886).

Then, the back side copy mode is checked (step S888). If it is the back side copy mode, the control is shifted to a status STS87 in a step S894.

If the back side copy is not to be made, whether the paper is to be fed from the deck or not is checked in a step S890, and if the decision is YES, the image leading edge flag to the pedestal controller Q103 is set (step S892). Thereafter, the control is shifted to a status STS87.

The status STS87 shown in FIG. 4(63) is now explained.

In a step S896, if the movable optical system does not reach the predetermined position in the predetermined time period, the movable optical system must have stopped somewhere or the motor must not work and the serviceman call error 82 is set (step S898).

If it is not abnormal, whether the paper is to be fed from the deck or not is checked in a step S900. If the paper is not to be fed from the deck, the paper size of the upper or lower cassette is stored in the accumulator in a step S902.

When the paper is to be fed from the deck, the paper size of the deck is stored in the accumulator in a step S912.

If the step S902 is executed, whether the record paper is to be manually inserted or not is checked in a step S904.

Steps S906 to S910 are processing program for checking the copy magnification. RI and RII (step S908) represent reduction 1 (reduction factor 71%) and reduction 2 (reduction factor 82%), respectively, and EI represents magnification 1 (114%).

In steps S916 to S928, the paper size is checked. Since the scan width of the movable optical system changes depending on the copy magnification and the paper size, the paper size is detected in the steps S916 to S928.

EII shown in a step S934 represents magnification factor 142%.

When the reversal position is determined (steps S930 and S940), the blank exposure lamp is turned on in a step S942. The scan of the movable optical system is terminated.

In a step S944, the drum clock count is cleared. In a step S946, the area "leading edge" in the RAM is cleared for the pedestal controller Q103.

In a step S948, the area STS is incremented by one to shift the control to a status STS88.

When the stop key is depressed during the copy operation, the copy operation must be stopped. Accordingly, the depression of the stop key is checked in a step S950.

If the stop key is not depressed and it is not the last copy (step S954), the paper feed roller is energized (step S956), the small or large counter is activated (step S958) and the continuous copy flag is turned on (step S960).

If the stop key is depressed, the continuous copy flag is turned off in a step S952.

In a status STS88 shown in FIG. 4(64), three drum clocks are detected (steps S962 and S964), the optical system forward clutch is deenergized (step S966), the optical system forward flag is turned off (step S968) and "89" is stored in the area STS to shift the control to a status STS89.

In the status 89 shown in FIG. 4(65), whether the reduction mode RI or RII has been selected or not is checked in a step S972. In the reduction mode, the main motor is rotated at the low speed. Thus, ten drum clocks are detected in steps S974 and S976. On the other hand, if the reduction mode is not selected, the main motor is rotated at the high speed. Thus, five drum clocks are detected in steps S980 and S982. Thereafter, in a step S984, the optical system backward clutch is energized to shift the control to a status STS8A.

In the status STS8A shown in FIG. 4(66), 13 drum clocks are detected (steps S984 and S986), the halogen lamp is turned off (step S988), the paper feed clutch is deenergized (step S990) and the small or large counter is deactivated (step S992).

In a step S994, the last copy is checked. If it is the last copy, the program branched to a step S998 to shift the control to a status 8B. On the other hand, if it is not the last copy, the halogen lamp ON request signal is set in a step S996 (see step S764 in FIG. 4(55)). The flag is set so that the halogen lamp is turned on during the backward movement of the optical system in the continuous copy mode.

In the status STS8B shown in FIG. 4(67), 30 drum clocks are detected (steps S1000 and S1002) and whether the unity magnification copy mode is to be carried out or not is checked (step S1004). Since it is the decision on whether the main motor is to be rotated at the high speed or not, the developing bias is set in accordance with the rotation speed (steps S1008 and S1006).

In a step S1010, the developing bias AC is turned off. Then, depending on whether it is the last copy or not, the control is shifted to a selected status (steps S1016 and S1014). If it is the last copy, the control is shifted to a status STS90, and if it is not the last copy, the control is shifted to a status STS8C.

In the status STS8C shown in FIG. 4(68), 47 drum clocks are detected (steps S1017 and S1018), the developing bias DC is set to a predetermined level (steps S1020 and S1022) and the paper feed solenoid is energized (steps S1024). Then, "8D" is stored in the area STS to shift the control to a status STS8D.

In the status STS8D shown in FIG. 4(69), whether the movable optical system has been returned to the home position or not is checked (step S1028). If the optical system has been returned to the home position, the control is shifted to a status STS85 (step S1030).

In a status STS8F shown in FIG. 4(70), 56 drum clocks are detected (steps S1032 and S1034) and the control is shifted to a status STS87.

A status STS90 shown in FIG. 4(72) is a processing program which is executed when the last copy is made (see steps S1012 and S1014 shown in FIG. 4(67)).

In the status STS90, whether the movable optical system has been returned to the home position or not is checked (step S1042), and if it has been returned, the developing bias DC is raised to 400 V to prevent the toner from being deposited to the drum (step S1044). Thereafter, the drum clock count is cleared (step S1046) and the control is shifted to a status STS91 (step S1048).

In a status STS91 shown in FIG. 4(73), 30 drum clocks are detected (steps S1050 and S1052), the transfer high voltage is turned off (step S1054), the primary high voltage is turned off (step S1056), the drum clock count is cleared (step S1058) and "92" is stored in the area STS to shift the control to a status STS92.

In the status STS92 shown in FIG. 4(74), 14 drum clocks are detected (steps S1062 and S1064) and the selection relay is switched to the lower heater (step S1066).

Thereafter, steps S1068 and S1070 are carried out and the control is shifted to a status STS93 (step S1071).

In the status STS93 shown in FIG. 4(75), 14 drum clocks are detected (steps S1072 and S1074), the secondary high voltage is turned off (step S1076), the drum clock count is cleared (step S1078) and "94" is stored in the area STS to shift the control to a status STS94.

In the status STS94 shown in FIG. 4(76), whether the jam killing has been selected or not is checked in a step S1082. Since the jam killing is normally not selected, the depression of the stop key is checked in a step S1084. Depending on the status of the stop key, the program branches to a step S1096 or S1086.

If the stop key is depressed (YES), the back side copy mode is checked in a step S1086. In the back side copy mode, 169×5 drum clocks are counted and then the program proceeds to the next step.

If the back side copy is not made (step S1086), 169×3 drum clocks are counted and then the program proceeds to the next step.

The number of drum clocks to be detected differs depending on whether the back side copy mode has been set or not because an extra time is required in the switch back operation carried out in the back side copy mode. That is, the record paper must be reversed at the switch-back unit when the paper is ejected.

If the stop key has not been depressed (step S1084), the program branches to the step S1096 to check whether the number of papers fed matches the number of papers ejected. If the number of papers fed does not match the number of papers ejected, it means that the paper is still left in the machine. Accordingly, the program returns to the main routine to run the status STS94. If the numbers match, the program after a step S1098 is executed and the control is shifted to a status STS95.

In the status STS95 shown in FIG. 4(77), 30 drum clocks are detected (steps S1116 and S1118), the fixer lower heater is energized (step S1120), the developing bias DC is turned off (step S1122), the main motor is deenergized (step S1124), the web motor is deenergized (step S1126), the separation fan is set to the low speed (step S1128), all blank exposure lamps are turned off (step S1130), the flat exposure lamp is turned off (step S1132), the serial data to the pedestal controller Q103 was cleared, the flapper (see FIG. 1(3)) of the switch-back unit is returned (step S1136), the sorter ON signal which is sent to the Q108 to rotate the conveyer motor is turned off (step S1138), the non-sort flapper of the sorter is deactivated (step S1140), all flags to be used by the internal microcomputer are cleared (steps S1142), the one-minute timer for determining the number of times of the potential control is started (step S1144), and "50" is stored in the area STS to shift the control to a status STS50 (step S1146).

The series of copy operations are thus completed and the program returns to the stand-by loop.

FIGS. 4(78) and 4(79) show control programs in the transmission of the serial data. In a step S1148, the transmission status is checked. It is checked by the internal area flag (most significant bit $b_7$ of send counter SNDCT shown in FIG. 4(79). If the most significant bit $b_7$ of the SNDCT is "1", it indicates the transmission mode.

If it is not the transmission mode, the send counter is incremented by one in a step S1150. When the bit $b_4$ of the send counter SNDCT changes to "1", the transmission to the A/D converter Q104 is started (steps S1152, S1164 and S1166). If the bit $b_4$ of the send counter SNDCT is not "1", whether the content of the send counter SNDCT is 1, 5, 9 or D is checked in steps S1154–S1160. The transmission to the pedestal controller Q103 is carried out in accordance with that timing (steps S1168 and S1170).

However, if the drum is rotating (that is, during the copy operation), the transmission is carried out in synchronism with the drum clock and hence the transmission to the pedestal controller Q103 is not carried out.

If the count of the send counter SNDCT is not 1, 5, 9 or D, the transmission to the slave Q102 is carried out (step S1162).

In the transmission mode (step S1148), the transmission flag of the ADCCT (most significant bit $b_7$ of the ADCCT shown in FIG. 4(79) is checked in a step S1172. Thus, whether the transmission to the A/D converter Q104 is being carried out or not is checked.

If the transmission to the A/D converter Q104 is not being carried out, the transmission to the slave Q102 is checked in a step S1174.

If the transmission to the A/D converter Q104 is being carried out, the ADC counter is incremented by one (step S1180), and if the transmission to the slave is being carried out, the SLV counter is incremented by one (step S1178).

If the transmission still continues after the predetermined time period (step S1182), the serviceman call error is set to indicate the abnormal state (step S1184).

FIGS. 5(1) to 5(11) show processing programs for the slave Q102.

In a step S1186 of FIG. 5(1), the RAM ports are initialized.

In a step S1186, the ON-state of the 24 V power supply is checked.

When the main switch is turned on (YES in a step S1188), the display is initialized in a step S1192. Thereafter, the display enable flag is turned on in a step S1194. It is an internal flag used in the display routine.

In a step S1196, the power-off state (24 V power supply off) is checked, and if it is the power-off state, the program returns to the step S1188.

In a step S1198, the depression of the key is checked. If the key has not been depressed, the display flag is set in a step S1200. Then, the program circulates the loop of the steps S1196–S1200.

In a step S1202 shown in FIG. 5(2), the key code (KYCOD) of the depressed key is stored in the area SKEY (set key).

In a step S1204, the key flag is reset. The key flag is an internal flag which is set by the depression of the key. The type of the depressed key is designated by the key code KYCOD.

In steps S1206 to S1230, the depressed key is determined and corresponding key processing is carried out. That is, if the ten-key (numeric key) is depressed, the ten-key processing is carried out (steps S1206 and S1208). When the copy start key is depressed, the copy start processing is carried out (steps S1210 and S1212). In actual, the depression of the copy start key is informed to the master Q101 by the serial communication.

When the stop key is depressed, the depression of the stop key is informed to the master Q101 by the serial communication (steps S1214 and S1216).

If the interrupt key is depressed during the copy operation, the depression of the interrupt key is informed to the master Q101 (steps S1218 and S1220).

When the cassette selection key (which selects one of the upper cassette, the lower cassette and the deck) is depressed, the selection processing is carried out (steps S1222 and S1224).

When the copy magnification designation key is depressed, the magnification key processing is carried out (steps S1226 and S1228).

When the copy mode designation key (e.g. double side copy mode designation key) is depressed, the corresponding mode processing is carried out (steps S1230 and S1232).

The main routine in the slave has thus been described.

FIG. 5(3) shows a timer interrupt (TINT) processing. The interruption by the interval timer occurs at every 1.248 msec.

In a step S1234, the display processing is carried out, in a step S1236, the key input processing is carried out, and in a step S1238, the timer processing is carried out. In the timer processing, a specified operation is carried out after a preset time.

The serial interruption (SINT) shown in FIG. 5(4) is now explained.

The high order 4 bits of the serial signal sent from the master Q101 to the slave Q102 are called status information and the low order 4 bits are called data information (see FIGS. 7(1) and 7(2)). In a step S1240, the status information is loaded and steps S1242–S1268 are carried out in accordance with the status.

Thereafter, in a step S1270, the data to be next transmitted to the master Q101 is set. Since the serial communication is carried out by parallelly exchanging the data, the data to be next transmitted is previously set in the slave. As the serial data is transmitted from the master Q101, the data are parallelly exchanged.

FIGS. 5(5) to 5(7) show a display routine which is outlined below.

LABEL: DISP

Input Condition: Periodical call by internal timer

Output Condition: [DGCNT]+1

Processing: One digit line display for each call. Display depends on the content of DGCNT as shown below.

| DGCNT | Display |
|---|---|
| 0 | Translate high order 4 bits of [QUANT] to 7-segment code. Supress O's. |
| 1 | Translate low order 4 bits of [QUANT]to 7-segment code. |
| 2 | Output content of [DGDA2]. |
| 3 | Output content of [DGDA3]. |
| 4 | Output content of [DGDA4]. |
| 5 | Output content of [DGDA5]. |
| 6 | Output content of [DGDA6]. |
| 7 | Output content of [DGDA7]. |

The content of the display area is translated to DGDA2–DGDA7 for each scan, and if the blink flag is set, the display is flashed at the interval of 800 msec.

In a step S1274 shown in FIG. 5(5), the digit line by the dynamic firing is turned off. In a step S1276, the 8-bit DP flag (see DPFLG shown in FIG. 5(7)) is checked. If the display enable flag is set at the bit $b_0$ of the DPFLG (step S1278), the display processing shown in step S1280 et seq is carried out.

On the other hand, if the display enable flag is not set, the entire display is erased (step S1290).

If the display enable flag is "1", the digit counter DGCNT is loaded in a step S1286 and steps S1292–S1298 are carried out.

In a step S1300, the digit signal is matched to the 7-segment signal to fire the desired digit.

In a step S1302, the digit counter is incremented by one for the next display, and when the digit counter reaches 8, it is cleared (steps S1304 and S1306).

Then, in a step S1308, a sub-routine DPCNV (see FIG. 5(6)) is executed.

FIGS. 5(8) and 5(9) show the output data to be displayed by the 7-segment LED and the display format. The "data" here includes 16 internal data O–F. "P" indicates the display format for the jam. When three papers are left in the machine, "P3" is displayed.

When the serviceman call error occurs, "E" is displayed.

FIGS. 5(10) and 5(11) show the key input routine which is outlined below.

Key Input Routine
LABEL: KEYIN
Input Condition: DGCNT=0–7
  Output digit line
  KYFLG When $b_7=1$, only stop and interrupt keys are valid.
    When $b_0=1$, no key is accepted.
Output Condition: KYCOD
  KYFLG $b_0 \leftarrow$ "1"
Processing: 15–20 msec for chattering. If two or more keys are depressed, they are neglected. After all keys are turned off, a key is again depressed.

In a step S1324 shown in FIG. 5(11), the bit $b_0$ of the key flag is checked. If the key processing has not been completed before this processing program is executed, the next key cannot be set. Accordingly, if the bit $b_0$ is "1", the program is returned.

If the key has not previously been entered, the key input is read in a step S1326.

In a step S1328, the presence or absence of the key read in the step S1326 is checked. If it is present, the bit $b_7$ of the key flag is checked (step S1330). During the copy operation, only when the flag (bit $b_7$ of KYFLG) is "1" indicating that only the stop key and the interrupt key is valid, the key flag is set.

The processing program to be executed by the slave Q102 has thus been described.

FIGS. 6(1)–6(11) show a processing program to be executed by the pedestal controller Q103. The pedestal controller Q103 (see FIG. 3(1)) controls in the double side copy mode and the deck paper feed mode.

In a step S1336 shown in FIG. 6(1), the CPU is initialized, and the serial data is checked in a step S1338. The content of the serial communication data sent from the master Q101 is checked.

In a step S1340, the input routine for the sensors of the pedestal controller Q103 is executed, and the deck paper feed status is set in a step S1342.

In a step S1344, the paper feed status of the intermediate tray is set, and the open/close state of the main unit door is checked. If the 24 V power supply is off, the pedestal controller Q103 determines that the main unit door is open.

In a step S1348, the home position of the intermediate tray is checked. Since it is not known where the paper size control plate 56 (see FIG. 1(1)) of the intermediate tray 59 is located at the time of the power-on, it is once returned to the home sensor position and then moved in accordance with the paper size.

In the deck lift up/down routine shown in a step S1350, the deck lifter 54L (see FIG. 1(1)) is moved up or down.

In steps S1352–S1362, the program branches to steps S1364–S1374 depending on the status STS0–5 used for the sequence control.

In the stand-by loop shown in a step S1364, the depression of the copy button in the main unit is waited.

In a step S1366, the front side copy operation is carried out in the double side copy mode.

In a step S1368, the back side copy operation is carried out in the double side copy mode.

In a step S1370, the deck paper feed is carried out.

In a step S1372, the deck paper feed is carried out during the front side copy operation in the double side copy mode.

In a step S1374, the back side copy operation in the double side copy mode is carried out and the record paper is reversed when it is ejected from the paper ejection port of the main unit.

In EXTINT (external interrupt) shown in FIG. 6(2), a request is issued when the communication with the master Q101 is carried out The request is applied to the interrupt terminal of the Q103 and the processing program is executed.

The pedestal controller Q103 communicates in synchronism with the serial clock from the master Q101. In a step S1376, the external clock mode is selected. In a step S1378, the data to be sent from the pedestal controller Q103 to the master Q101 is set.

In a step S1380, the trigger gate is opened, and in a step S1382, the enable signal is sent to the master Q101 as soon as the pedestal controller Q103 becomes ready for the transmission.

In the event interruption shown in FIG. 6(3), the clock of the intermediate tray 59 is applied to the interrupt terminal of the event timer in the pedesta1 controller Q103.

In a step S1384, the tray counter is decremented by one for each input of the clock. In a step S1386, the event counter is set to "1". Thus, the interruption occurs every other time and the count is started. That is, the interruption is requested for each clock pulse sent from the encoder attached to the motor shaft of the intermediate tray.

In FIG. 6(4), the serial data is checked.

In a step S1388, whether the serial communication from the master Q101 to the pedestal controller Q103 is completed or not is checked. If it is completed, the enable signal to the master Q101 is reset in a step S1390.

In steps S1392–S1396, the data of four types of communication data (see FIG. 9(1)) sent from the master Q101 to the pedestal controller Q103 is determined. The data is set depending on the content (steps S1402–S1406 and S1398).

In a step S1400, the sequence timing clock is incremented by one. In the step S1400, the clock to be used is counted up to control the timing of the serial communication by the drum clock timing.

FIG. 6(5) shows the deck lift up/down routine.

In a step S1408, the open/close state of the deck door is checked. If the deck door is open, the deck lift up/-down request is set in a step S1420 to supplement the record papers Thus, the data to lift down the deck lifter 54L is set to the master Q101.

The deck lifter is moved down in response to the signal from the master Q101 (steps S1422 and S1424), and whether the lifter 54L has been moved down to the lowermost position or not is checked in a step S1426. When the lifter 54L is moved down to the lowermost position, the motor of the lifter 54L is stopped in a step S1428.

If the deck door is closed (step S1408), the deck lift up/down request is set in a step S1410. The deck is moved up at the timing which allows the lift-up of the deck (steps S1412 and S1414).

In a step S1416, whether the lift-up of the lifter 54L is completed or not is checked. In a step S1418, the lift-up of the lifter 54L is stopped.

FIG. 6(6) shows the stand-by loop. It shows the branch to the status which is carried out after the copy start button is depressed.

FIG. 6(7) show the sequence in the front side copy operation in the double side copy mode.

In a step S1450, the control plate 59 (see FIG. 1(1)) of the intermediate tray 59 is moved in accordance with the paper size.

In a step S1452, whether the movement is completed or not is checked. If it is completed, the intermediate tray ready signal is set in a step S1454. Thus, the intermediate tray ready signal for the serial data to be sent from the pedestal controller Q103 to the master Q101 is set, as shown in FIG. 9(2). Then, the main unit start the copy operation and the end of the front side copy operation is checked in a step S1456.

As the record paper is sent from the main unit to the intermediate tray 59, the control is shifted to the status STSO in a step S1458 and the program returns to the stand-by loop.

FIG. 6(8) shows the sequence of the back side copy operation in the double side copy mode. The record paper is fed from the intermediate tray 59.

In a step S1466, the send-out of the paper feed request (see FIG. 9(1)) from the master Q101 is waited.

In response to the paper feed request, the paper feed operation is started (step S1468). When the preset number of papers have been fed (step S1470), the program again returns to the stand-by loop (step S1472).

FIG. 6(9) shows the switch-back processing. Since the switch-back processing has been described in connection with FIG. 1(3), it is not explained here. After the switch-back, the program again returns to the stand-by loop (step S1464).

FIG. 6(10) shows the deck paper feed loop.

The issue of the paper feed request from the master Q101 is detected (step S1474, see FIG. 9(1)) and the paper feed is started (step S1476). When the preset number of papers have been fed (step S1478), the control is again returned to the stand-by loop (step S1480).

FIG. 6(11) shows the sequence to feed the paper from the deck 54 (see FIG. 1(1)) and carry out the front side copy operation in the double side copy mode.

In a step S1480, the control plate 56 of the intermediate tray 59 is moved, and the completion of the movement is checked in a step S1482.

In a step S1484, the intermediate tray ready signal (see FIG. 9(2)) is sent to the master Q101 (step S1484). Then, the paper feed from the deck 54 is started in response to the paper feed request from the master Q101 (step S1488).

As the front side copy operation completes (step S1490), the control is again returned to the stand-by loop (step S1492).

The processings to be carried out by the pedestal controller Q103 have thus been described.

FIGS. 7(1) and 7(2) show the serial data sent from the master Q101 to the slave Q102. The high order 4 bits of the 8-bit serial data are the status information and the low order 4 bits are the data information so that sixteen communication data are transmitted. For example, the bit $b_0$ of the status 0 (condition status) represents the power on/off, the bit $b_1$ represent end of wait/waiting, the bit $b_2$ represents master ready/not ready, and the bit $b_3$ represents master abnormal/normal.

The status 9, A, D and E are control data for the output ports of the slave Q102. By arranging the output ports closely to the load, the number and the length of the control lines can be reduced.

FIG. 8 shows the 8-bit serial data sent from the slave Q102 to the master Q101. The high order three bits are the status information and the low order five bits are the data information. For the data shown at the top of FIG. 8, the high order three bits represent the status 0, the bits $b_0$ and $b_1$ specify the paper feed cassette, bit $b_2$ represents the auto-shut-off (the power supply is automatically shut off when no operation is carried out for a predetermined time period), the bit $b_3$ represents the depression of the top key and the bit $b_4$ represents the depression of the interrupt key.

FIG. 9(1) shows the serial transmission data sent from the master Q101 to the pedestal controller Q104 and FIG. 9(2) shows the serial transmission data sent from the pedestal controller Q104 to the master Q101. Those serial data are transmitted in synchronism with the drum clock during the copy operation. The A/D converter Q104 counts the pulses at this timing in the double side copy mode or the deck paper feed mode to control the sequence.

FIG. 10 shows a timing chart for the serial transfer. During the copy operation, the serial transfer is started from the master Q101 to the pedestal controller Q103 in synchronism with the drum clock.

The timings of the counter, the internal timer and the drum clock are shown at the top of FIG. 10.

In the non-copy operation, the communication with the pedestal controller Q103 is carried out in synchronism with the pulse of the internal timer. Between the communications between the master Q101 and the slave Q102, the communication between the pedestal controller Q103 and the AD converter Q104 is carried out. The communication intervals are 4.992 msec. and 19.968 msec. as shown in FIG. 10.

In the copy operation, the pedestal controller Q103 communicates in synchronism with the drum clock (see botton of FIG. 10).

FIG. 11 shows communication lines between the master Q101 and the slave Q102, the pedestal controller Q103 and the AD converter Q104. The Q101–Q104 each has the 8-bit shift register which is operated in synchronism with the serial clock SCK from the master Q101. The data outputted from the terminal SO of the master Q101 is applied to the terminal SI, and the data from the terminal SO is applied to the terminal SI of the master Q101 one bit at a time. In this manner, the data are parallelly exchanged.

FIG. 12 shows the timings of the serial clock SCK, the serial-out SO and the serial-in SI. The data is outputted at the rise of the serial clock SCK, and the data is inputted at the fall.

FIGS. 13(1)–13(4) show the timings of the sequences in the present embodiment.

FIG. 13(1) shows the control timing from the power-on to the stand-by. When the power supply is turned on and the temperature of the fixer heater reaches 150° C., the main motor is rotated at the low speed. Then, as the fixer heater reaches 170° C., the main motor is rotated at the high speed (main motor high) and the rated potential control is effected.

FIG. 13(2) shows the sequence timing for the size A4 copy (one size A4 copy, AE within one minute), FIG. 13(3) shows the sequence timing for the single reduced copy (AE) after the size A4 unity magnification copying, and FIG. 13(4) shows the sequence timing for the double side single copying (manual exposure) in the deck paper feed mode. The controls in those operation modes are apparent from the drawings and hence the explanation thereof is omitted.

What is claimed is:

1. An image forming apparatus comprising:

image forming means operable in a first mode for forming an image on one side of a record medium and a second mode for forming the images on both sides of the record medium;

command means for commanding an interrupting image formation in said second mode during the image formation in said second mode;

storage means capable of storing in a plurality of modes the record medium transported from said image forming means, which record medium has been subjected to the image formation; and control means for controlling said storage means to store in a predetermined mode of said plurality of modes the record medium transported from said image forming means during the interrupting image formation, which record medium has been subjected to the image formation.

2. An image forming apparatus according to claim 1, wherein said accommodation means includes a plurality of trays and is operable in a sort mode for distributing and storing the record media into said plurality of trays and a non-sort mode for storing the record media in a specified tray, said predetermined mode being said non-sort mode.

3. An image forming apparatus comprising:

image forming means operable in a first mode for forming an image on one side of a record media and a second mode for forming images on both sides of the record medium;

said image forming means having intermediate accommodation means for temporarily storing the record media each having image formed on one side thereof in said second mode;

command means for commanding an interrupting image formation in said second mode during the image formation is said second mode; and control means for controlling said image forming means in the interrupting image formation in said second mode in accordance with a sheet accommodating capacity of said intermediate accommodation means and the number of record media stored in said intermediate accommodation means before the interrupting image formation is started.

4. An image forming apparatus according to claim 3, wherein said control means controls said image forming means to allow said interrupting image formation commanded by said command means by a difference between the sheet accommodating capacity of said accommodation means and said number of record media already stored.

5. An image forming apparatus comprising:

image forming means operable in a first mode for forming an image on one side of a record medium and a second mode for forming images on both sides of the record medium, said image forming means having intermediate accommodation means for temporarily storing the record media each having image recorded on the side in said second mode;

command means for commanding the interrupting image formation in said second mode during the image formation in said second mode; and control means for controlling said image forming means in the interrupting image formation in said second mode in accordance with the recording medium size selected before said interrupting image formation and the record medium size selected in said interrupting image formation.

6. An image forming apparatus according to claim 5, wherein said image forming means is operable in said first mode or said second mode for the record media of different sizes, and said intermediate accommodation means changes the accommodation size in accordance with the size of the record media selected in said second mode.

7. An image forming apparatus according to claim 6, wherein said control means controls said image forming means to allow said interrupting image formation when the size of the record media selected before said interrupting image formation is equal to the size of the record media selected in said interrupting image formation.

8. An image forming apparatus comprising:

image forming means operable in a first mode for forming an image on one side of a record medium and a second mode for forming images on both sides of the record medium, said image forming means having intermediate accommodation means for temporarily storing the record media each having image recorded on one side in said second mode;

command means for commanding interrupting image formation in said second mode during the image formation in said second mode; and control means for storing data related to the image formation in said second mode during the image formation in said second mode; and control means for storing data related to the image formation to be suspended in accordance with an output of said command means, and for controlling said image forming means to be able to resume the suspended image formation operation based on the stored data after the completion of the interrupting of image formation.

9. An apparatus according to claim 8, wherein said data is data concerning the sheet number of record media.

10. An apparatus according to claim 8, wherein said data is data concerning image forming condition to be selected prior to initiation of the image formation.

* * * * *

UNITED STATES PATENT AND TRADEMARK OFFICE

CERTIFICATE OF CORRECTION

PATENT NO. : 4,641,954 Sheet 1 of 5

DATED : February 10, 1987

INVENTOR(S) : MASANORI MIYATA, ET AL.

Figures 1A, 3:
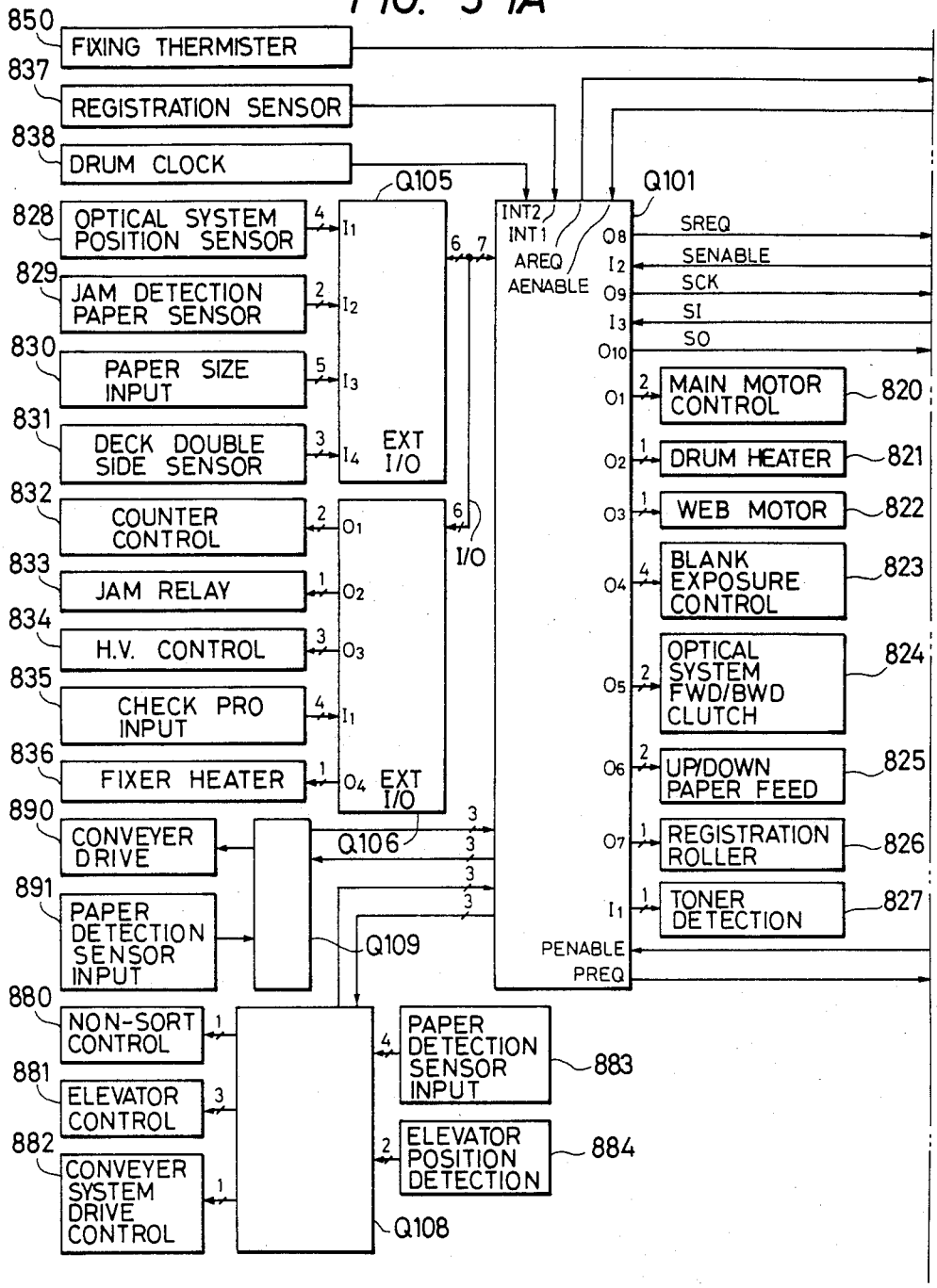
Figures 1B, 3:
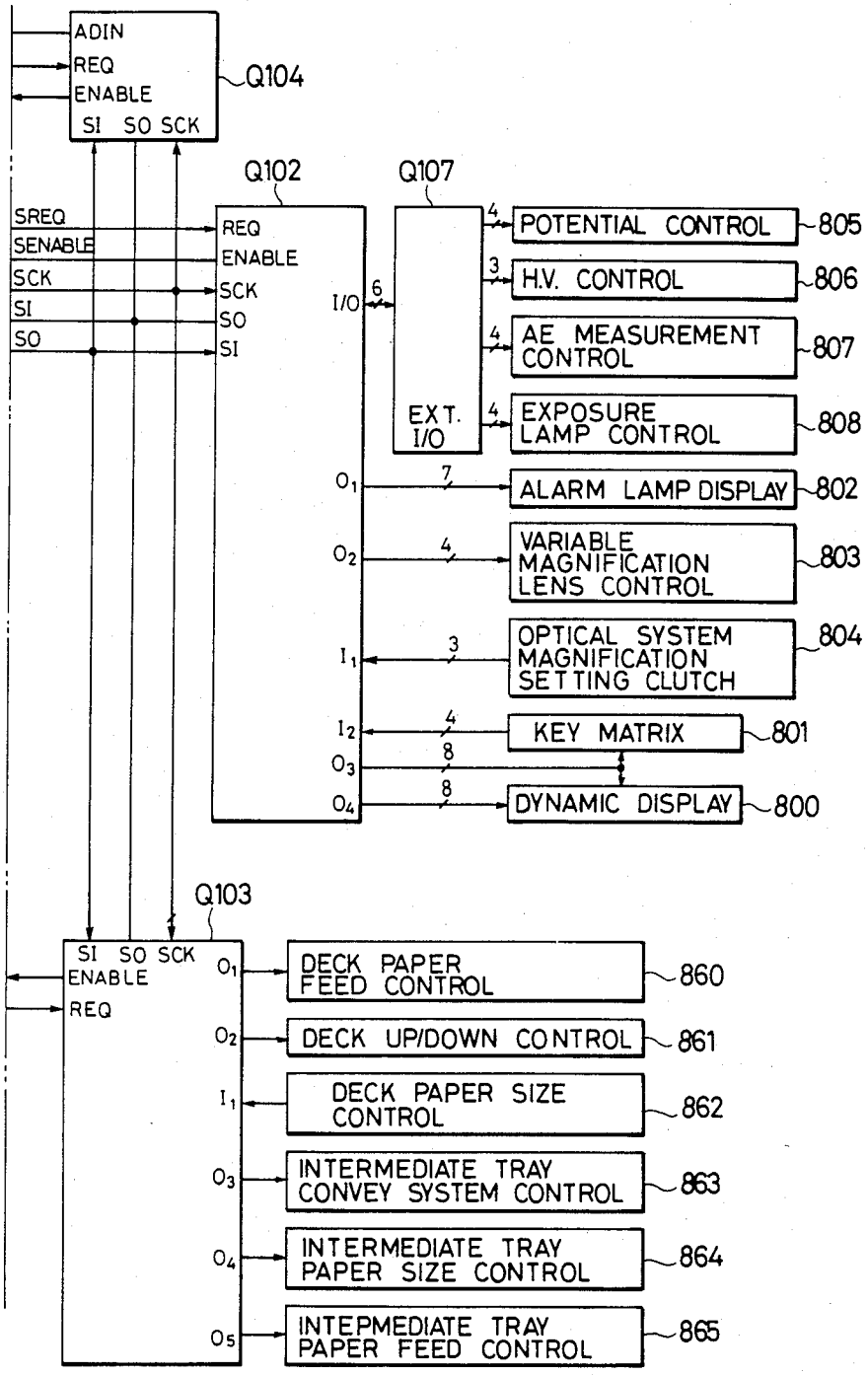
Figure 3:
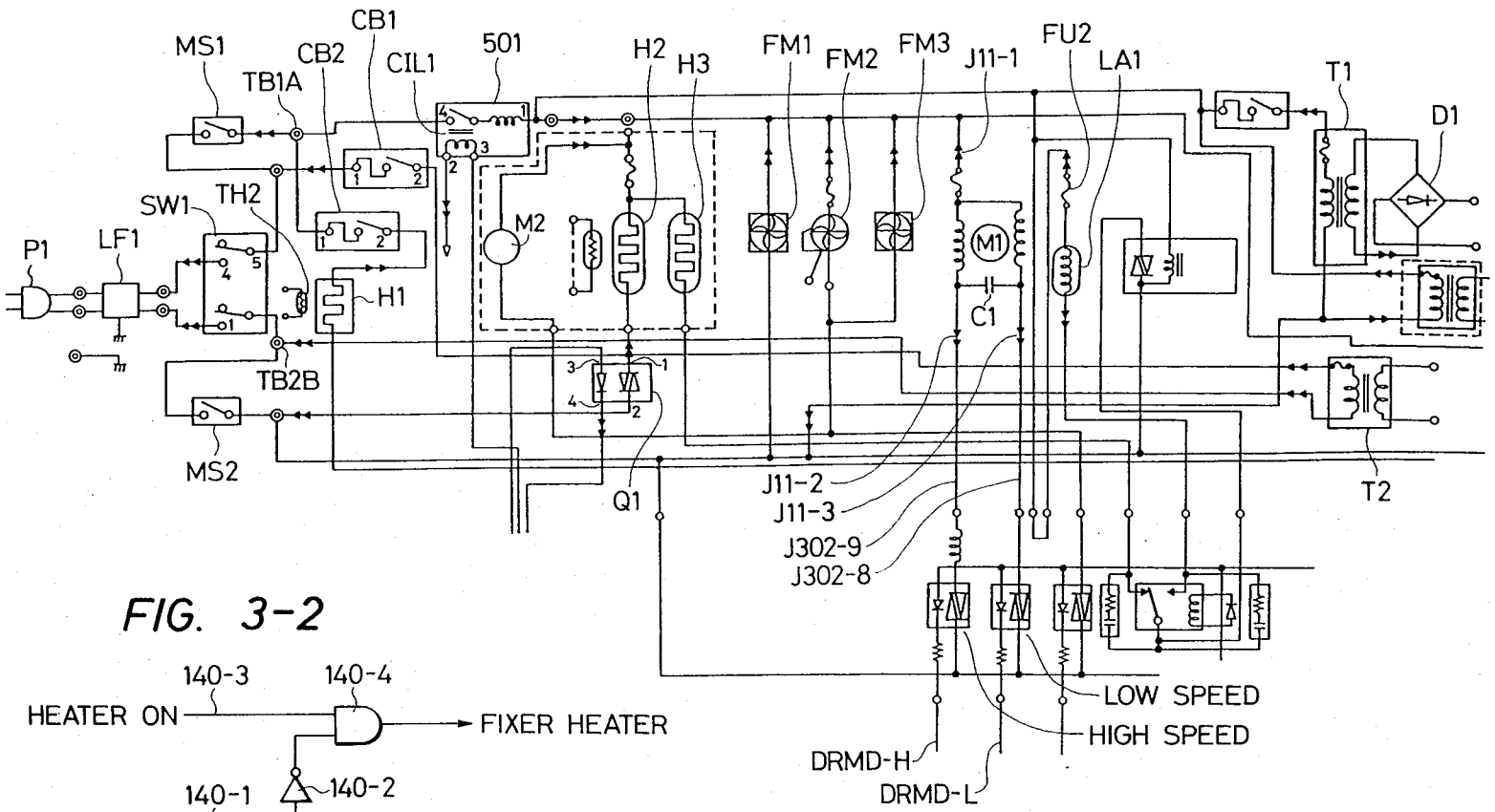
Figures 2, 3:
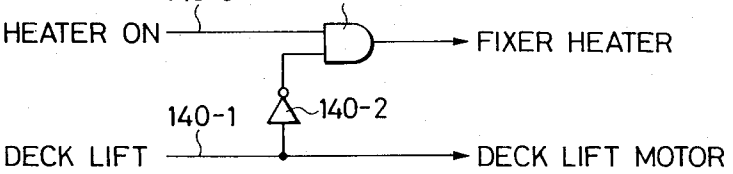
Figures 4, 64:
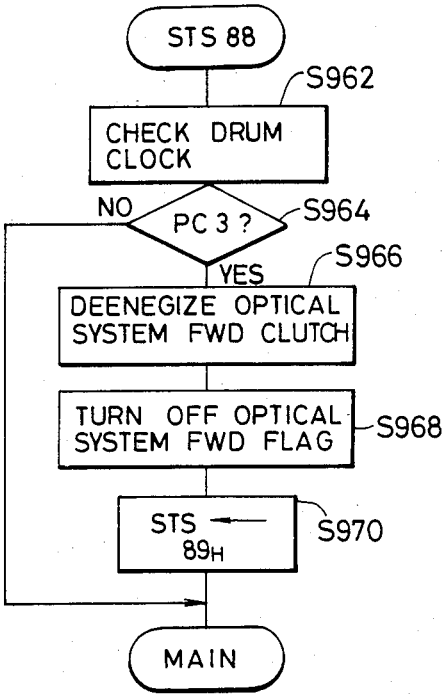
Figures 4, 59:
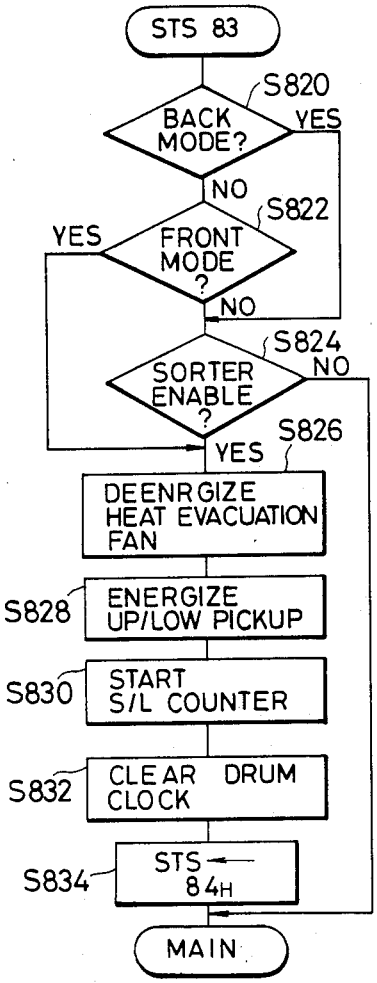
Figures 4, 60:
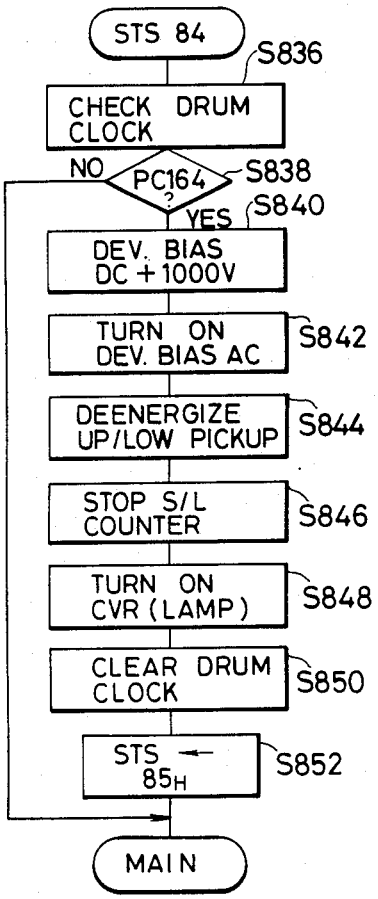
Figures 4, 61:
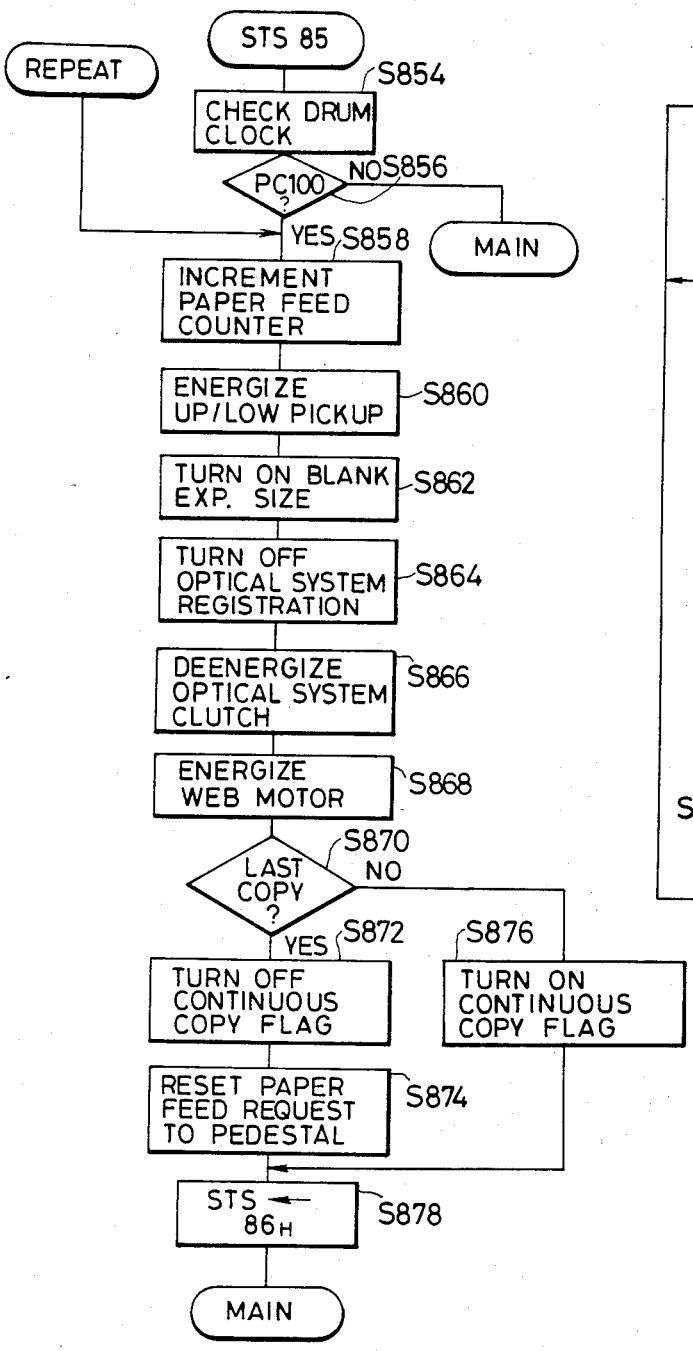
Figures 4, 62:
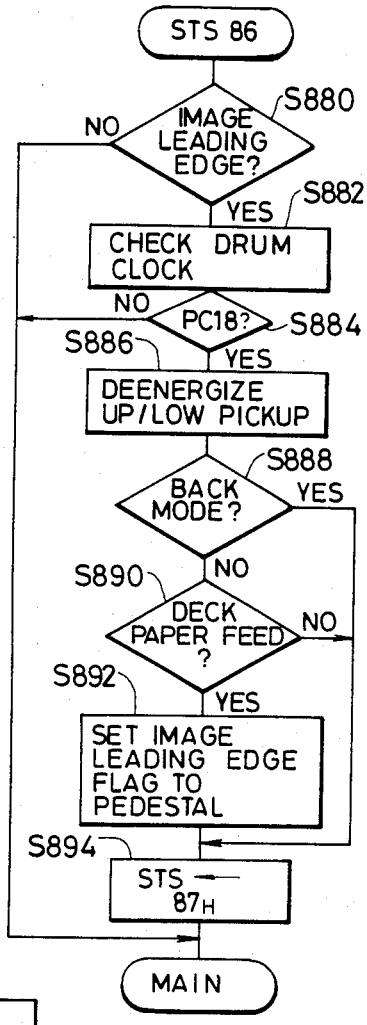
Figures 4, 63A:
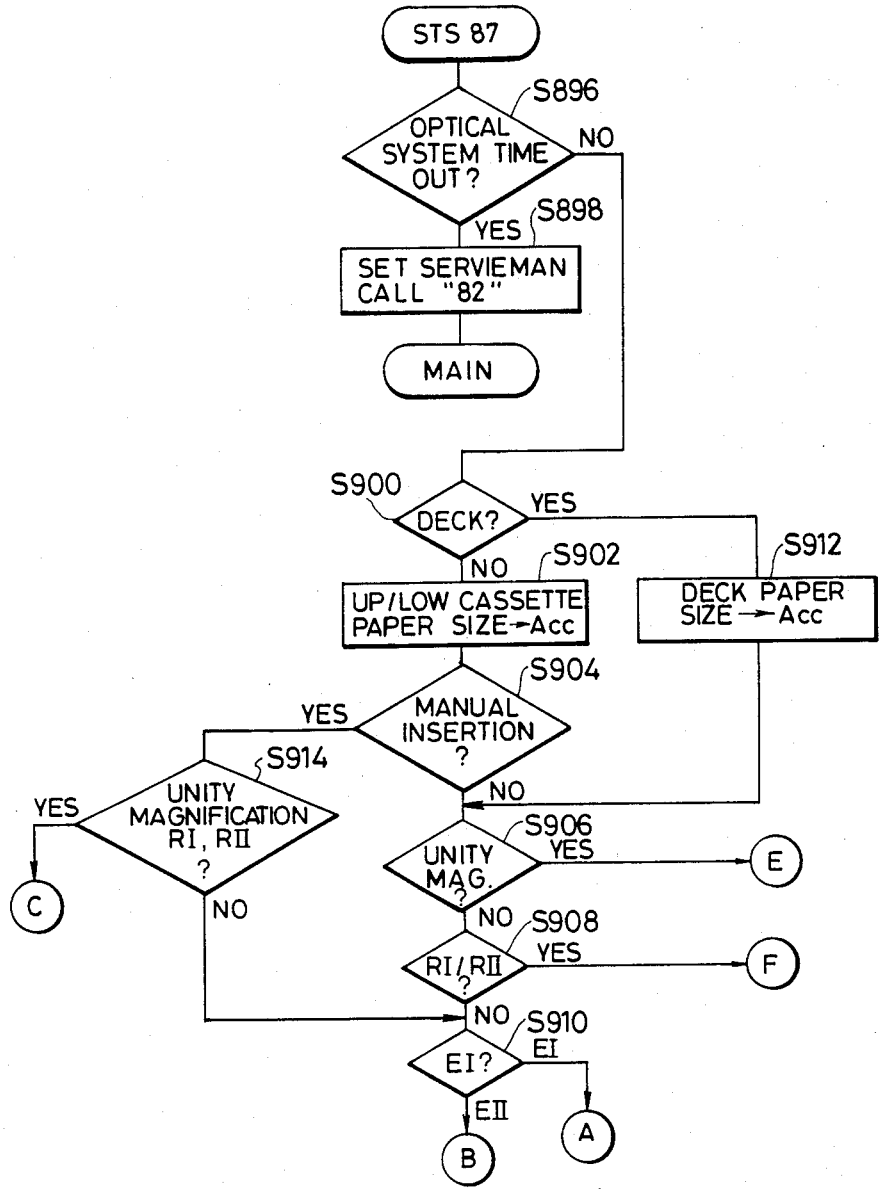
Figures 4, 63B:
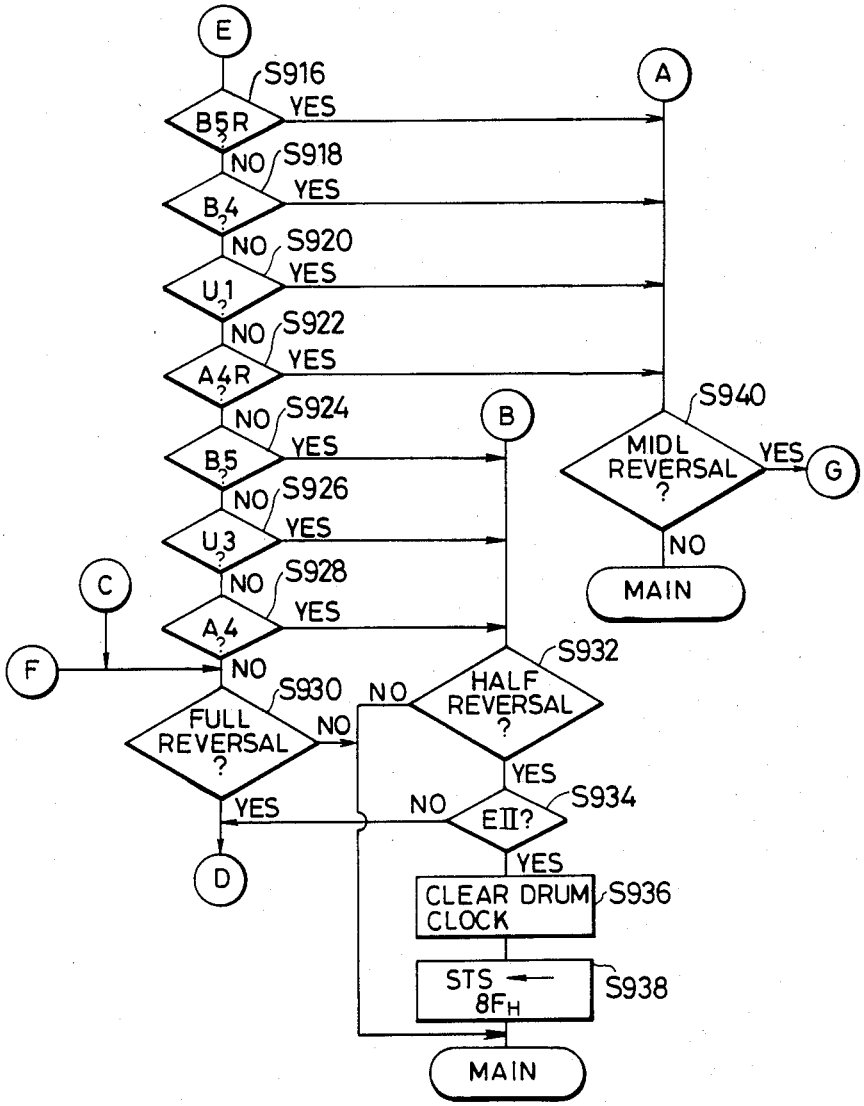
Figures 4, 63C:
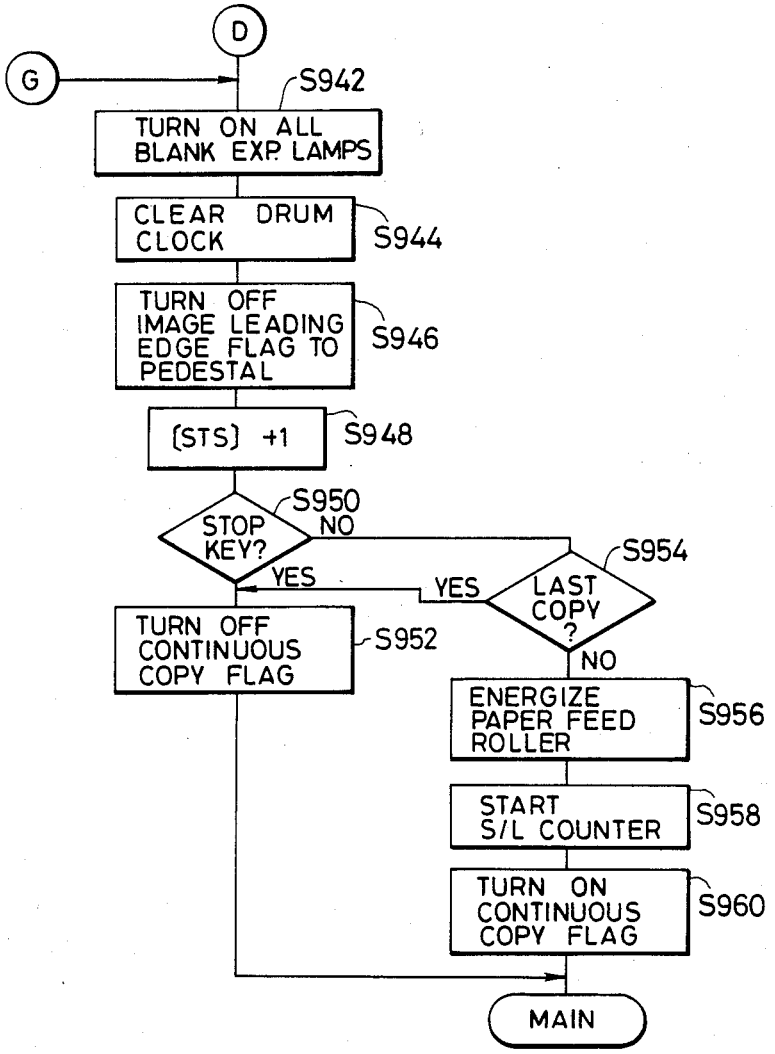
Figures 4, 68:
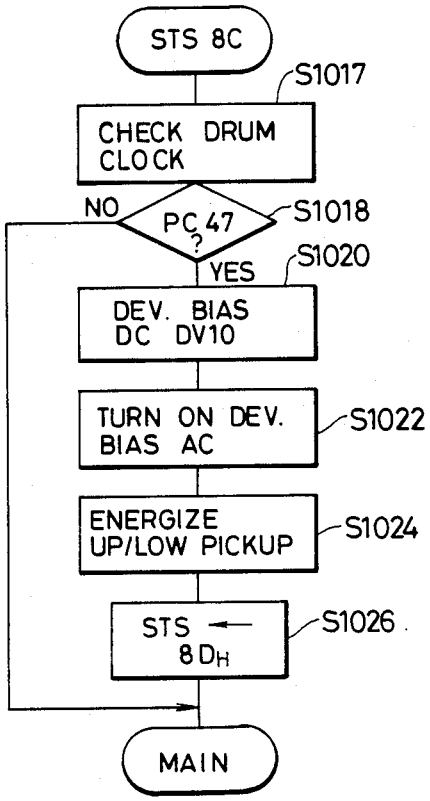
Figures 4, 69:
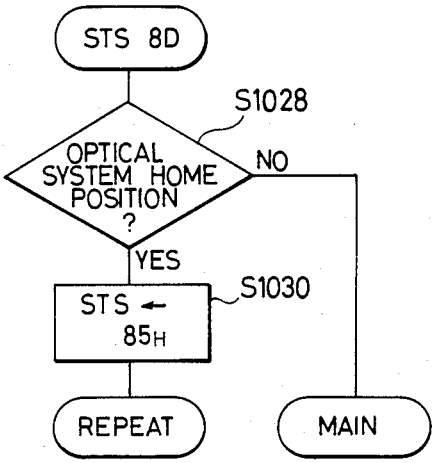
Figures 4, 70:
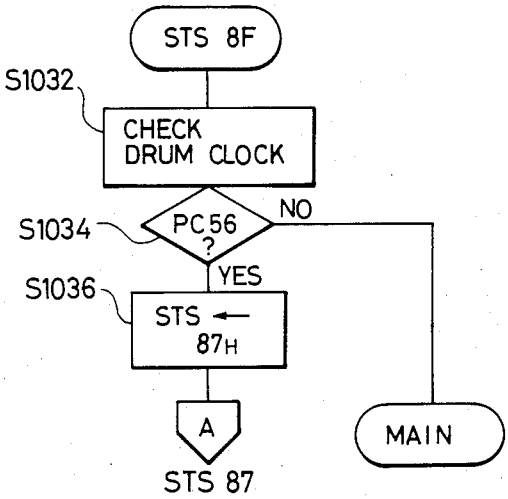
Figures 4, 71:
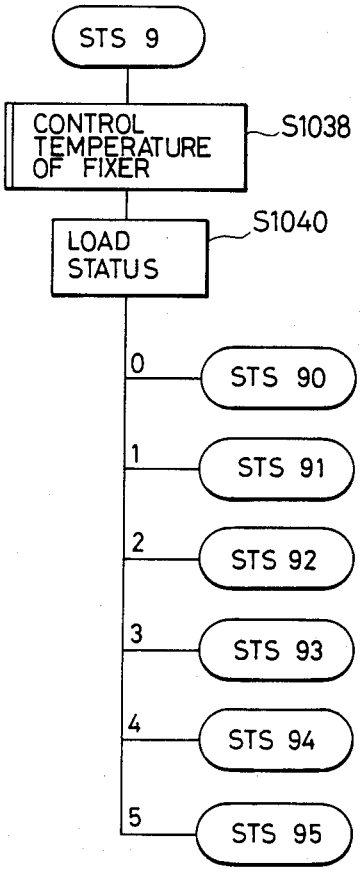
Figures 4, 72:
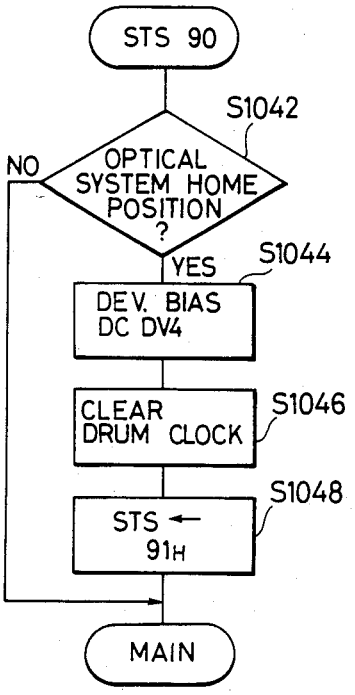
Figures 4, 73:
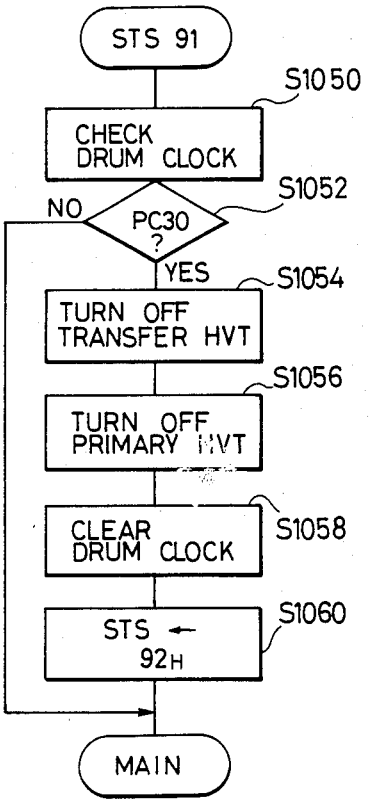
Figures 4, 74:
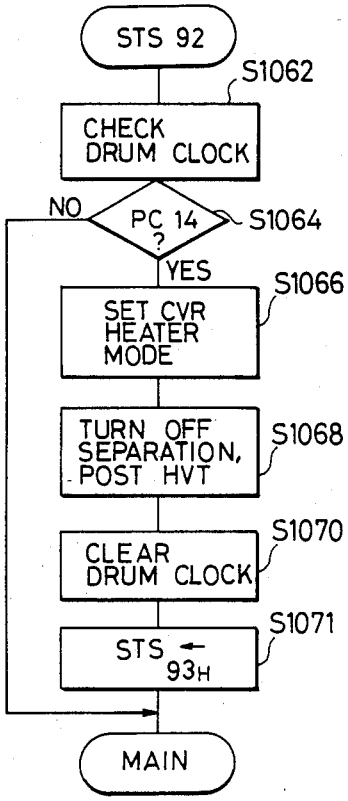
Figures 4, 75:
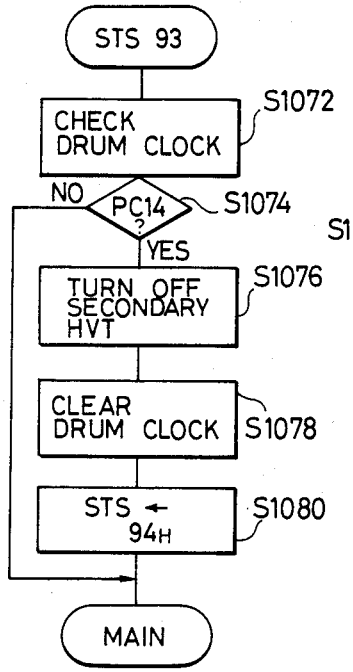
Figures 4, 77:
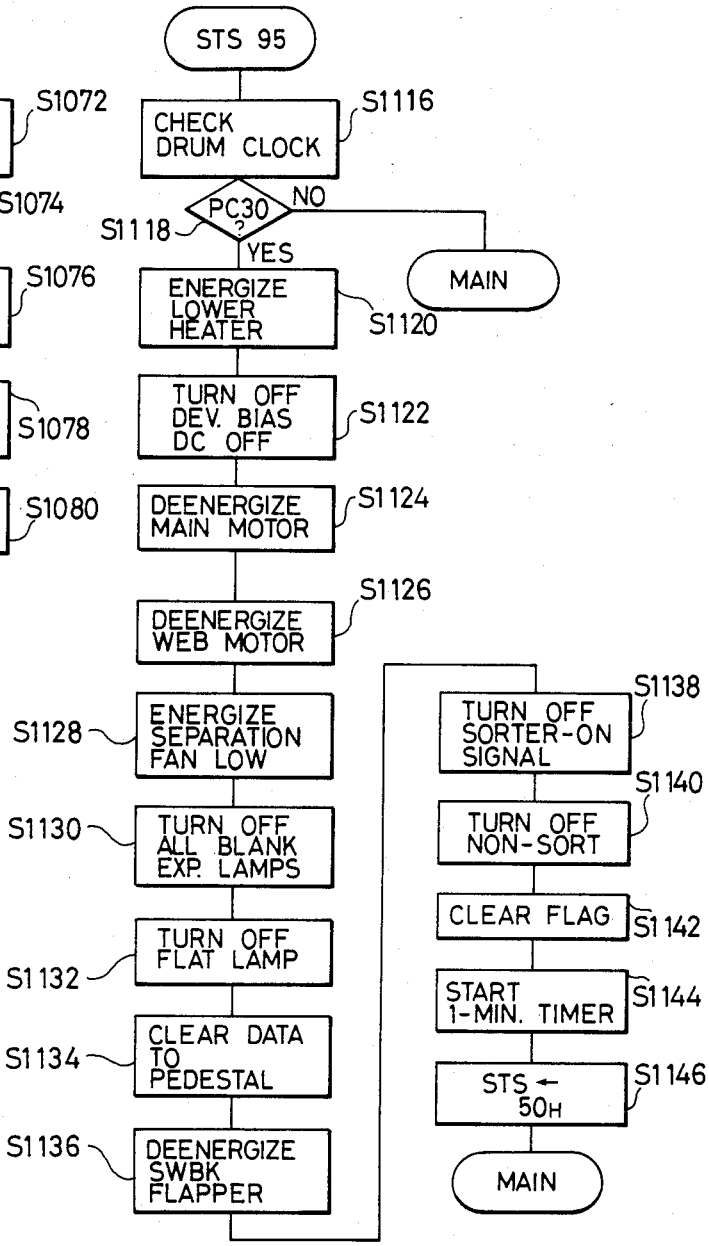
Figures 4, 76:
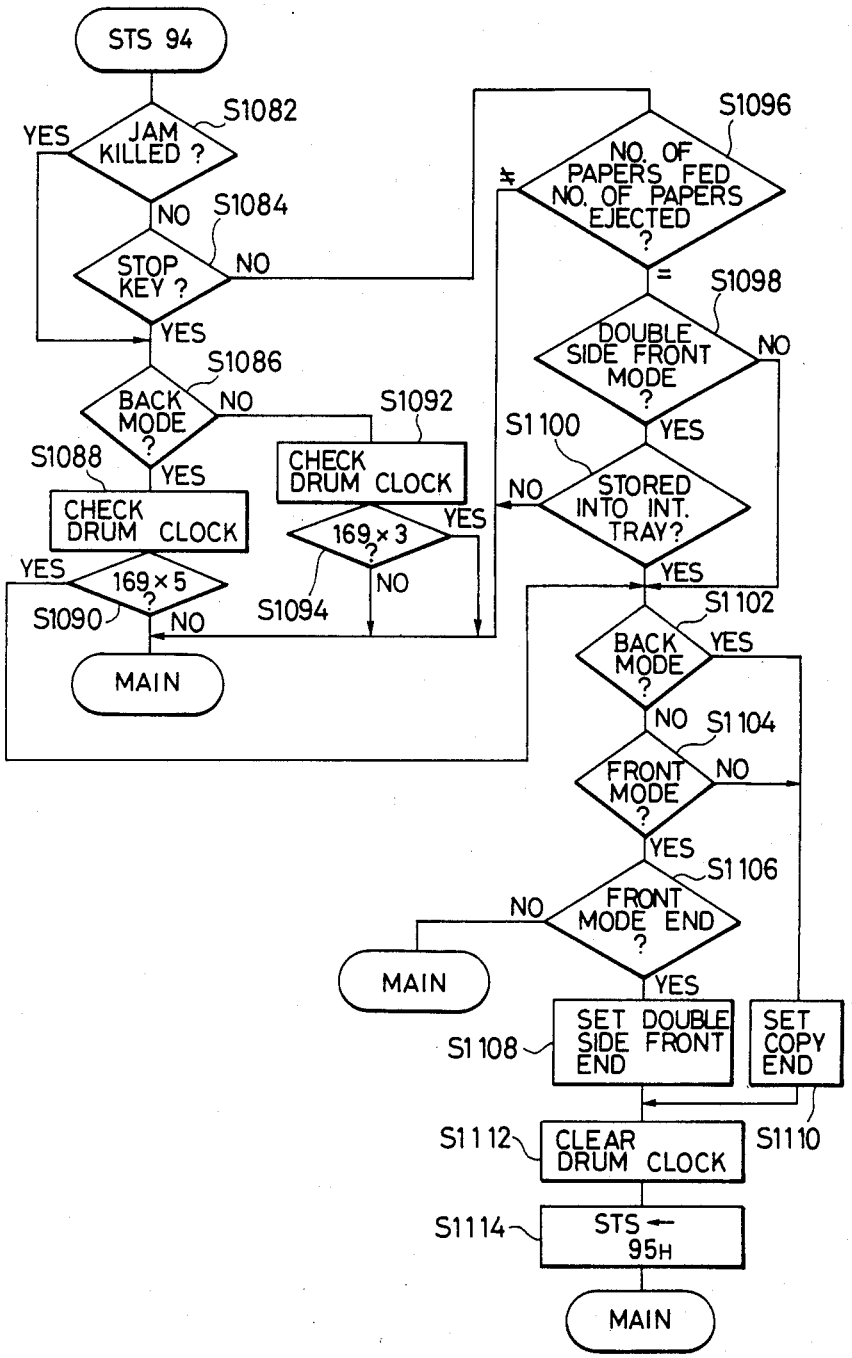
Figures 4, 78:
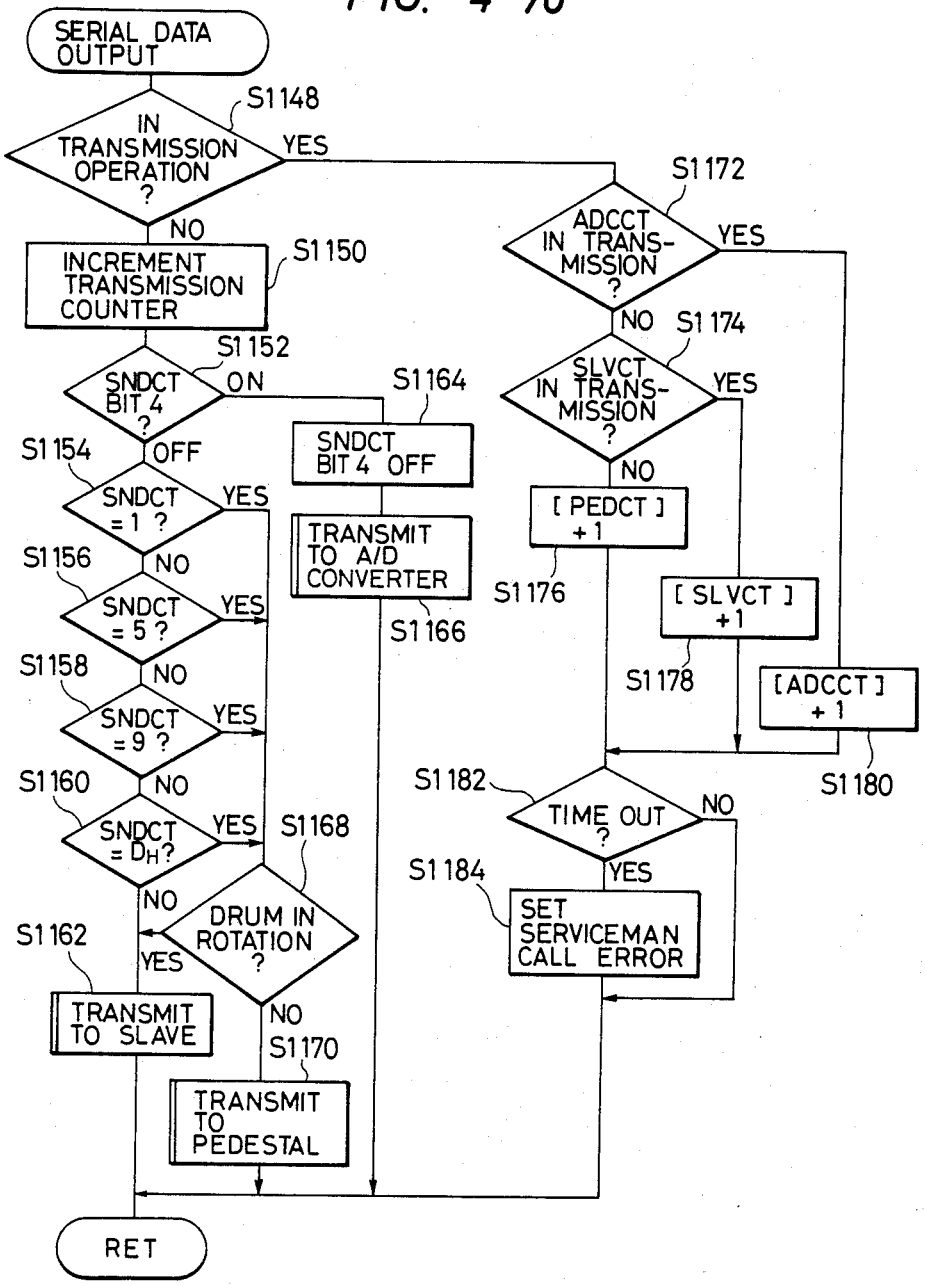
Figures 1, 5:
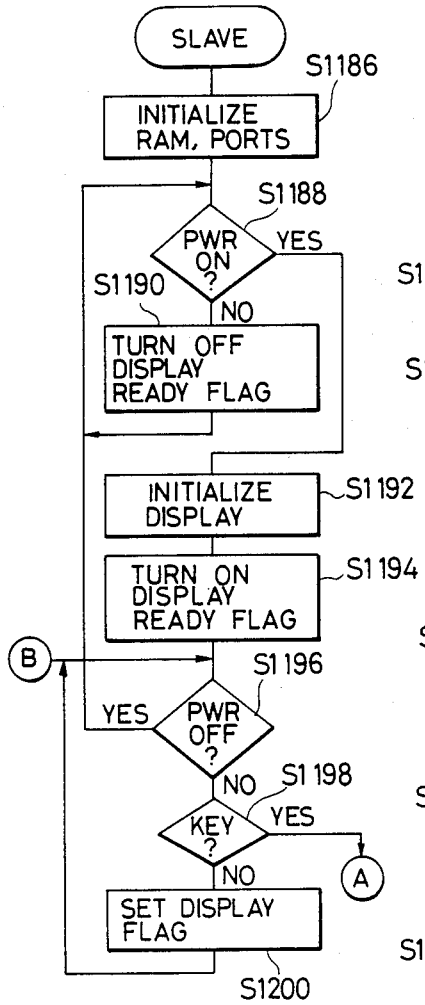
Figures 2, 5:
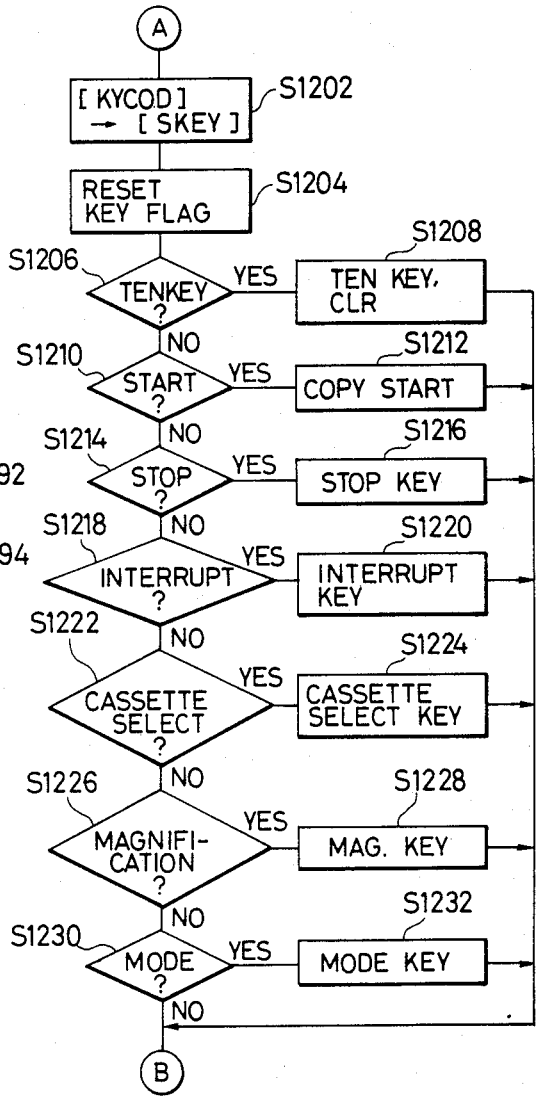
Figures 3, 5:
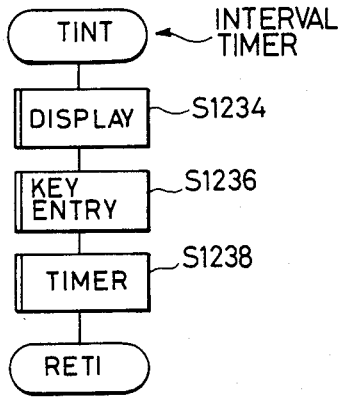
Figures 4, 5:
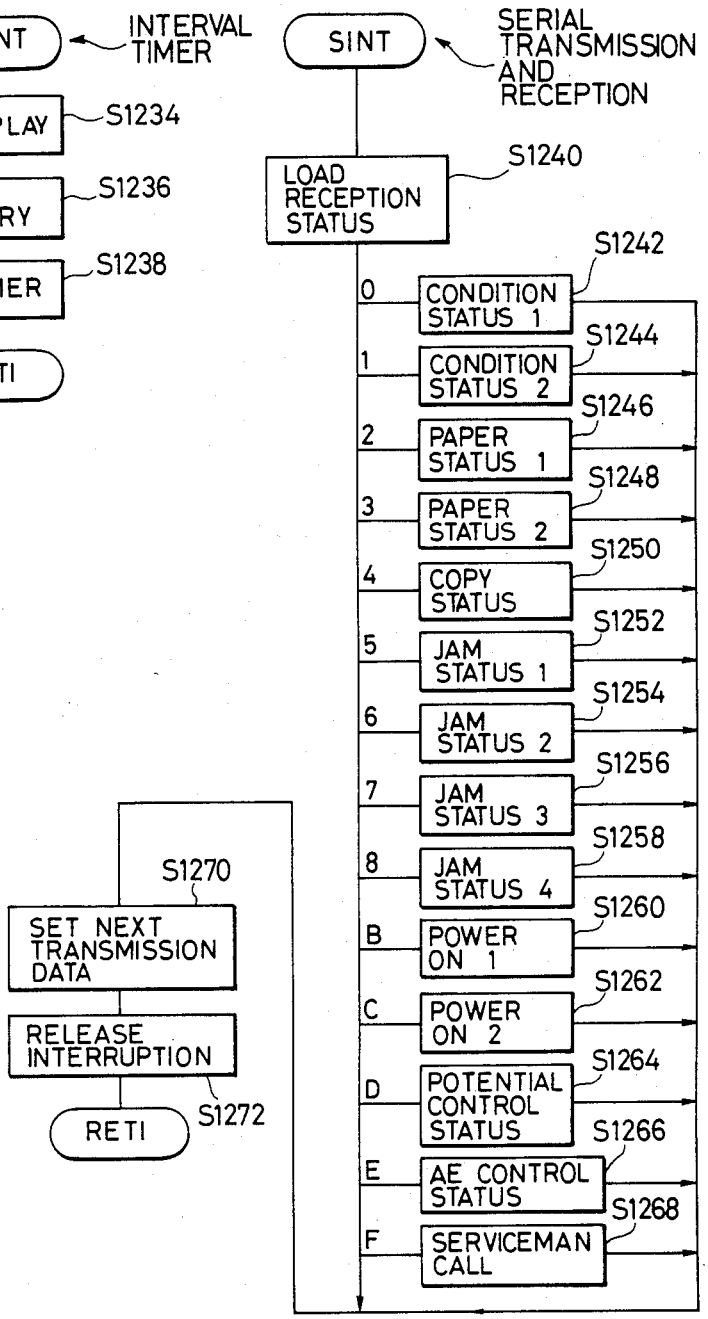
Figure 5:
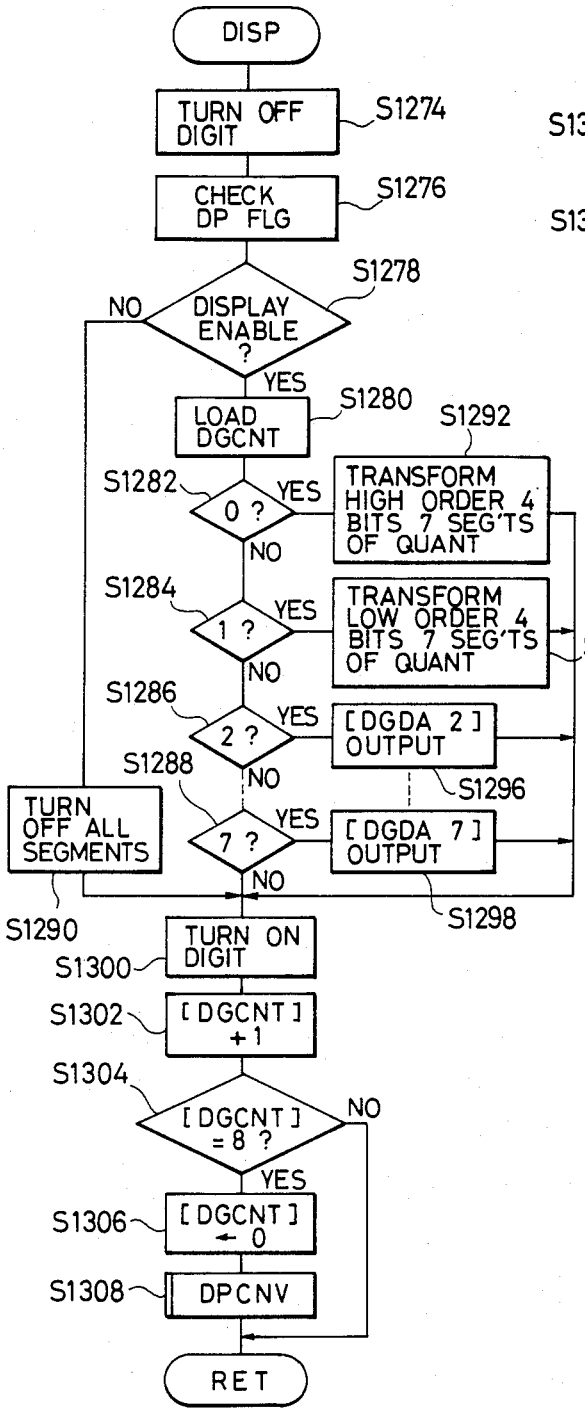
Figures 5, 6:
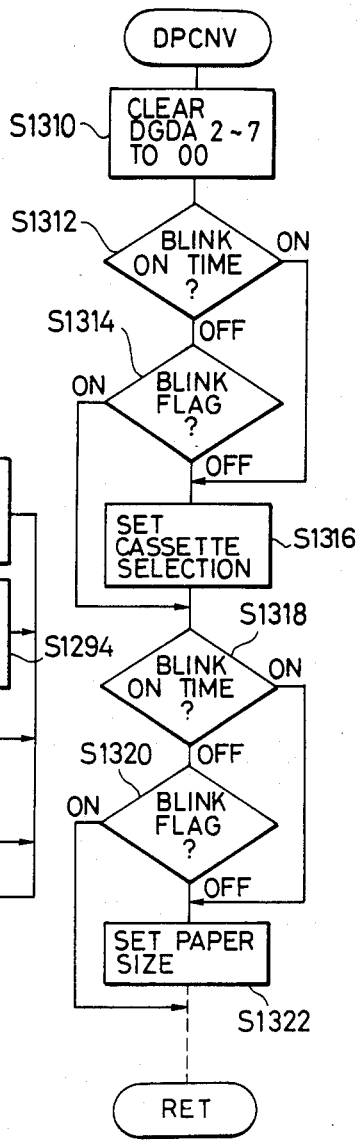
Figures 5, 6, 7:
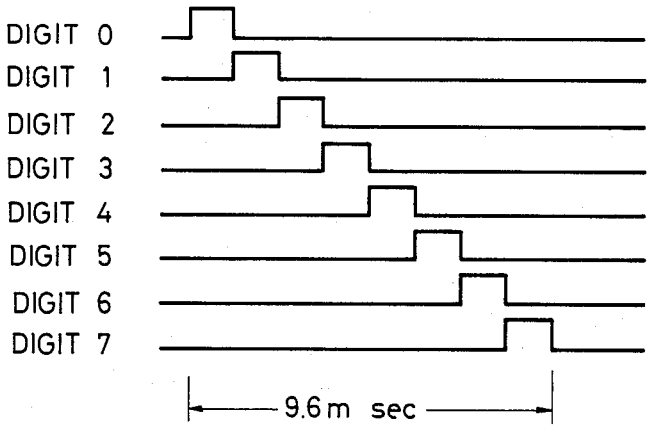
Figures 5, 6, 7, 8, 9, 10:
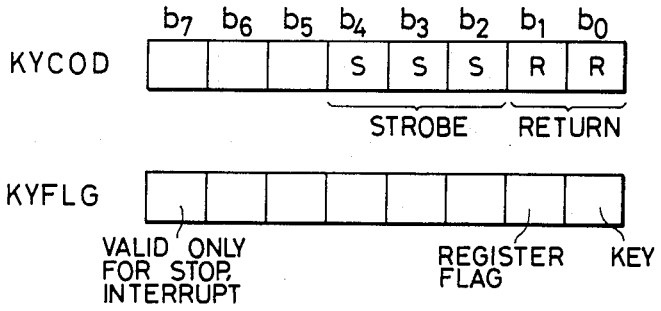
Figures 5, 6, 7, 8, 9, 10, 11:
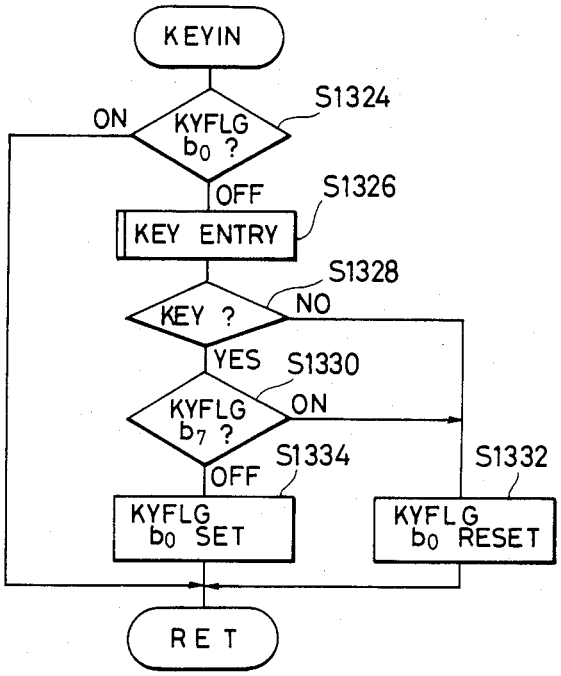
Figures 1, 6:
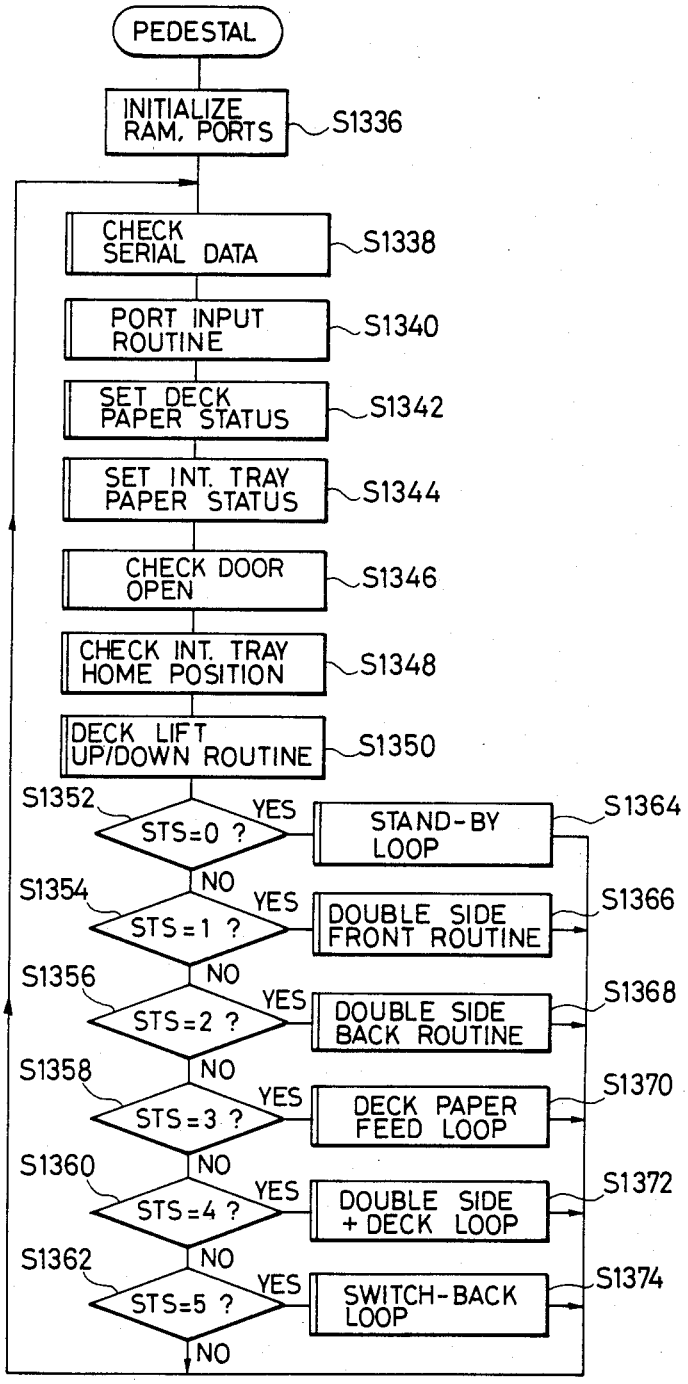
Figures 2, 6:
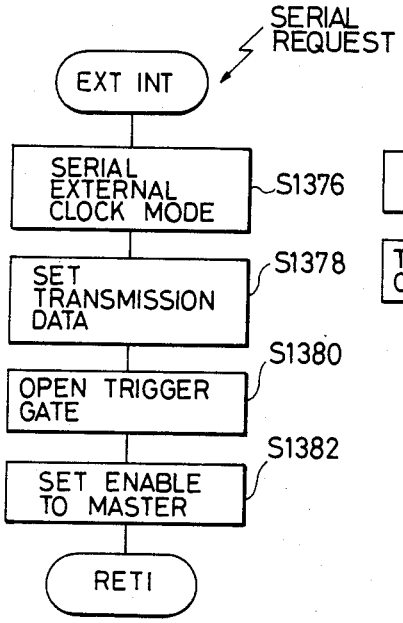
Figures 3, 6:
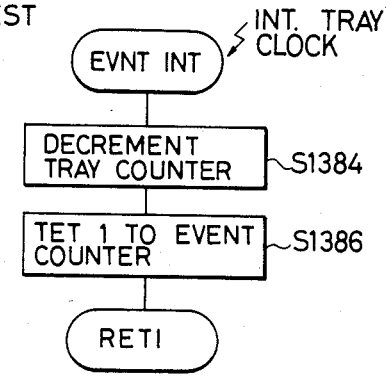
Figures 4, 6:
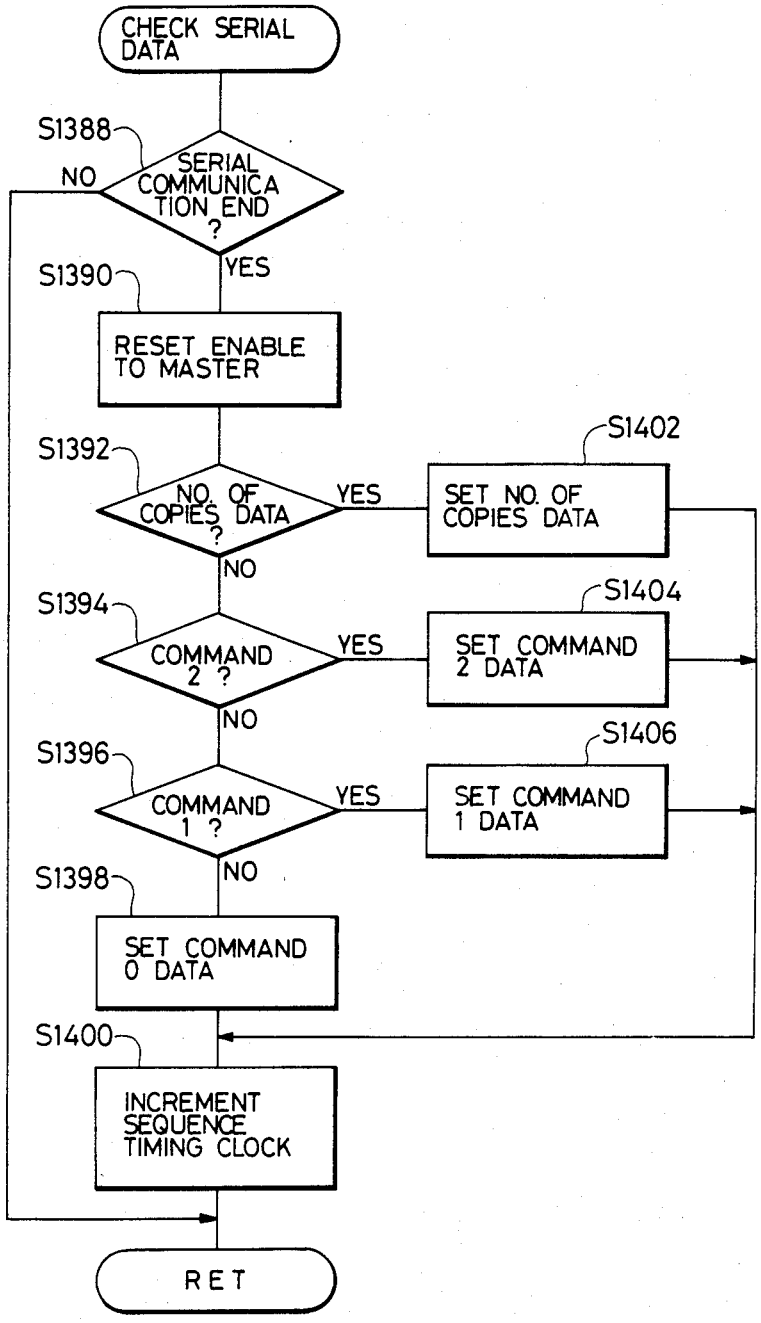
Figures 5, 6:
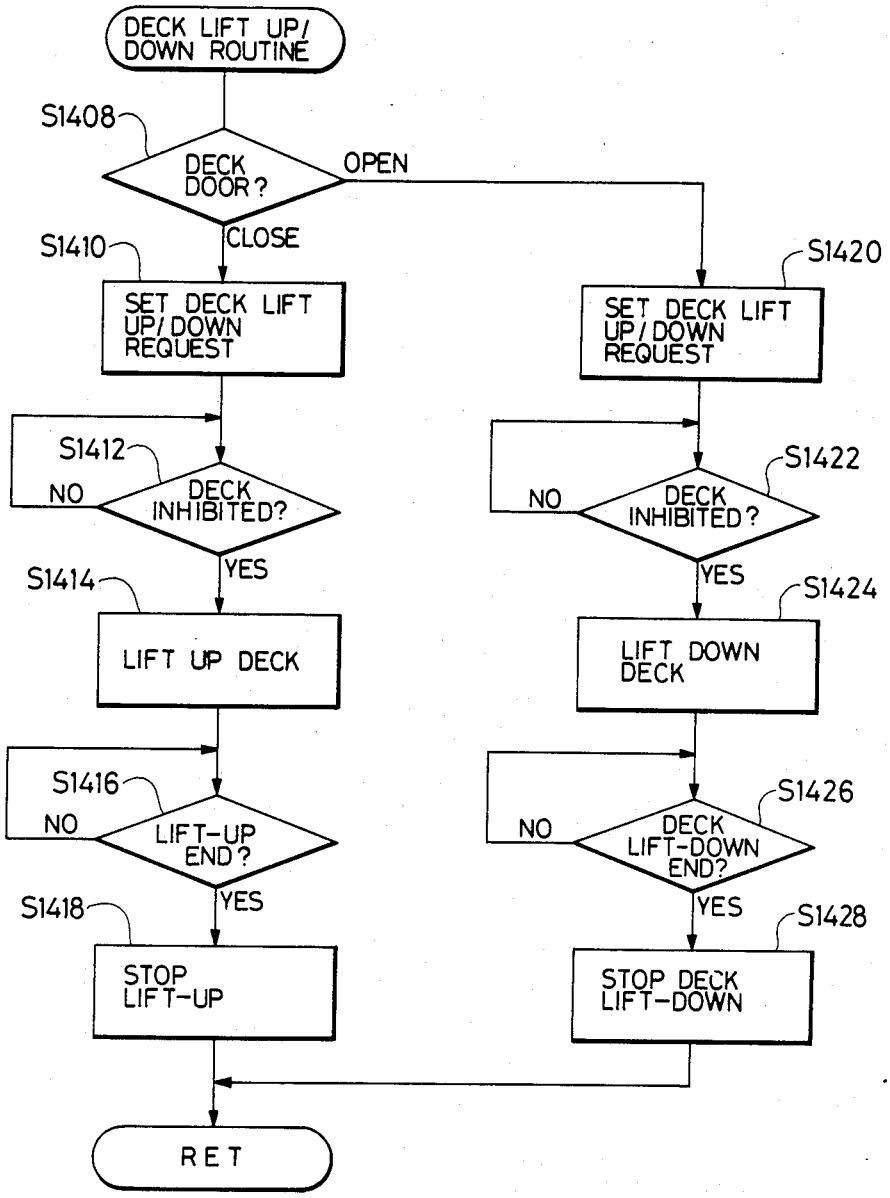
Figure 6:
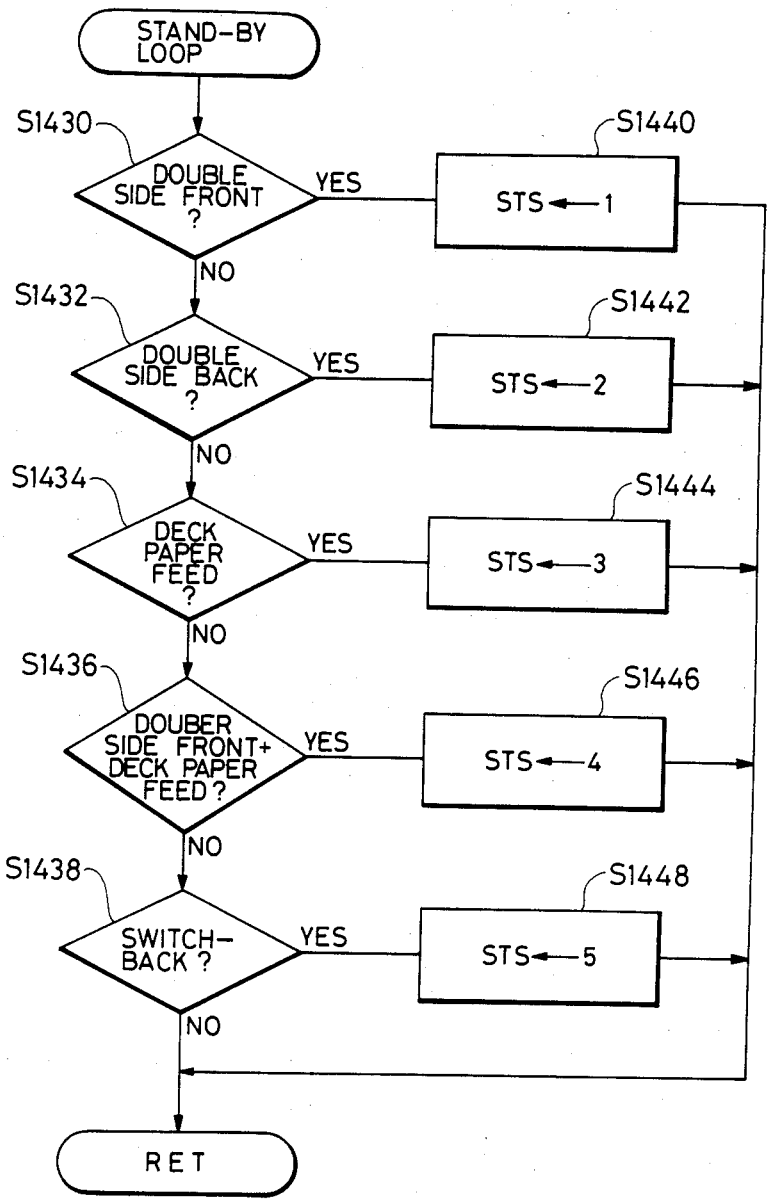
Figures 6, 7:
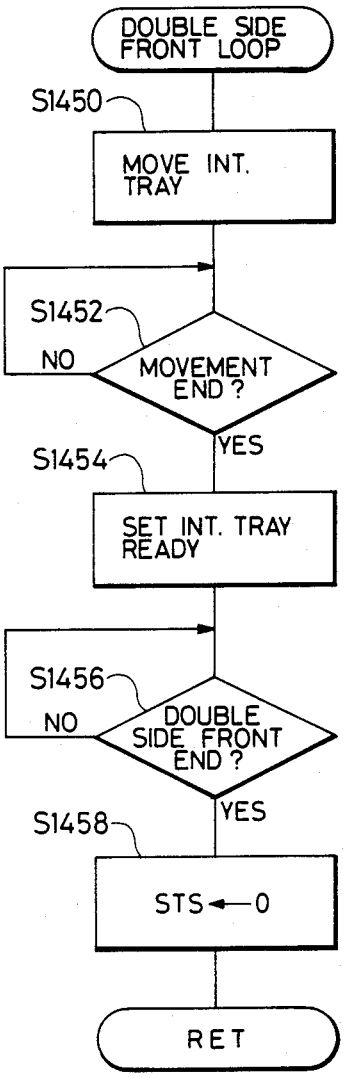
Figures 6, 7, 8:
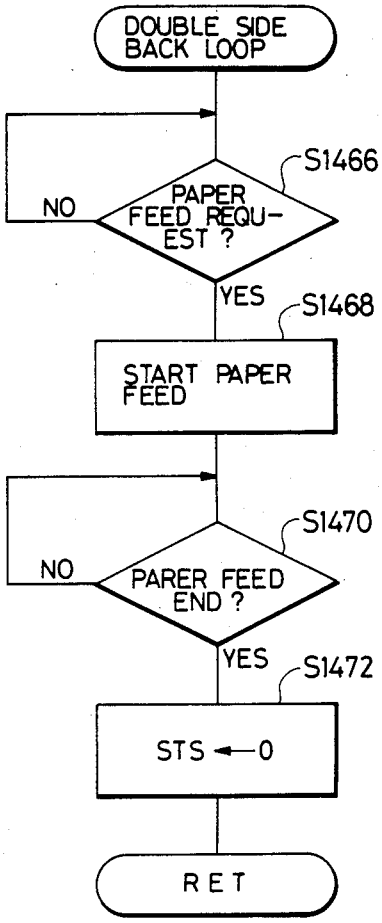
Figures 6, 7, 8, 9:
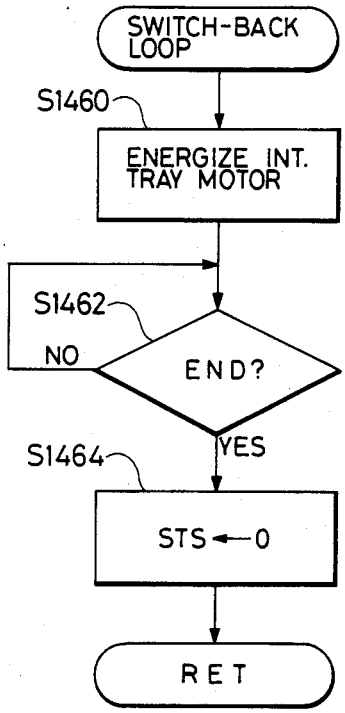
Figures 6, 7, 8, 9, 10:
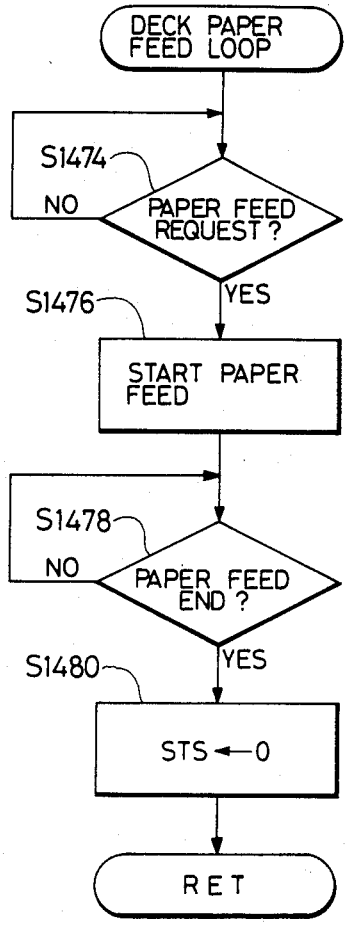
Figures 6, 7, 8, 9, 10, 11:
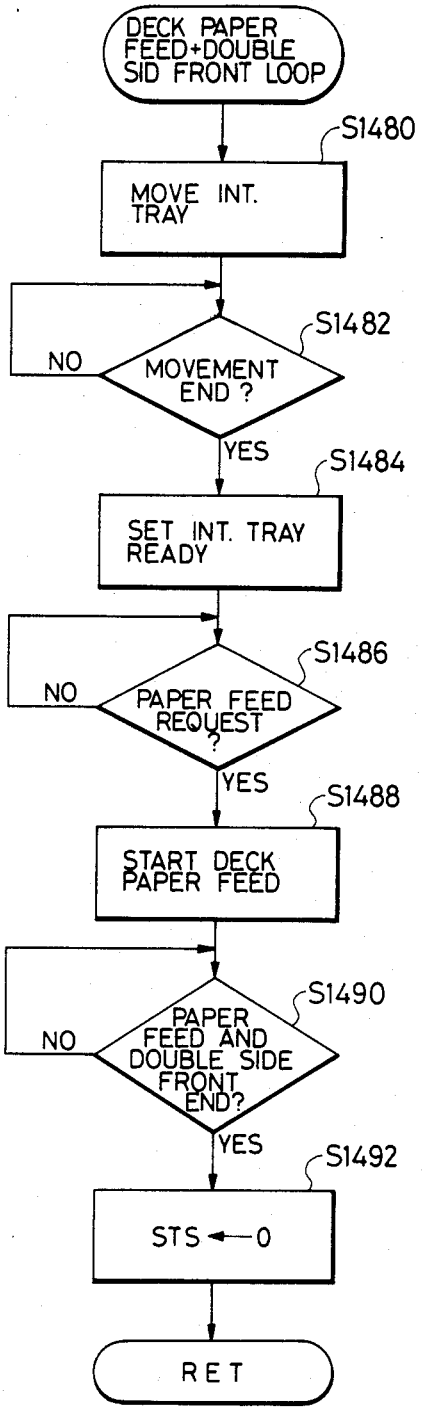
Figure 10:
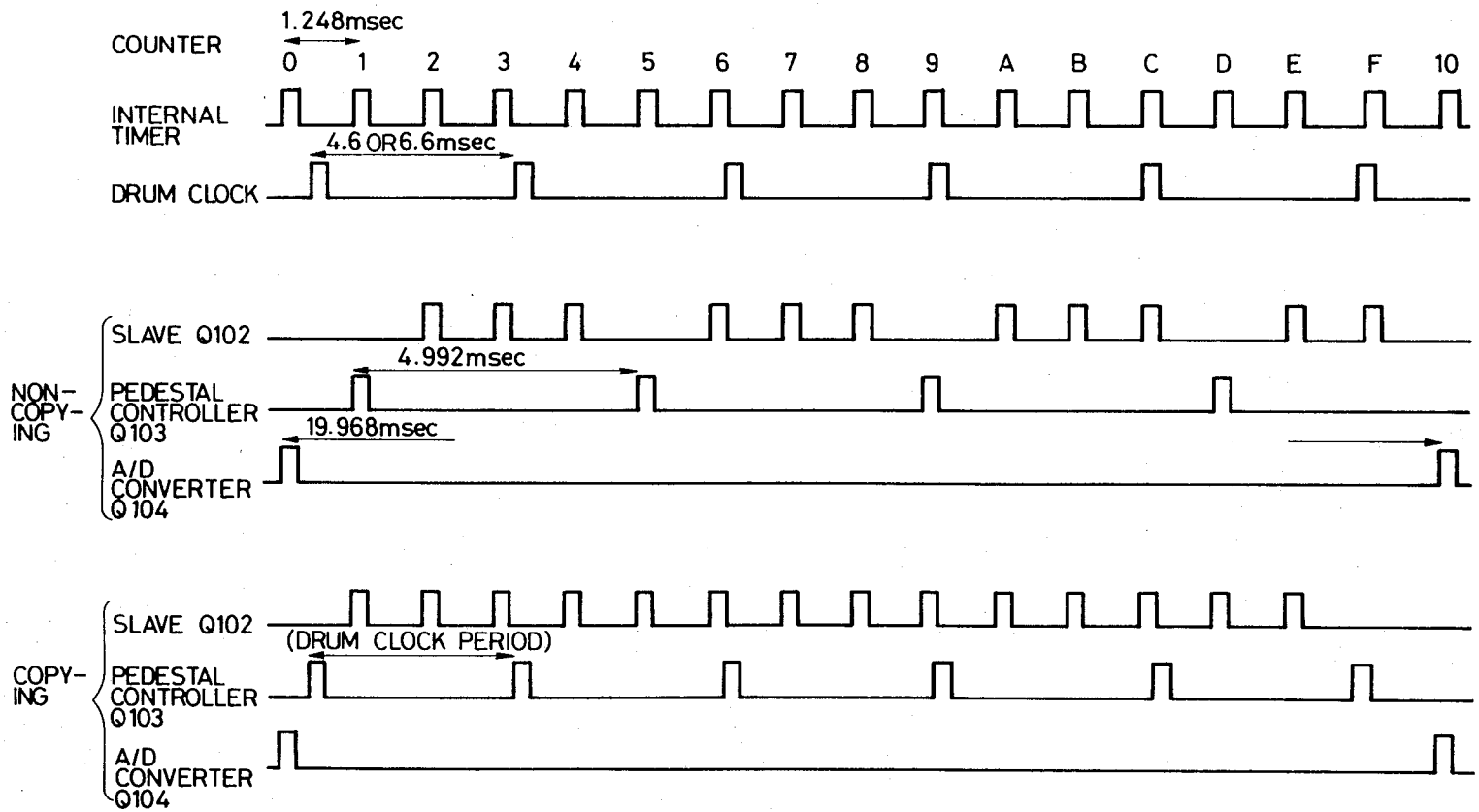
Figure 11:
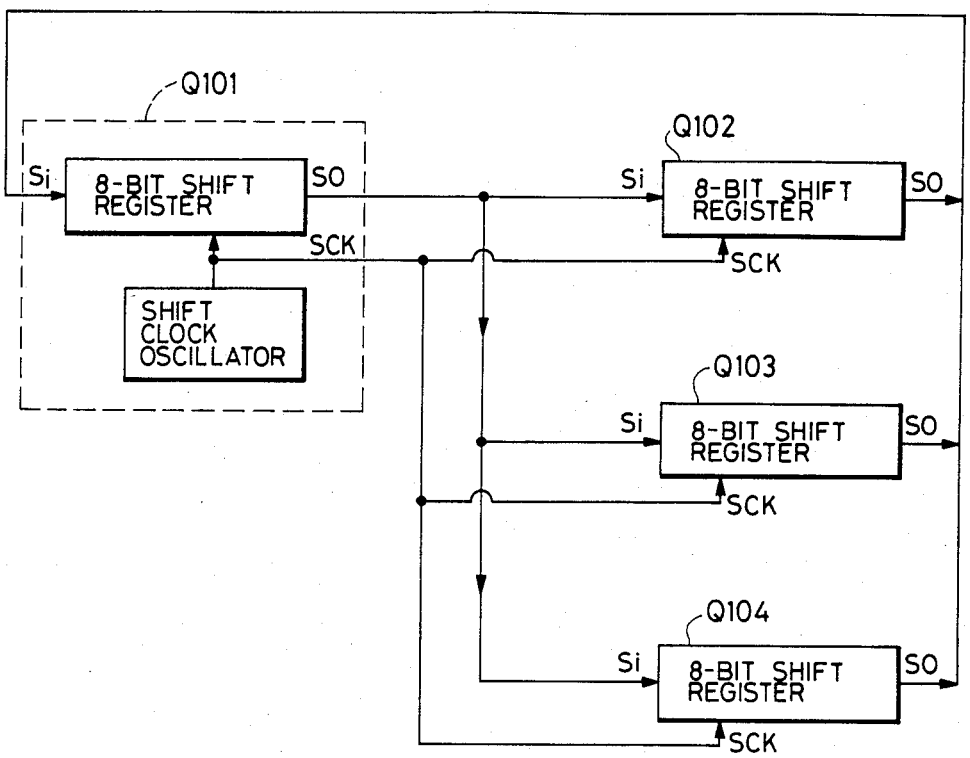
Figure 12:
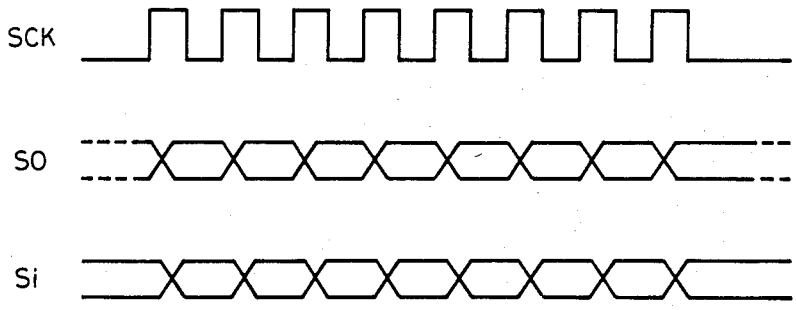
Figures 1, 13:
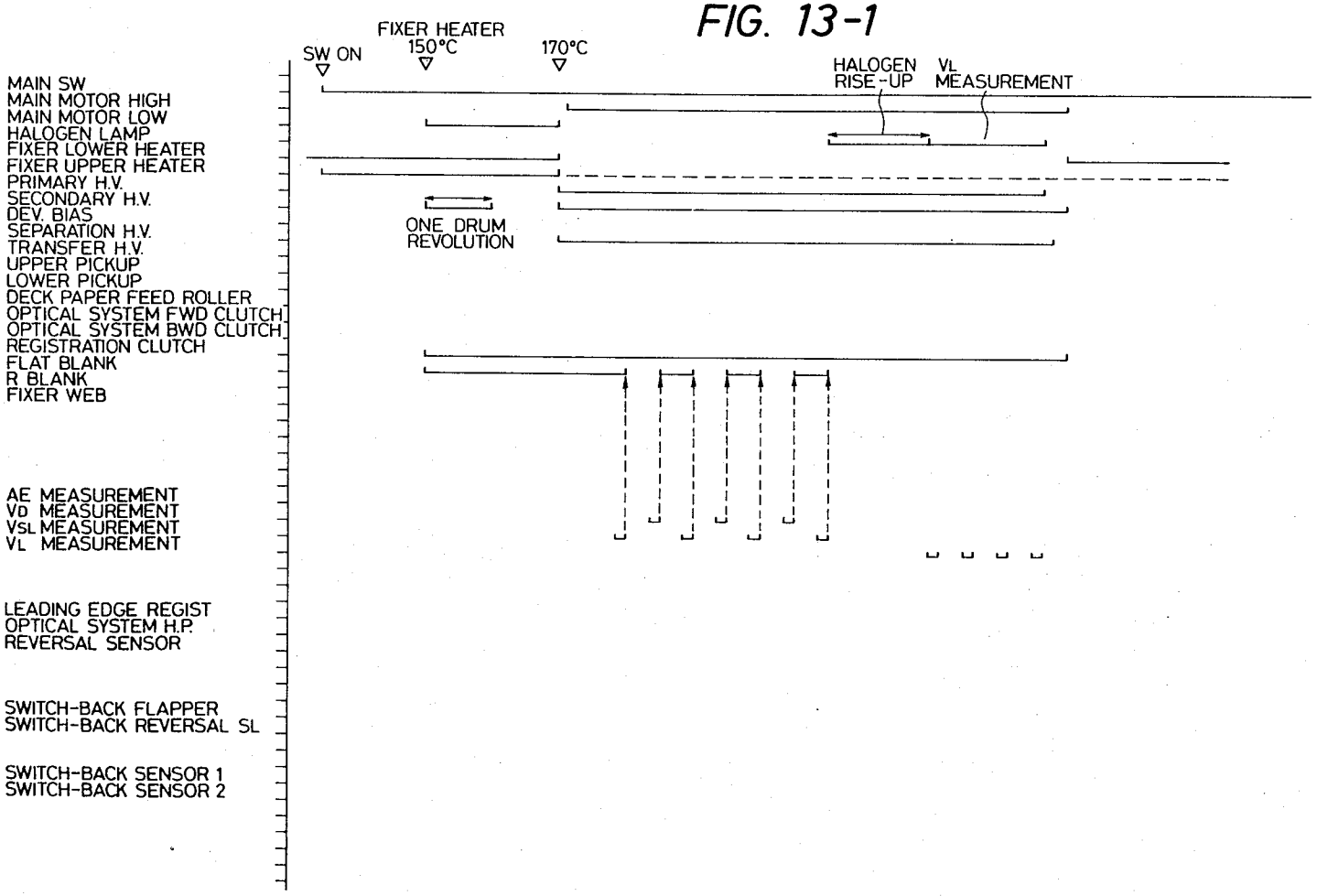
Figures 2, 13:
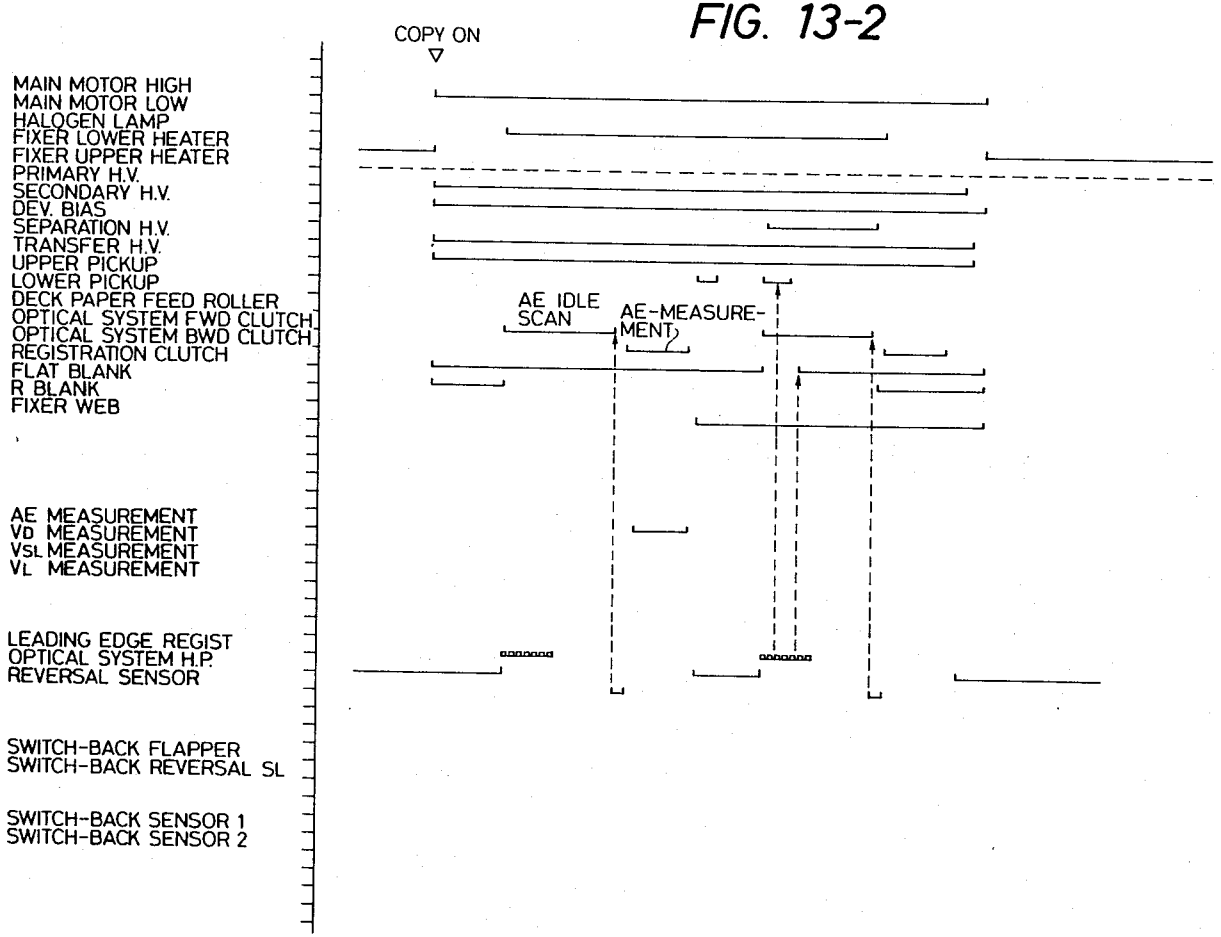
Figures 3, 13:
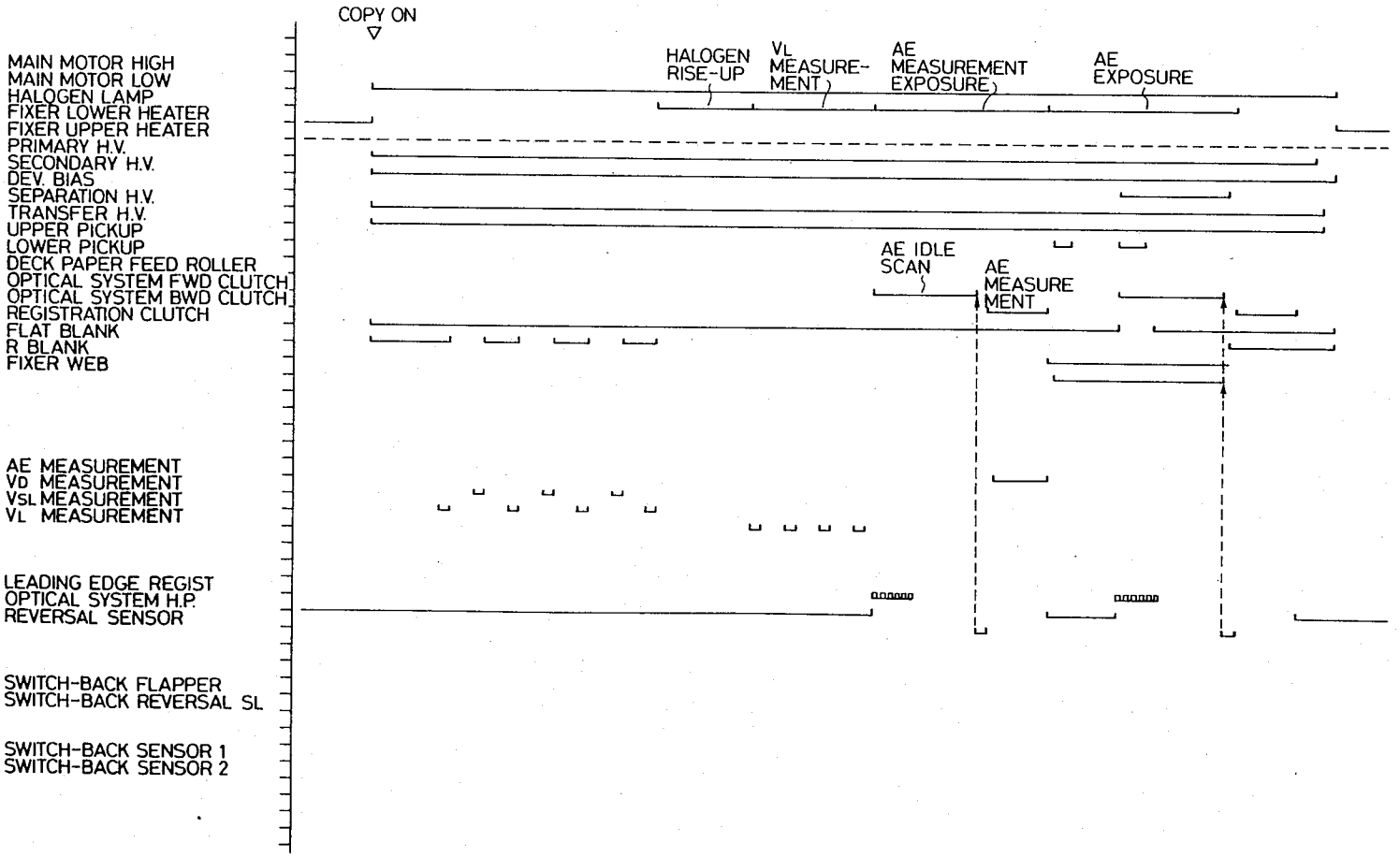
Figures 4, 13:
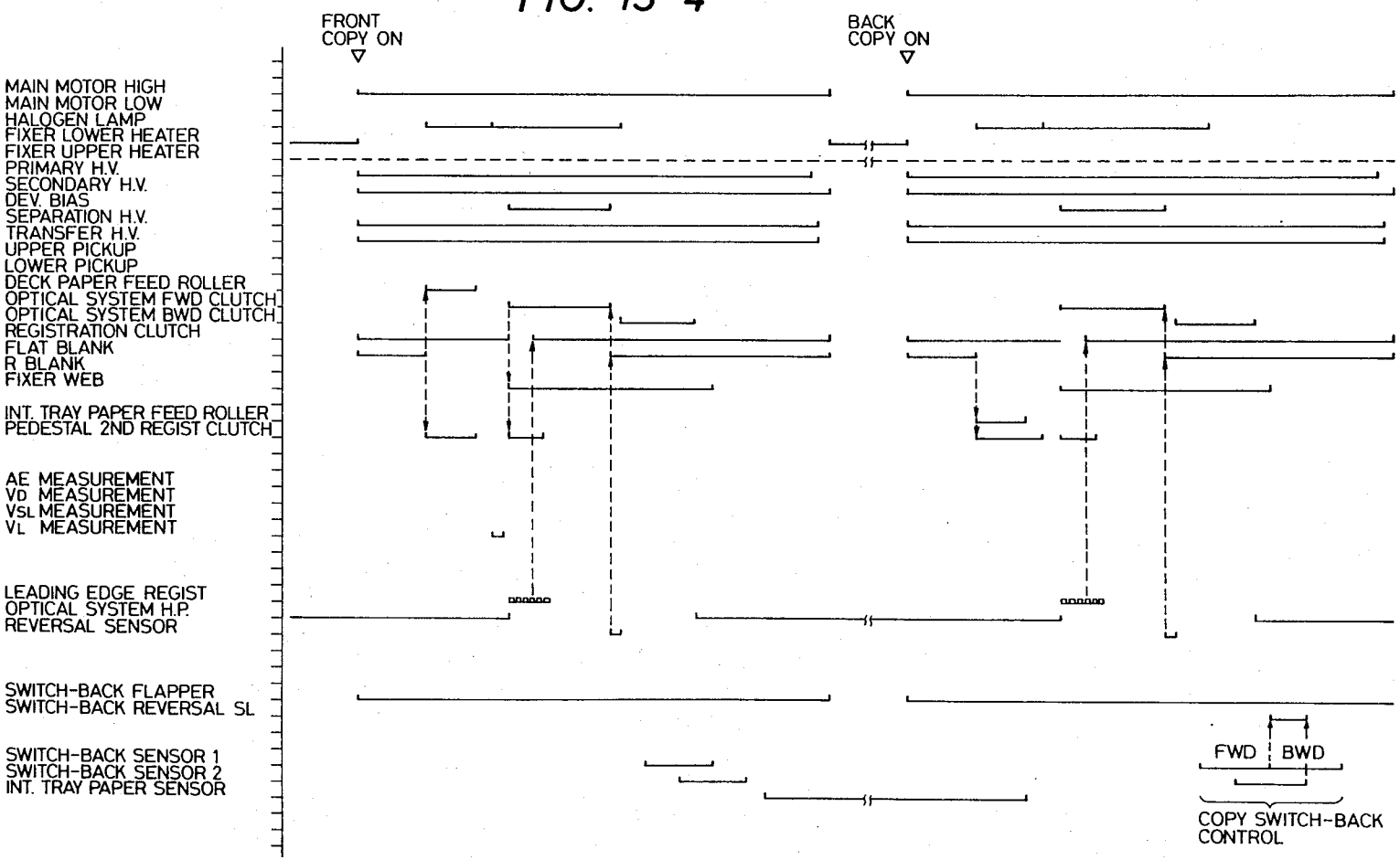

It is certified that error appears in the above-identified patent and that said Letters Patent is hereby corrected as shown below:

IN THE DRAWINGS:

SHEET 6, FIG. 3-1B, "INTEPMEDIATE" should read --INTERMEDIATE--;

SHEET 10, Fig. 4-4, "ENEGIZE" should read --ENERGIZE--;

SHEET 14, Fig. 4-13, "ENERGIRE" should read --ENERGIZE--;

SHEET 39, Fig. 4-64, "DEENEGIZE" should read --DEENERGIZE--;

SHEET 40, Fig. 4-59, "DEENRGIZE" should read --DEENERGIZE--;

SHEET 42, Fig. 4-63A, "SERVIEMAN" should read --SERVICEMAN--;

SHEET 61, Fig. 6-3, "TET" should read --SET--;

SHEET 64, Fig. 6-6, "DOUBER" should read --DOUBLE--;

SHEET 65, Fig. 6-8, "PARER" should read --PAPER--;

SHEET 68, Fig. 7-1, "DUUBLE" should read --DOUBLE--;

SHEET 69, Fig. 7-2, "FRROR" should read --ERROR--;

SHEET 72, Fig. 9-2, "DOUBLL" should read --DOUBLE--.

COLUMN 2, line 37, "reduce" should read --reduces--.

COLUMN 3, line 10, "103" should read --Q103--.

UNITED STATES PATENT AND TRADEMARK OFFICE

CERTIFICATE OF CORRECTION

PATENT NO. :4,641,954 Sheet 2 of 5

DATED :February 10, 1987

INVENTOR(S) :MASANORI MIYATA, ET AL.

It is certified that error appears in the above-identified patent and that said Letters Patent is hereby corrected as shown below:

COLUMN 5, line 3, "member" should read --number--;

line 10, "and 77" should read --and 78--;

line 26, "patterns numeral" should read --patterns. Numeral--;

line 29, "bit" should read --lit--.

COLUMN 6, line 45, "enalog" should read --analog--;

line 46, "thermister" should read --thumistor--.

COLUMN 7, line 8, "is" (second occurrence) should read --in--;

line 15, "very" should read --every--;

line 16, "1,248" should read --1.248--;

line 42, "b3" should read --$b_3$--;

line 52, "Q02" should read --Q102--.

COLUMN 8, line 68, "operator" should read --operation--.

COLUMN 10, line 14, "thermister" should read --thumistor--;

line 51, "deenergize" should read --deenergizes--.

COLUMN 11, line 49, "prots," should read --ports,--.

UNITED STATES PATENT AND TRADEMARK OFFICE

CERTIFICATE OF CORRECTION

PATENT NO. : 4,641,954 Sheet 3 of 5

DATED : February 10, 1987

INVENTOR(S) : MASANORI MIYATA, ET AL.

It is certified that error appears in the above-identified patent and that said Letters Patent is hereby corrected as shown below:

COLUMN 13, line 3, "Thermister" should read --thumistor--;

line 20, "I/0" should read --I/O--;

line 26, "I/0" should read --I/O--.

COLUMN 14, line 13, after "0" insert --shown--;

line 25, "thermister" should read --thumistor--;

line 34, "thermister" should read --thumistor--.

COLUMN 16, line 20, "S228" should read --S288--.

COLUMN 17, line 28, "45" should read --STS45--.

COLUMN 18, line 67, "drum on" should read --drum-on--.

COLUMN 19, line 67, "drums" should read --drum--.

COLUMN 23, line 38, after "S844" insert --,--;

line 40, "S868" should read --S848--;

line 42, "STS852" should read --STS85--.

COLUMN 24, line 64, "89" should read --STS89--.

UNITED STATES PATENT AND TRADEMARK OFFICE

CERTIFICATE OF CORRECTION

PATENT NO. : 4,641,954 Sheet 4 of 5

DATED : February 10, 1987

INVENTOR(S) : MASANORI MIYATA, ET AL.

It is certified that error appears in the above-identified patent and that said Letters Patent is hereby corrected as shown below:

COLUMN 25, line 36, "steps" should read --step--.

COLUMN 26, line 22, "switch back" should read --switch-back--;

line 44, after "cleared" insert --(step S1134)--;

line 49, "steps" should read --step--;

line 60, after "4(79)" insert --)--.

COLUMN 27, line 14, after "4(79)" insert --)--;

line 32, "S1186" should read --S1188--;

line 59, "In actual, the" should read --The--.

COLUMN 30, line 34, "pedestal" should read --pedestal--.

COLUMN 31, line 15, "59" should read --56--.

UNITED STATES PATENT AND TRADEMARK OFFICE

CERTIFICATE OF CORRECTION

PATENT NO. : 4,641,954 Sheet 5 of 5

DATED : February 10, 1987

INVENTOR(S) : MASANORI MIYATA, ET AL.

It is certified that error appears in the above-identified patent and that said Letters Patent is hereby corrected as shown below:

COLUMN 32, line 4, "represent" should read --represents--.

Signed and Sealed this

Eighth Day of September, 1987

*Attest:*

DONALD J. QUIGG

*Attesting Officer*

*Commissioner of Patents and Trademarks*